US007758478B2

(12) United States Patent
Golesh et al.

(10) Patent No.: US 7,758,478 B2
(45) Date of Patent: Jul. 20, 2010

(54) WEIGHT SELECTION APPARATUS FOR A WEIGHT STACK

(75) Inventors: Eric D. Golesh, Arvada, CO (US); Robert J. Smith, Louisville, CO (US); Patrick A. Warner, Boulder, CO (US); Jonathan Harrach-Salazar, Erie, CO (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 11/377,718

(22) Filed: Mar. 16, 2006

(65) Prior Publication Data

US 2006/0217245 A1 Sep. 28, 2006

Related U.S. Application Data

(60) Provisional application No. 60/663,490, filed on Mar. 17, 2005, provisional application No. 60/709,739, filed on Aug. 19, 2005.

(51) Int. Cl.
*A63B 21/06* (2006.01)
*A63B 21/062* (2006.01)

(52) U.S. Cl. ..... 482/98; 482/93; 482/94

(58) Field of Classification Search ..... 482/908, 482/108, 94, 99, 107, 97
See application file for complete search history.

(56) References Cited

U.S. PATENT DOCUMENTS

| | | | | |
|---|---|---|---|---|
| 772,906 | A | 10/1904 | Reach | |
| 1,053,109 | A | 2/1913 | Reach | |
| 3,647,209 | A | 3/1972 | La Lanne | |
| 4,453,710 | A | 6/1984 | Plötz | |
| 4,529,198 | A | 7/1985 | Hettick, Jr. | |
| 4,579,337 | A | 4/1986 | Uyeda | |
| 4,601,466 | A * | 7/1986 | Lais | 482/98 |
| 4,822,034 | A | 4/1989 | Shields | |
| 5,306,221 | A | 4/1994 | Itaru | |
| 5,348,524 | A | 9/1994 | Grant | |

(Continued)

FOREIGN PATENT DOCUMENTS

| | | | |
|---|---|---|---|
| DE | 278064 | A | 4/1990 |

(Continued)

OTHER PUBLICATIONS

U.S. Appl. No. 12/579,122, filed Oct. 14, 2009, Crawford et al.

*Primary Examiner*—Loan H Thanh
*Assistant Examiner*—Sundhara M Ganesan
(74) *Attorney, Agent, or Firm*—Dorsey & Whitney LLP

(57) ABSTRACT

Aspects of the present invention relate to a weight stack including a weight selector mechanism providing an adjustable source of resistance for use with a variety of load bearing exercise devices. The weight stack can include a plurality of weight plates stacked one on top of another. The weight selection mechanism can include a weight selector member extending through and adapted to selectively connect with each weight plate. The weight selector member can include a plurality of projections adapted to selectively engage engagement surfaces in the weight plates. A user can rotate the weight selector member with a selector knob to connect the desired number of weights to be lifted with the weight selector member. Embodiments of the weight stack can also include a locking mechanism that prevent a user from turning the weight selector member once a sufficient lifting force is applied to the selected weight plates.

12 Claims, 38 Drawing Sheets

U.S. PATENT DOCUMENTS 5,374,229 A 12/1994 Sencil
5,643,151 A 7/1997 Naimo
5,669,861 A * 9/1997 Toups ..... 482/98
5,839,997 A 11/1998 Roth et al.
5,876,313 A * 3/1999 Krull ..... 482/98
6,033,350 A 3/2000 Krull
6,083,144 A 7/2000 Towley, III et al.
6,095,955 A 8/2000 Lee
6,099,442 A 8/2000 Krull
6,117,049 A 9/2000 Lowe
6,149,558 A 11/2000 Chen
6,174,265 B1 * 1/2001 Alessandri ..... 482/5
6,186,927 B1 2/2001 Krull
6,186,928 B1 2/2001 Chen
6,193,635 B1 2/2001 Webber et al.
6,196,952 B1 3/2001 Chen
6,228,003 B1 5/2001 Hald et al.
6,261,022 B1 7/2001 Dalebout et al.
6,394,935 B1 5/2002 Lake
6,402,666 B2 6/2002 Krull
6,416,446 B1 7/2002 Krull
6,422,979 B1 7/2002 Krull
6,436,013 B1 8/2002 Krull
6,461,282 B1 10/2002 Fenelon
6,500,101 B1 12/2002 Chen
6,540,650 B1 4/2003 Krull
6,629,910 B1 * 10/2003 Krull ..... 482/98
6,669,606 B2 12/2003 Krull
6,733,424 B2 5/2004 Krull
6,746,381 B2 6/2004 Krull
6,749,547 B2 6/2004 Krull
D498,272 S 11/2004 Sanford-Schwentke et al.
6,855,097 B2 2/2005 Krull
7,077,790 B1 7/2006 Krull
7,077,791 B2 7/2006 Krull
7,121,988 B2 10/2006 Walkerdine
7,137,931 B2 11/2006 Liu
7,252,627 B2 8/2007 Carter
7,261,678 B2 8/2007 Crawford et al.
7,291,098 B1 11/2007 Krull
7,377,885 B2 5/2008 Doudiet
7,413,533 B2 8/2008 Lin
2002/0002106 A1 * 1/2002 Krull ..... 482/107
2002/0025888 A1 2/2002 Germanton et al.
2003/0148862 A1 8/2003 Chen et al.
2004/0005968 A1 * 1/2004 Crawford et al. ..... 482/106
2004/0005969 A1 1/2004 Chen
2004/0072661 A1 4/2004 Krull
2004/0220025 A1 11/2004 Krull
2005/0085351 A1 4/2005 Kissel
2005/0143228 A1 6/2005 Lee
2006/0025287 A1 * 2/2006 Chermack ..... 482/107
2006/0105889 A1 5/2006 Webb
2006/0135328 A1 6/2006 Doudiet
2006/0205571 A1 9/2006 Krull
2008/0254952 A1 10/2008 Webb

FOREIGN PATENT DOCUMENTS

EP 177643 A1 4/1986
EP 1 614 450 A1 1/2006
FR 2613237 10/1988
SE 455 573 7/1988
SU 1258447 A1 9/1986
SU 1389789 A2 4/1988

* cited by examiner 200A
222A
206A
200B
222B
206B
200C
222C
206C
200D
222D
206D
200E
222E
206E
200F
222F
206F
200G
222G
206G
200H
222H
206H
200I
222I
206I
200J
222J
206J
200K
222K
206K
200L
222L
206L
200M
222M
206M
200N
222N
206N
200O
222O
206O
200P
222P
206P
200Q
222Q
206Q
200R
222R
206R
200S
222S
206S

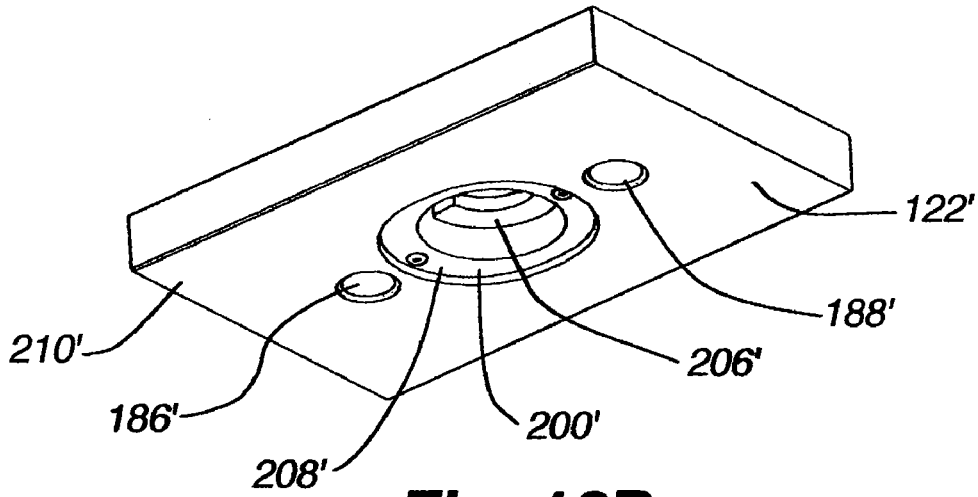
Fig. 12D
Fig. 12E
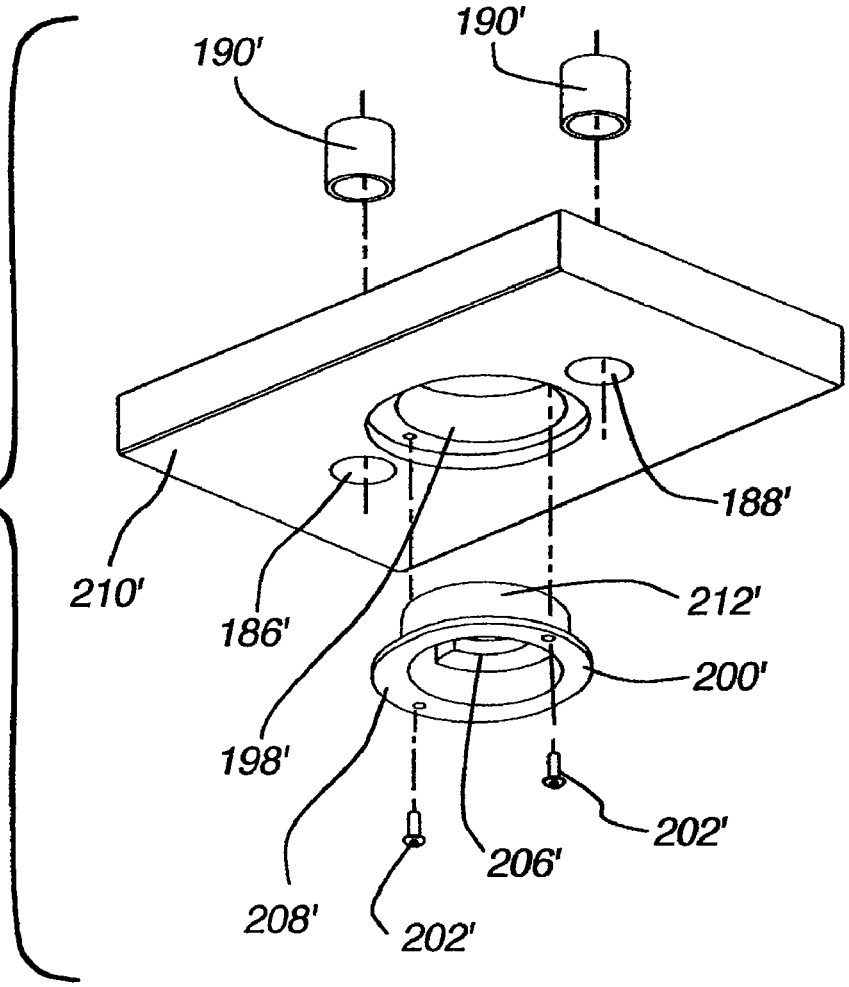

WEIGHT SELECTION APPARATUS FOR A WEIGHT STACK

CROSS-REFERENCE TO RELATED APPLICATIONS

This application claims the benefit of U.S. Provisional Application 60/663,490, filed on Mar. 17, 2005, and U.S. Provisional Application 60/709,739, filed Aug. 19, 2005, both of which are hereby incorporated herein by reference.

BACKGROUND a. Field of the Invention

Aspects of the present invention relate to exercise devices, and some more particular aspects relate to an apparatus providing the ability to conveniently select a desired number of weight plates to be lifted from a weight stack used as an adjustable source of resistance on an exercise device.

b. Background Art

Exercise equipment utilizing weight stacks as a source of resistance allow users to perform a variety of exercises. Some weight stacks include a plurality of weight plates that can be selectively connected with a resistance cable operably connected with an actuation device, such as a handle, providing a user interface with the weight stack. The level of resistance is adjusted by connecting a desired number of weight plates with the resistance cable. With some exercise equipment, weight plates are selected to be lifted by positioning a selector pin under the weight plate designating the desired load. As such, selection of a desired load requires pulling the selector pin from the weight stack and inserting the selector pin in the proper location under the desired weight. With these types of weight stack configurations, the selector pin can sometimes be difficult to remove and re-insert. In addition, the selector pin may sometimes be inserted insufficiently to safely carry the desired load. It is with these shortcomings in mind that the instant invention was developed.

BRIEF SUMMARY

Aspects of the present invention relate to a weight stack including a weight selector mechanism providing an adjustable source of resistance for use with a variety of load bearing exercise devices. Embodiments of the weight stack discussed herein include a plurality of weight plates stacked one on top of another. The weight selection mechanism can include a weight selector member extending through and adapted to selectively connect with each weight plate. In some embodiments, the weight selector member can include a plurality of tabs adapted to selectively engage collars in the weight plates. A user can rotate the weight selector member with a selector knob to connect the desired number of weights to be lifted with the weight selector member. The selector knob can be located adjacent to or remotely from the weight stack. Embodiments of the weight stack can also include a locking mechanism that prevents a user from turning the selector knob and weight selector member once a lifting force is applied to the selected weight plates.

In one aspect of the present invention, a weight stack for an exercise device includes: a plurality of weight plates each having a uniquely shaped engagement surface; an engagement assembly supported on the plurality of weight plates, the engagement assembly including a longitudinal member with a plurality of longitudinally spaced projections; wherein each unique engagement surface is arranged adjacent the longitudinal member; and wherein the longitudinal member is rotatably positionable to arrange the spaced projections for engagement with a corresponding uniquely shaped engagement surface to engage one or more of the plurality of weight plates.

In another form of the present invention, a weight stack for an exercise device includes: a first weight plate having a first aperture with a first engagement surface defining a first size; a second weight plate having a second aperture with a second engagement surface defining a second size; and an engagement assembly selectively connected with the first weight plate and the second weight plate, the engagement assembly including a rotatably supported longitudinal member including a first projection adapted to selectively engage the first engagement surface and a second projection adapted to selectively engage the second engagement surface. When the longitudinal member is in a first rotational orientation, the first projection is positioned to engage the first engagement surface and the second projection is not positioned to engage the second engagement surface; and when the longitudinal member is in a second rotational orientation, the first projection is positioned to engage the first engagement surface and the second projection is positioned to engage the second engagement surface.

In yet another form of the present invention, a weight stack for an exercise device includes: a first weight plate including a first aperture having a first engagement surface and a first slot; a second weight plate including a second aperture having a second engagement surface and a second slot; and a longitudinal member extending through and adapted to rotate relative to the first aperture and the second aperture, the longitudinal member including a first projection adapted to engage the first engagement surface and a second projection adapted to engage second engagement surface. When the longitudinal member is in a first rotational orientation, the first projection is aligned with the first engagement surface and the second projection is aligned with the first slot and the second slot, and when the longitudinal member is in a second rotational position, the first projection is aligned with the first engagement surface and the second projection is aligned with the second engagement surface.

In still another form of the present invention, a weight stack for an exercise device includes: a plurality of weight plates each having a uniquely shaped engagement surface; a means for selectively engaging each uniquely shaped engagement surface supported on the plurality of weight plates; and a means for rotating the means for selectively engaging.

The features, utilities, and advantages of various embodiments of the invention will be apparent from the following more particular description of embodiments of the invention as illustrated in the accompanying drawings and defined in the appended claims.

BRIEF DESCRIPTION OF THE DRAWINGS

FIG. 12D is a bottom isometric view of the weight plate shown in FIG. 12B.

FIG. 12E is an exploded view of the weight plate shown in FIG. 12D.

DETAILED DESCRIPTION

Aspects of the present invention relate to a weight stack including a weight selector mechanism for implementation with a variety of load bearing fitness equipment machines. For example, weight stacks according aspects of the present invention can be used for providing a load to fitness equipment that allow exercise of a user's arms, chest, legs, back, shoulders, neck, or any other type of exercise equipment utilizing a weight stack structure for loading purposes. Embodiments of the weight stack discussed herein include a plurality of weight plates stacked one on top of another. Each weight plate can also include a pair of apertures through which guide rods are positioned for guiding vertical motion of the weight plates. In addition, each weight plate can include an aperture with a collar positioned therein. As discussed in more detail below, the weight selection mechanism can include a weight selector member extending through each collar. The weight selector member can include a plurality of tabs or projections adapted to selectively engage an engagement surface on each collar. As such, the weight selector member can be rotated within the collars to selectively engage the tabs with a desired number of weight plates to be lifted during exercise. A selector knob operably connected with the weight selector member allows a user to rotate the weight selector member. In addition, embodiments of the weight stack can also include a locking mechanism that prevents a user from turning the selector knob and weight selector member once a lifting force is applied to the selected weight plates. As such, the locking mechanism helps to prevent a user from disengaging weight plates from the weight selector member while lifting forces are applied to the weight stack.

Figure 1A:
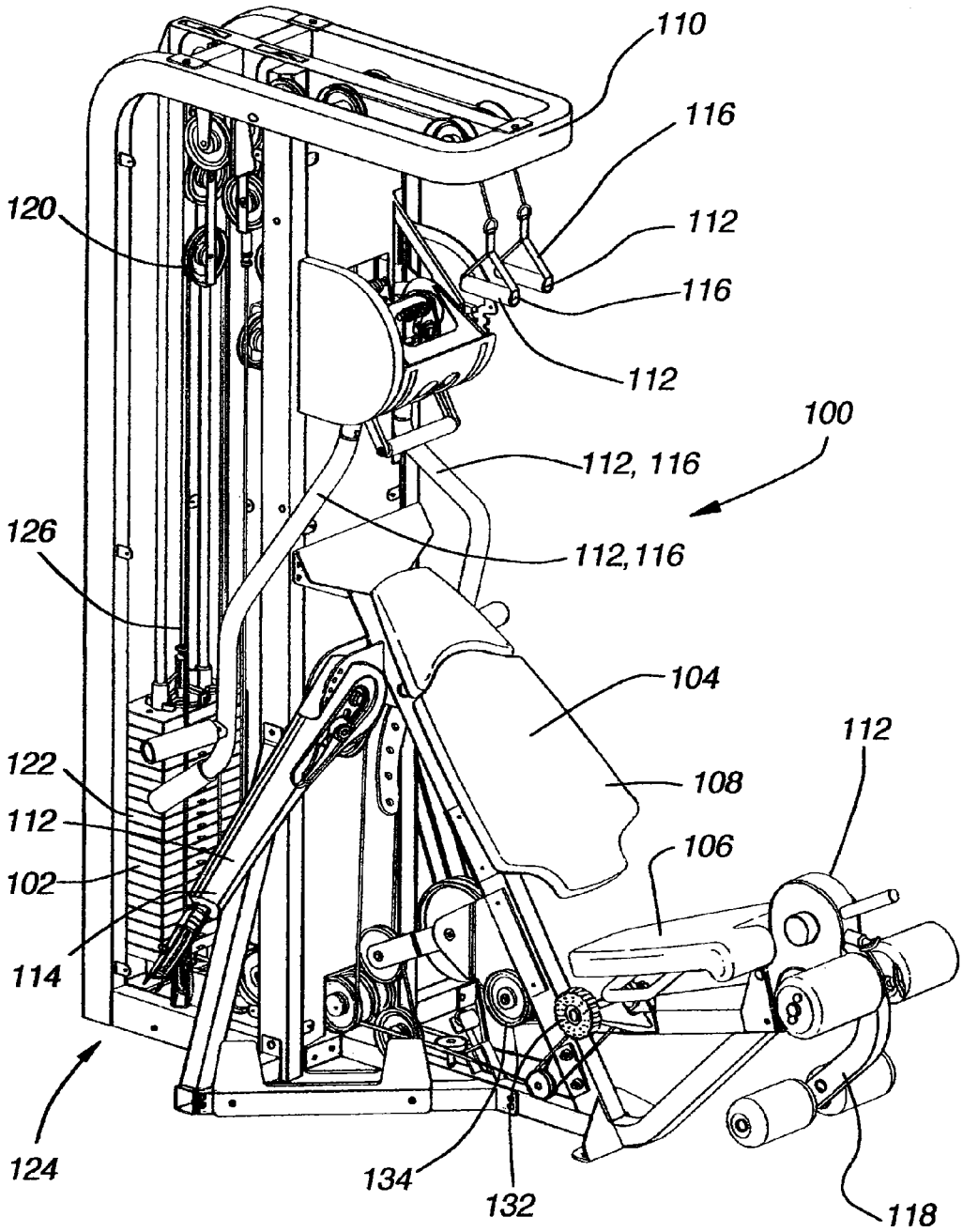
FIG. 1A is a right front isometric view of an exercise device including a weight stack according to aspects of the present invention.
Figure 1B:
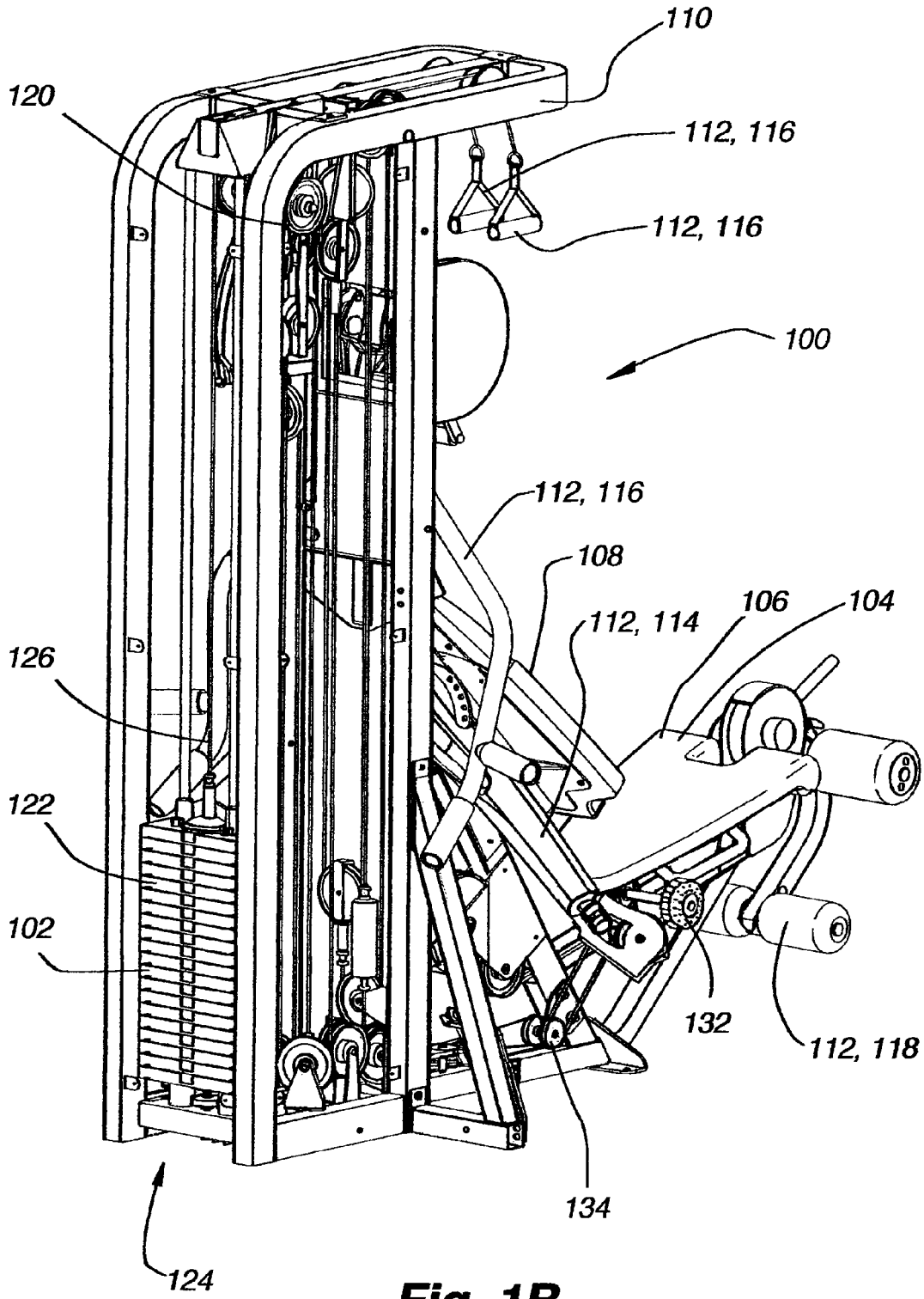
FIG. 1B is a right rear isometric view of the exercise device including the weight stack of FIG. 1A.

FIGS. 1A and 1B show one example of an exercise device 100 including one embodiment of a weight stack 102 conforming to aspects of the present invention. It is to be appreciated that the weight stacks described and depicted herein can be used with a variety of different exercise devices other than what is shown and described herein. As shown in FIGS. 1A and 1B, the exercise device 100 includes a user support 104 including a seat 106 and a back support 108 connected with a frame 110. The frame 110 supports various types of actuation devices 112, such as arm assemblies 114, handles 116, and a leg extension station 118, connected with a resistance cable-pulley assembly 120, providing a user interface with the weight stack 102. As such, the resistance cable-pulley assembly 120 operably connects the weight stack 102 with various types of actuation devices. In turn, the weight stack 102 provides a source of resistance to a user while performing various exercises with the exercise device 100. The weight stack 102 includes a plurality of weight plates 122 stacked one on top of another. Although the weight stack shown in FIGS. 1A and 1B includes 20 weight plates (122A through 122T referenced in FIG. 2A), it is to be appreciated that other embodiments can include more or less than 20 weight plates. As discussed in more detail below, a user can set a desired resistance by operating an engagement assembly or a weight selector assembly or mechanism 124 to select a desired number of weight plates 122 to lift during exercise.

Figure 1C:
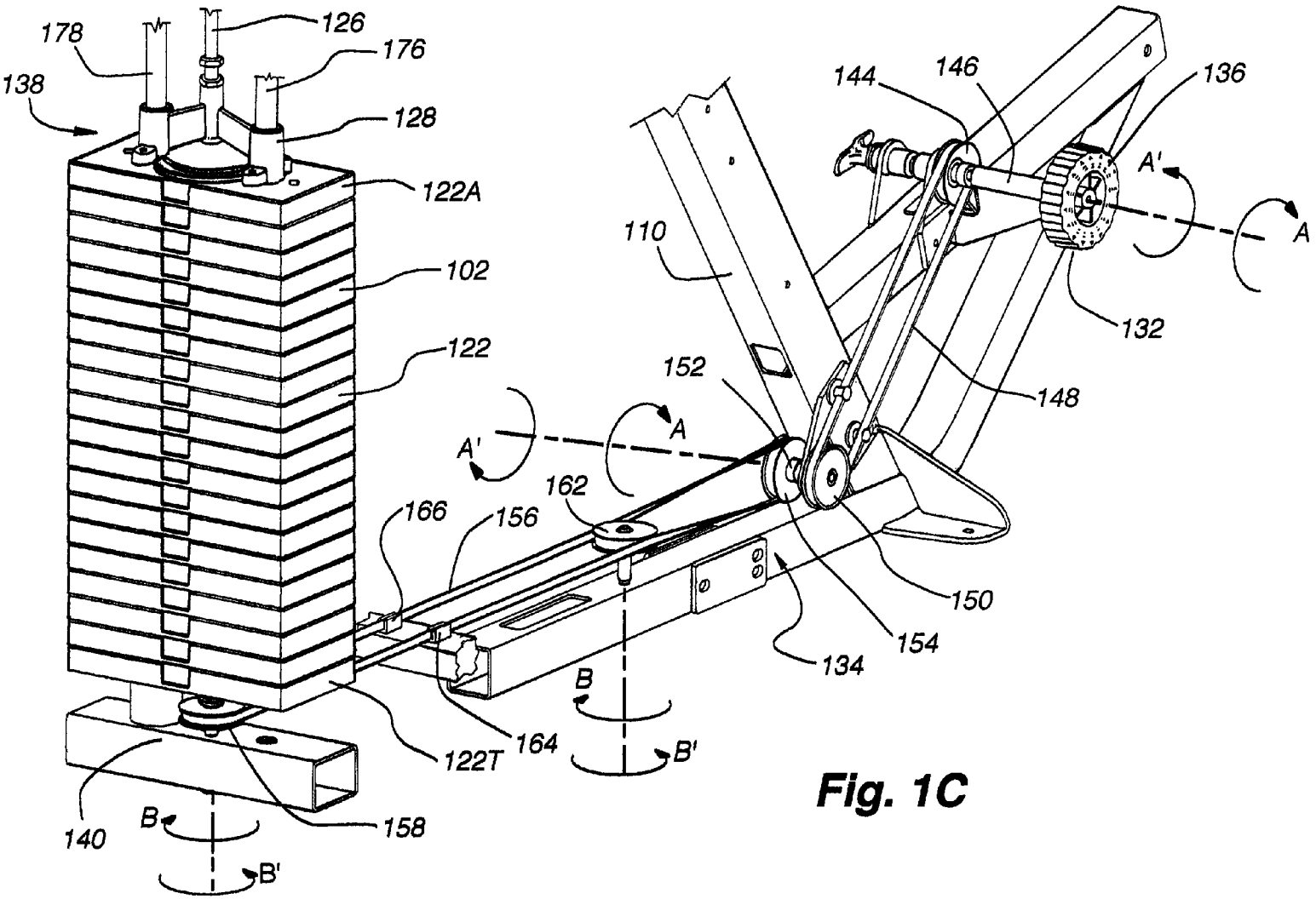
FIG. 1C is a detailed view of a selector knob and a belt-pulley assembly operably connected with the weight stack.

As previously mentioned and as shown in FIGS. 1A and 1B, the weight stack 102 can be operably connected with various user actuation devices 112 through the resistance cable-pulley assembly 120 supported by the frame 110 of the exercise device 100. FIGS. 1B and 1C show detailed views of a lift or resistance cable 126 connected with the weight stack 102. A user can perform exercises on the exercise device by exerting forces on one or more of the actuation devices, which are translated through the resistance cable and to the weight stack. As shown in FIG. 1C, the resistance cable 126 is connected with a lift member 128, which in turn, is connected with a top or first weight plate 122A. Forces exerted on the resistance cable by the user, in turn, can act to lift and lower the first weight plate 122A along with a selected number of additional weight plates 122 on the weight stack 102.

As discussed in more detail below, the weight selector assembly 124 includes a selector knob 132 that allows a user to choose a desired resistance level by selecting a desired number of weight plates 122 to lift. Although a selector knob is described, it is to be appreciated that various forms of gripping members can be used to adjust select the desired weight, such as a handle and the like. As shown in FIGS. 1A-1C, the selector knob 132 is located near the user seat 106 and is operably coupled with the weight stack 102 through a belt-pulley assembly 134. The location of the selector knob 132 on the exercise device 100 allows a user seated on the user support 104 to conveniently adjust the exercise resistance while seated on the user support. It is to be appreciated that the selector knob can be located in various locations other than what is shown in FIGS. 1A-1C. As shown in FIG. 1C, indicia or markings 136 can be located on the selector knob 132 that correspond with the various available weight selections. As such, a user can determine the amount of weight selected to be lifted by aligning one of the markings with a specified fixed location, such as an indicator pin (not shown) affixed to the frame 110 of the exercise device 100.

Figure 2A:
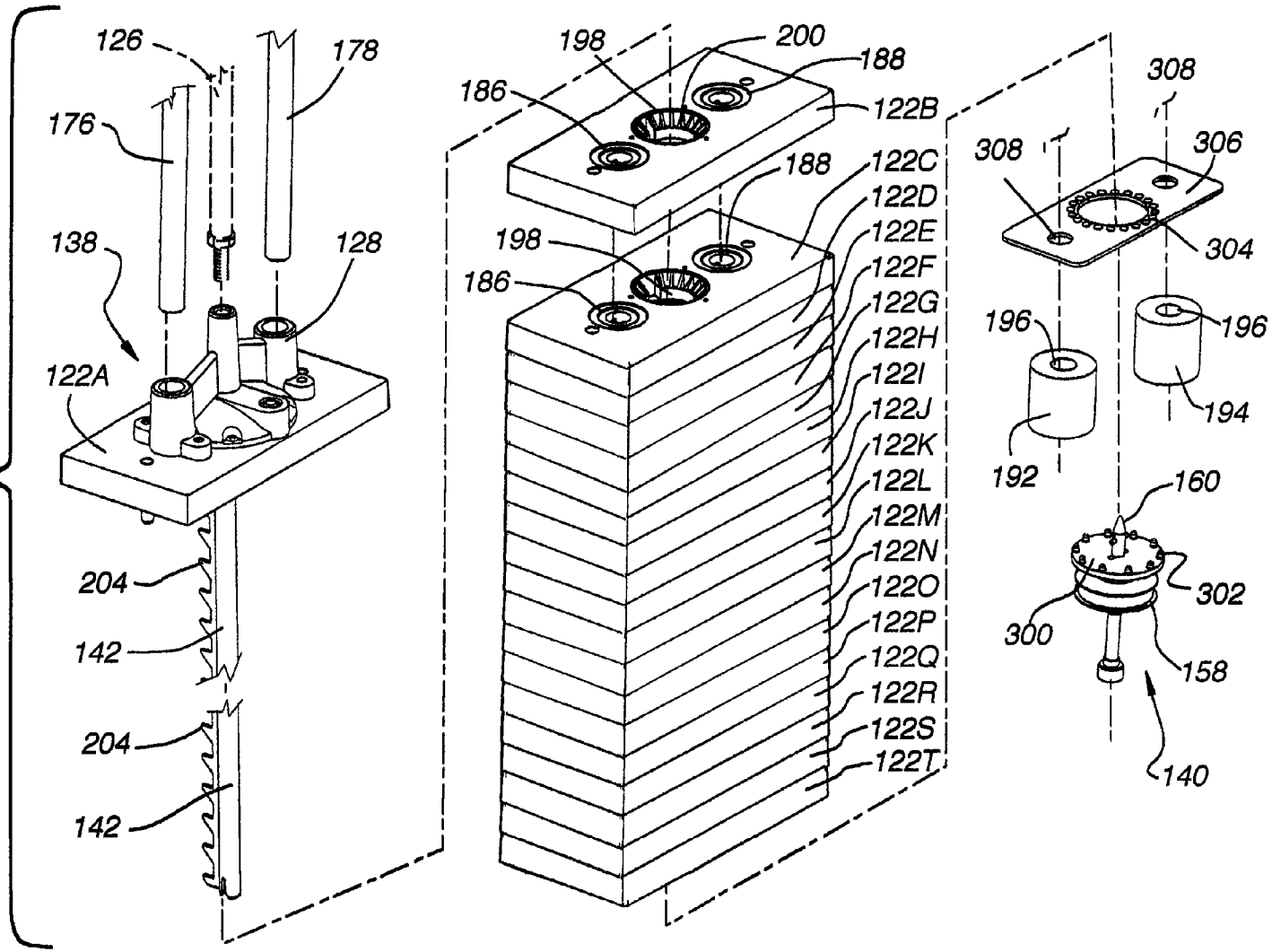
FIG. 2A is an exploded view of the weight stack shown in FIGS. 1A-1C.
Figure 2B:
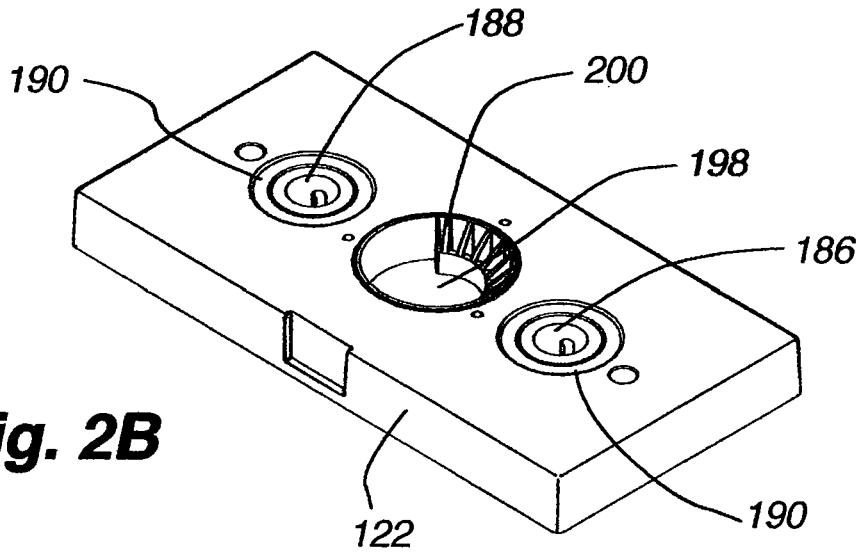
FIG. 2B is a top rear isometric view a weight plate.
Figure 2C:
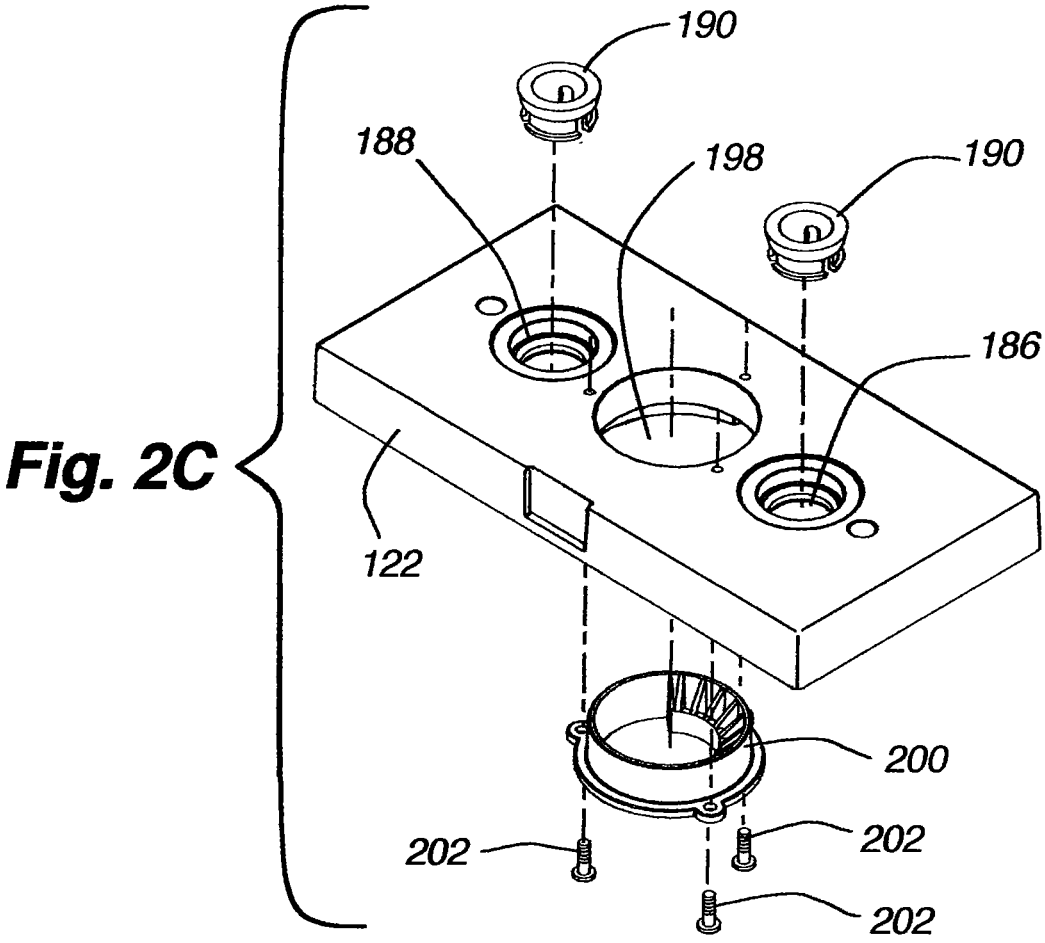
FIG. 2C is an exploded view of the weight plate shown in FIG. 2B.

As shown in FIGS. 1C and 2A, the weight selector mechanism 124 interfaces with an upper locking mechanism or assembly 138 and a lower locking mechanism or assembly 140, both of which are operably connected with a weight selector member 142. When the weight stack 102 is in an "at rest" state (i.e. no weights are being lifted), the lower locking assembly 140 is connected with the weight selector member 142 and the upper locking assembly 138. As discussed in more detail below, the desired amount of weight to be lifted is selected by rotating the selector knob 132, which in turn, causes the weight selector member 142 to rotate to selectively engage the weight selector member with a desired number of weight plates. When forces are applied to the weight stack 102 to lift the selected number of weight plates, such as during exercise, the upper and lower locking assemblies prevent a user from turning the selector knob and the weight selector member. As such, the locking assemblies help prevent weight plates from being disengaged from the weight selector member while lifting forces are applied to the weight stack.

As previously mentioned, the belt-pulley assembly 134 operably connects the selector knob 132 with the weight stack 102, and more particularly, the lower locking assembly 140 and weight selector member 142. As shown in FIG. 1C, the selector knob 132 and a first pulley 144 are connected with a selector knob axle 146, which is rotatably supported by the frame 110 of the exercise device 100 near the seat 106. As such, the selector knob 132 and the first pulley rotate 144 together. A first belt 148 connects the first pulley 144 with a second pulley 150 connected with a first pulley axle 152, which is rotatably supported by the frame 110. A third pulley 154 is also connected with the first pulley axle 152, and as such, the second pulley 150 and third pulley 154 rotate together. A second belt 156 connects the third pulley 154 with a weight stack pulley 158, which in turn, is connected with the lower locking assembly 140. As discussed in more detail below with reference to FIGS. 2A, 6B, 6C, and others, the weight stack pulley 158 is connected with a lower shaft 160 in the lower locking assembly 140, which in turn, is selectively connected with the weight selector member 142. As shown in FIG. 1C, the third pulley 154 rotates about a substantially horizontal axis of rotation and the weight stack pulley 158 rotates about a substantially vertical axis of rotation. As such, the second belt 156 twists as the second belt extends between the third pulley 154 and the weight stack pulley 158. Therefore, the second belt 156 is routed over an idler pulley 162 as well as through first and second belt guides 164, 166 connected with the frame 110 to help guide and align the second belt with the third pulley and the weight stack pulley.

Because the selector knob 132 is operably connected with the weight stack pulley 158, rotation of the selector knob causes the weight stack pulley to rotate. In one example, rotation of the selector knob 132 in a clockwise direction (direction A in FIG. 1C) rotates the first pulley 144 in the same clockwise direction. Rotation of the first pulley 144 in the clockwise direction, in turn, causes the second pulley 150 to rotate in the clockwise direction (direction A in FIG. 1C), which also rotates the third pulley 154 in the same clockwise direction. Rotation of the third pulley 154 in the clockwise direction, in turn, causes the weight stack pulley 158 and the idler pulley 162 to rotate in a counterclockwise direction (as viewed from the bottom of the weight stack pulley and idler pulley and shown as direction B in FIG. 1C). Alternatively, rotation of the selector knob 132 in a counterclockwise direction (direction A' in FIG. 1C) rotates the first pulley 144 in the same counterclockwise direction. Rotation of the first pulley 144 in the counterclockwise direction, in turn, causes the second pulley 150 to rotate in the counterclockwise direction (direction A' in FIG. 1C), which also rotates the third pulley 154 in the same counterclockwise direction. Rotation of the third pulley 154 in the counterclockwise direction, in turn, causes the weight stack pulley 158 and the idler pulley 162 to rotate in a clockwise direction (as viewed from the bottom of the weight stack pulley and idler pulley and shown as direction B' in FIG. 1C). As discussed in more detail below, when the weight stack 102 is in the "at rest" condition, rotation of the weight stack pulley 158 causes the lower shaft 160 and the weight selector member 142 to rotate, which selectively engages the weight selector member with a desired number of weight plates to be lifted.

It is to be appreciated that other belt-pulley configurations having more or less pulleys and/or belts can be utilized in other embodiments of the present invention. It is also to be appreciated that other embodiments need not use belts or cables and pulleys to operably connect the selector knob with the lower locking mechanism. For example, other embodiments can utilize sprockets and chains and/or various arrangements of gears or other transmission means. In addition, as previously mentioned, the selector knob can be located in various other locations on the exercise device or the weight stack, which may require corresponding changes to the connection structure between the selector knob and the weight stack. Additionally, in other embodiments, a motor or servo can be attached to the weight selector member and be controlled wirelessly by a remote selector control knob, button, and the like. Further, the belt-pulley assembly can be configured with different gear ratios such that the rotation of the selector knob can have different rotational effects on the rotation of the weight selector member. For example, the belt-pulley assembly can be configured such that the rotation of the selector knob can have a one-to-one effect on the rotation of the weight selector member. Other embodiments of the belt-pulley assembly configured differently so that the ratio can be greater than or less than one-to-one.

As discussed in more detail below, the weight stack 102 shown in FIGS. 1A-2A allows a user to select a desired number of weight plates 122 to lift by turning the selector knob 132. Rotation of the selector knob 132, in turn, rotates the weight selector member 142 to selectively engage the weight selector member with a desired number of weight plates to lift. As a user performs exercises, forces exerted on the resistance cable 126 connected with the top or first weight plate 122A lift and lower the first weight plate along with a selected number of additional weight plates 122 engaged with the weight selector member 142. As weight plates are being lifted and lowered, the upper and lower locking assemblies 138, 140 prevent rotation of the selector knob 132 and weight selector member 142. FIG. 2A shows an exploded view of the weight stack 102 shown in FIGS. 1A-1C along with the upper and lower locking mechanisms 138, 140, the weight selector member 142, and the plurality of weight plates 122.

Figure 4A:
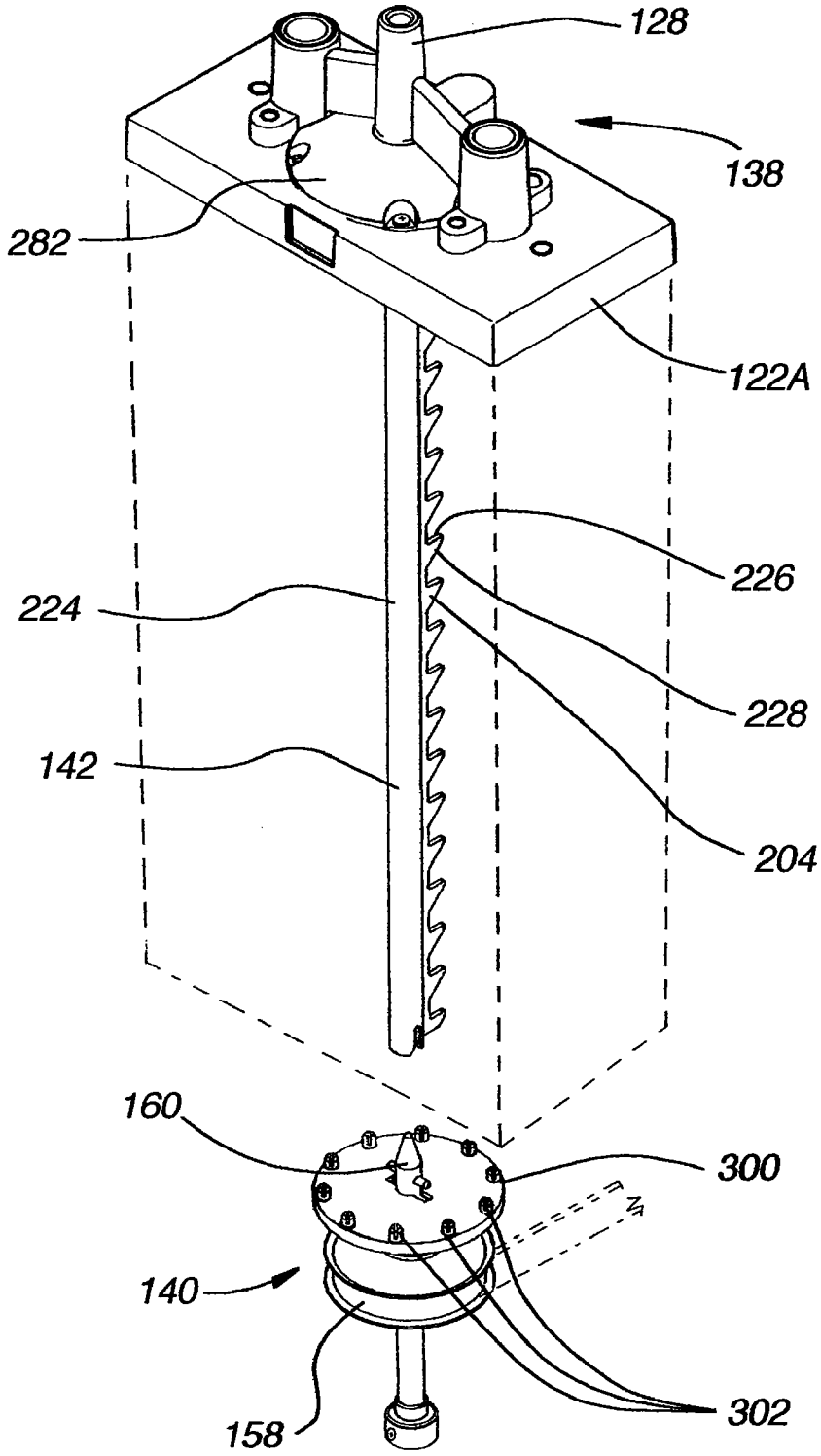
FIG. 4A is an isometric view of an upper locking assembly, top weight plate, lift member, weight selector member, and lower locking assembly.
Figure 4B:
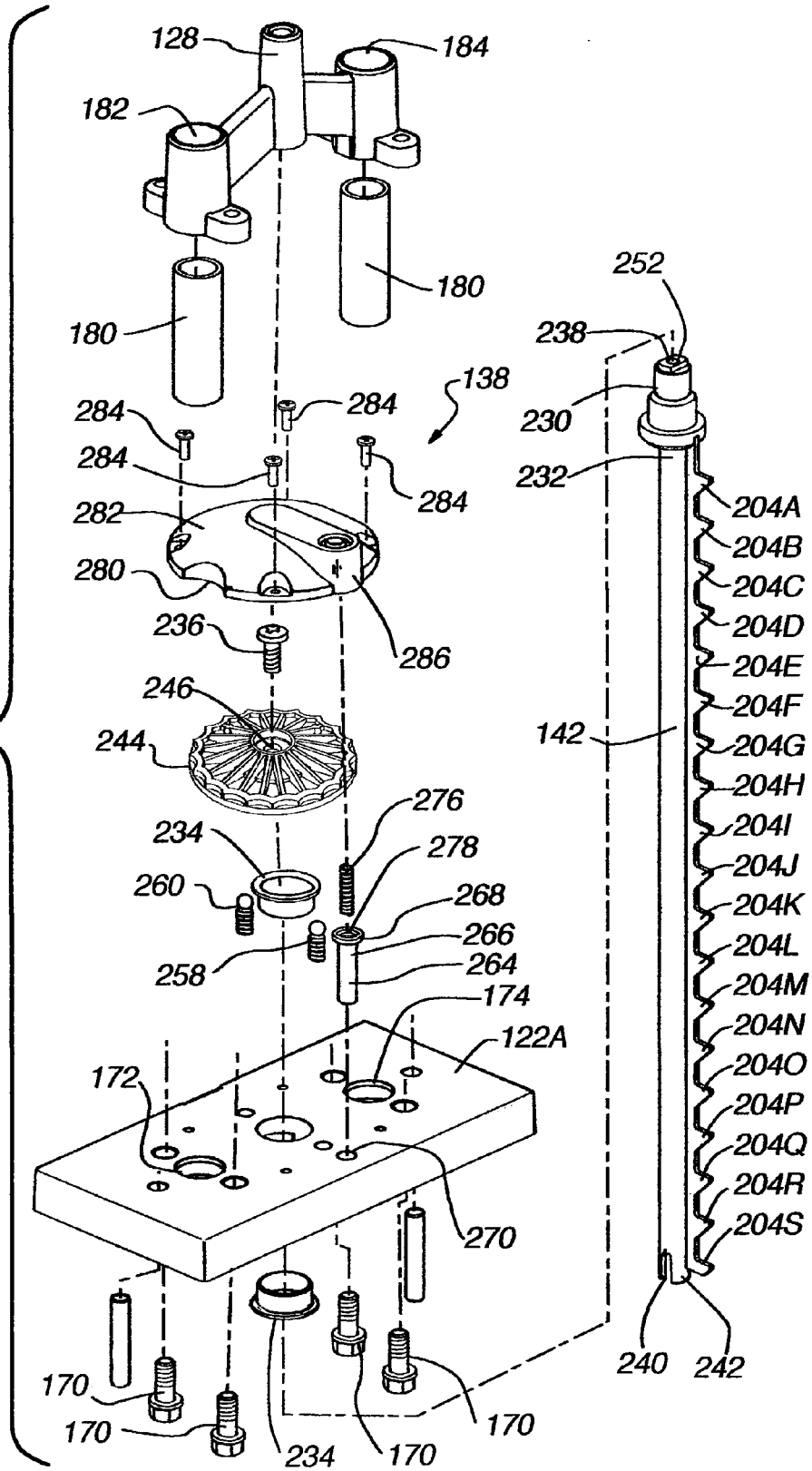
FIG. 4B is an exploded view of the upper locking assembly, top weight plate, lift member, and weight selector member shown in FIG. 4A.

As discussed above with reference to FIGS. 1C and 2A, the resistance cable 126 is connected with the top weight plate 122A through the lift member 128. As shown in FIGS. 4A and 4B, four bolts 170 extending upward through the top weight plate 122A connect the lift member 128 to the top weight plate 122A. As sufficient forces are applied to the resistance cable 126, the top weight plate 122A moves up and down with the resistance cable 126. As shown in FIG. 4B, the top weight plate 122A includes first and second guide rod apertures 172, 174 through which first and second guide rods 176, 178 extend. Guide rod bushings 180 positioned in first and second apertures 182, 184 of the lift member 128 and first and second guide rod apertures 172,174 in the top weight plate 122A provide for a low friction engagement between the top weight plate and the guide rods. As shown in FIGS. 1C and 2A, the first and second guide rods 176, 178 also extend through the weight plates (122B through 122T) positioned under the top weight plate 122A. As previously mentioned, the guide rods 176, 178 help guide the vertical motion of the weight plates 122. As shown in FIGS. 2A-2E, the weight plates (122B through 122T) have first and second guide rod apertures 186, 188 through which the first and second guide rods 176, 178 extend. Guide rod bushings 190 positioned in the first and second guide rod apertures allow for a low friction engagement between the weight plates 122 and the guide rods 176, 178. The weight plates 122 are supported by first and second cylindrically-shaped bumpers 192, 194 having guide rod apertures 196 adapted to receive end portions of the first and second guide rods 176, 178, respectively.

As shown in FIGS. 2A-2E, each weight plate 122 also includes an aperture 198 through which the weight selector member 142 extends. Although the apertures 198 are shown as being centrally located in the weight plates 122, it is to be appreciated that the apertures can be positioned in other locations on the weight plates. As shown in FIG. 2A, the weight stack 102 includes 20 weight plates (122A through 122T), with 19 of the weight plates (122B through 122T) each having a weight plate collar (200A through 200S shown in FIG. 3A) positioned in the aperture 198. As discussed in more detail below, the weight selector member 142 is rotatably connected with the top or first weight plate 122A, and as such, does not include a weight plate collar. As shown in FIGS. 2B-2E, the weight plate collars (200A through 200S) are held in the central apertures 198 of the weight plates (122B through 122T) by three screws 202. It is to be appreciated that other types of fastening structures can also be used to secure the weight plate collars to the weight plates. In addition, the weight plate collars may be formed integrally with the weight plates.

Figure 2D:
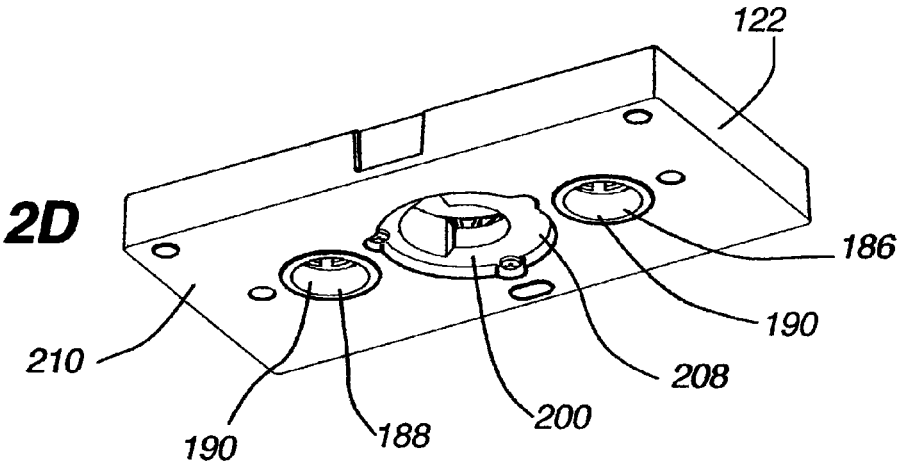
FIG. 2D is a bottom rear isometric view of the weight plate shown in FIG. 2B.
Figure 2E:
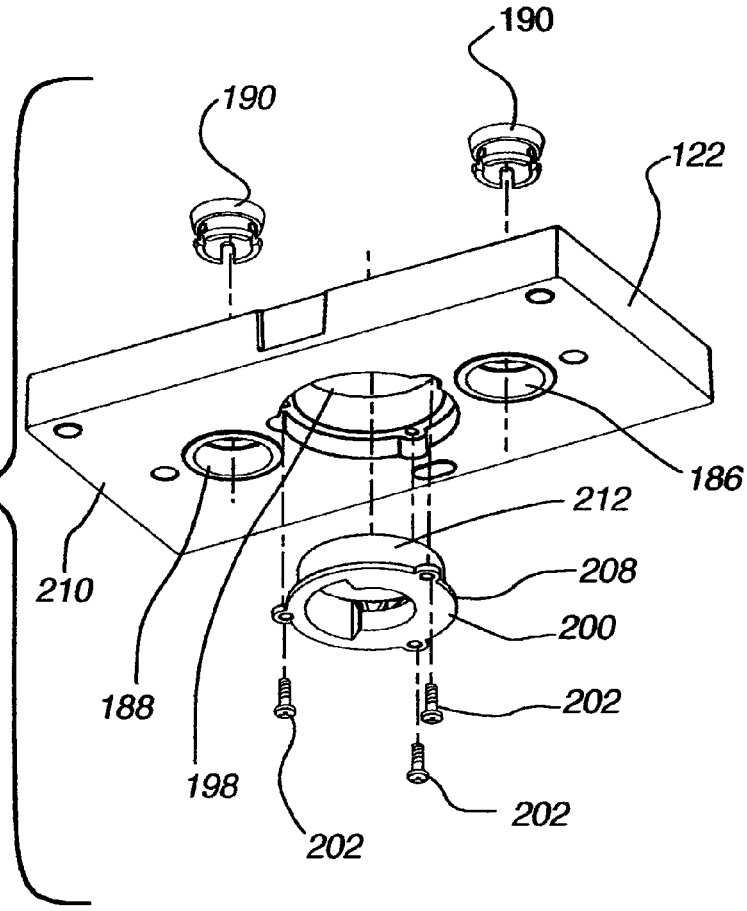
FIG. 2E is an exploded view of the weight plate shown in FIG. 2B.
Figure 3A:
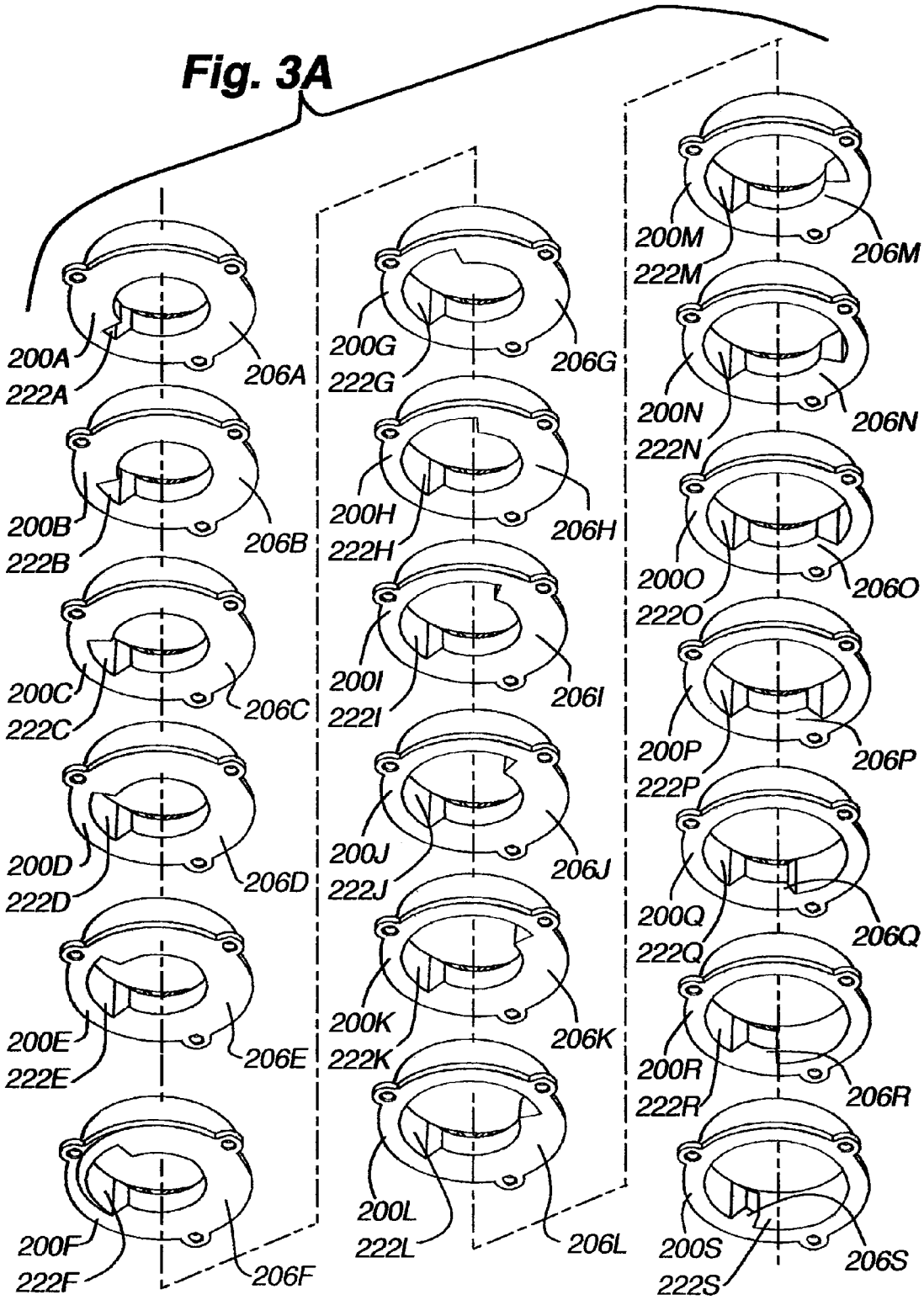
FIG. 3A shows bottom isometric views of the plurality of weight stack collars used in the weight stack.
Figure 3C:
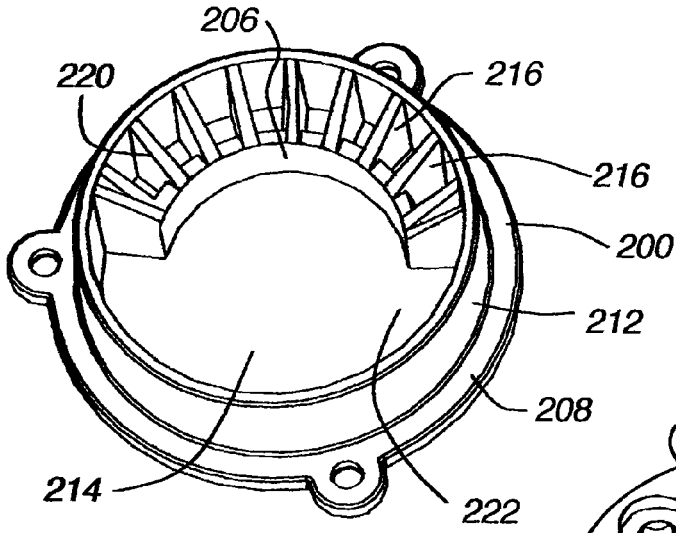
FIG. 3C is a top isometric view of the weight plate collar shown in FIG. 3B.
Figure 3E:
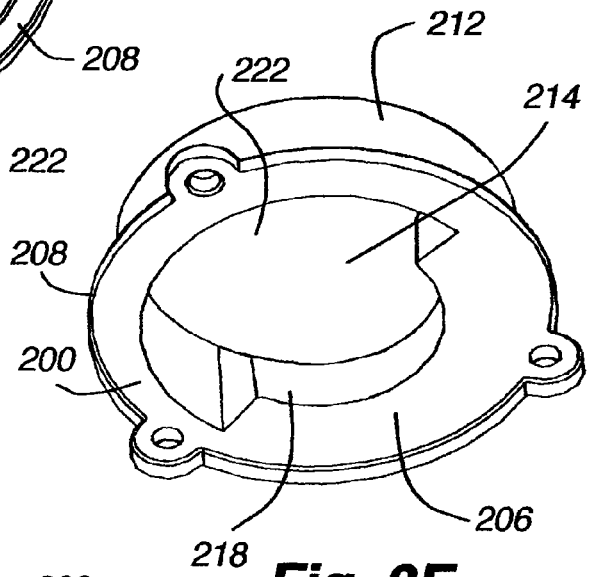
FIG. 3E is a bottom isometric view of the weight plate collar shown in FIG. 3B.
Figure 3B:
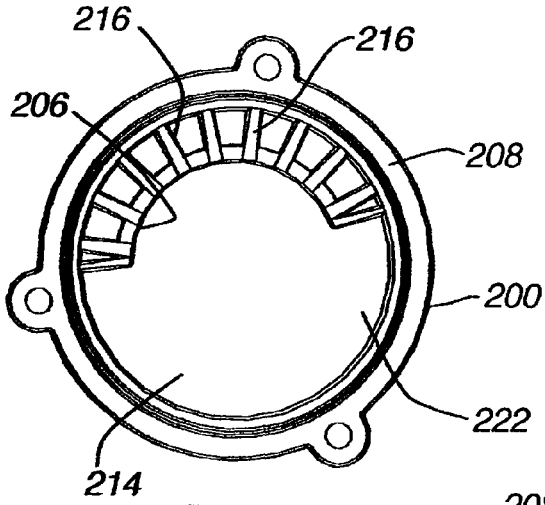
FIG. 3B is a top view of a weight plate collar.
Figure 3D:
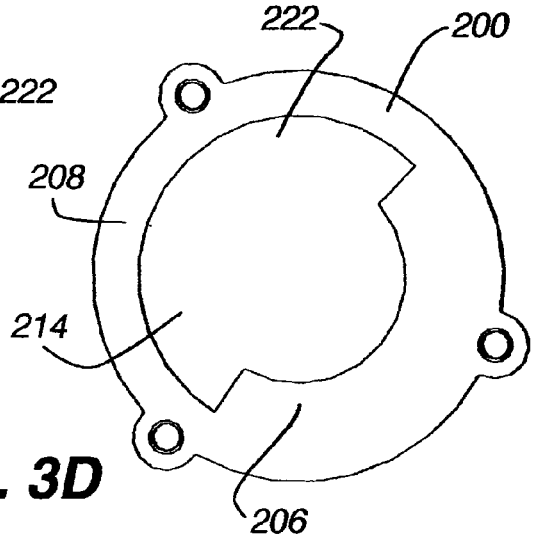
FIG. 3D is a bottom view of the weight plate collar shown in FIG. 3B.

As discussed in more detail below with reference to FIGS. 2A, 4B, and others, the weight selector member 142 includes a plurality of projections or tabs 204 adapted to selectively engage the weight plate collars 200 to select the desired number of weight plates 122 to be lifted. In particular, the weight selector member 142 includes 19 tabs (204A-204S shown in FIG. 4B) adapted to engage corresponding weight plate collars (200A-200S shown in FIG. 3A). The weight selector member 142 is rotated to place the tabs 204 into alignment with engagement surfaces which may be in the form of inner flanges 206 on the weight plate collars 200. As such, a particular weight plate is selected to be lifted when one of the tabs on the weight selector member rotated into alignment with the flange on the weight plate collar connected the particular weight plate. As shown in FIGS. 3A-3E, the weight plate collars 200 each include an outer bottom flange 208 adapted to engage a bottom surface 210 of each weight plate 122, as shown in FIGS. 2D and 2E. It is to be appreciated that the outer bottom flanges of the weight plate collars can have virtually any shape that allows for attachment of the weight plate collars to the weight plates while positioned within the apertures 198 of the weight plates (122B through 122T). Referring to FIGS. 2D-3E, a raised cylindrical middle portion 212 extending upward from the bottom flange 208 is adapted to be received within the aperture 198 in the weight plates (122B through 122T). The inner flange 206 extends radially inward from the raised cylindrical middle portion 212, defining an aperture 212 through which the weight selector member 142 extends. As shown in FIGS. 3B and 3C, the inner flange 206 also includes a plurality of brace structures 216 to help strengthen the inner flange. The inner flange 206 also defines a cylindrically-shaped lower portion 218 and an outwardly sloped an upper portion 220, which corresponds with the cross-sectional shape of the weight selector member 142. As shown in FIGS. 3A-3E, the inner flange 206 of each weight plate collar 200 extends at least partially around the circumference of the inside of the raise cylindrical middle portion 212, defining a slot 222 between opposing end portions of the inner flange 206. As discussed in more detail below, when one of the tabs 204 on the weight selector member 142 is aligned below the inner flange 206 on a particular weight plate, the weight plate is selected to be lifted. Alternatively, when one of the tabs on the weight selector member is aligned with the slot 222 on a particular weight plate, the weight plate is not selected to be lifted.

Except for the top weight plate 122A, the weight plates (122B through 122T) in the weight stack 102 each include weight plate collars 200 with flanges 206 and slots 222 having different lengths. For example, FIG. 3A shows a bottom isometric view of embodiments of the weight plate collars 200 used in the weight stack 102. As previously mentioned, the weight stack includes 20 weight plates (122A through 122T), with 19 of the weight plates (122B through 122T) having weight plate collars (200A through 200S). The weight selector member 142 is rotatably connected with the top or first weight plate 122A and is always lifted with the weight selector member. As such, the top or first weight plate 122A does not include a weight plate collar. Therefore, referring to FIGS. 2A and 3A, the first or top weight plate collar 200A is positioned in the second weight plate 122B from the top, and the $19^{th}$ or bottom weight plate collar 200S is positioned in the $20^{th}$ weight plate 122T from the top (i.e. the bottom weight plate). From the top collar 200A to the bottom collar 200S in FIG. 3A, the lengths of the inner flanges 206 and slots 222 change from a relatively long flange 206A and a relatively short slot 222A (shown in the top weight plate collar 200A) gradually to a relatively short flange 206S and a relatively long slot 222S (shown in the bottom weight plate collar 200S).

It is to be appreciated that weight plate collars 200 with varying inner flange and slot lengths can be used with various embodiments of the weight stack 102. FIGS. 3B-3E shows various detailed views of the weight plate collar 200 with the inner flange 206 and slot 222 having lengths indicative of a weight plate collar used in the middle portion of the weight stack where the weight selector member 142 is oriented to have a particular corresponding tab 204 to engage the inner flange in several rotational orientations. As such, a weight plate collar used in the lower portion of the weight stack 102 may have relatively a relatively shorter flange length and a relatively longer slot length than shown in FIGS. 3B-3E, where the weight selector member is oriented to have a particular corresponding tab engage the inner flange in relatively fewer rotational orientations. Conversely, a weight plate collar used in the upper portion of the weight stack may have relatively a relatively longer flange length and a relatively shorter slot length than shown in FIGS. 3B-3E, where the weight selector member is oriented to have a particular corresponding tab engage the inner flange in relatively more rotational orientations.

Figure 4D:
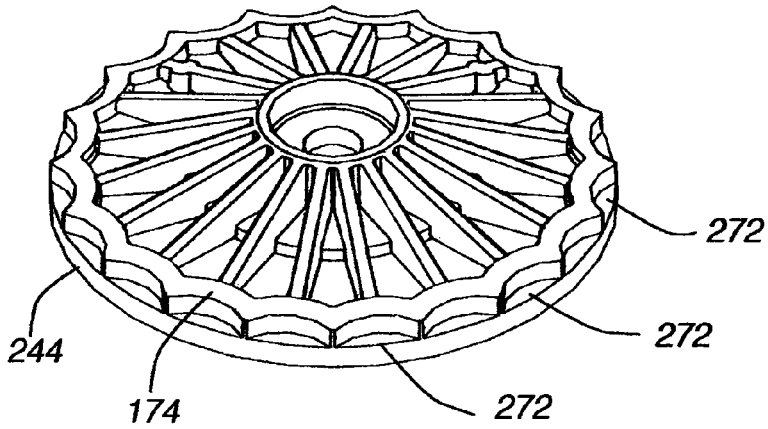
FIG. 4D is a detailed top isometric view of an upper locking disk shown in FIG. 4B.
Figure 4C:
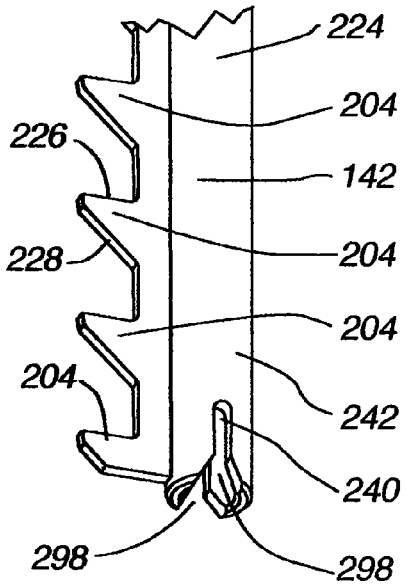
FIG. 4C is a detailed view of a bottom end portion of the weight selector member shown in FIG. 4B.

As previously mentioned, when the weight stack 102 is in an "at rest" state (i.e. no weights are being lifted), the selector knob 132 can be rotated, which in turn, rotates the weight selector member 142 to engage a desired number of weight plates 122 to be lifted. FIGS. 4A-4C show one embodiment of the weight selector member 142 which is rotatably connected with the first weight plate 122A. The weight selector member includes a plurality of longitudinally aligned triangularly-shaped tabs 204 extending outward from a cylindrically-shaped main body 224. It is to be appreciated that the weight selector member 142 may have different shapes or forms, and may be made of various types of material, such as metal. In addition, the tabs 204 may be each of the same or different sizes and orientations. As previously mentioned, the tabs (204A through 204S) are adapted to engage the inner flanges 206 of corresponding weight plate collars (200A through 200S) in the weight plates (122B through 122T). Depending on the configuration of each of the weight plate collars 200 and each of the respective inner flanges 206 on the weight plate collars, the weight selector member tabs 204 can be formed differently. For example, the tabs can be positioned angularly in either direction along the outer surface of the weight selector member. Although the tabs are shown as being equally spaced, the tabs may also be unevenly spaced, depending on the spacing between the weight plates, for example if the weight plates had differing thicknesses. As shown in FIGS. 4A-4C, each tab 204 includes a substantially horizontally-oriented upper surface 226 and a sloped lower surface 228. As discussed in more detail below, the upper surfaces 226 are adapted to engage inner flanges 206 of corresponding weight plate collars on weight plates that are selected to be lifted. As such, in this particular embodiment, the weight selector member includes one tab corresponding with each weight plate having a weight plate collar.

As previously mentioned, the weight selector member 142 is rotatably connected with the top weight plate 122A. As such, the weight selector member 142 is lifted up and down along with the top weight plate 122A and can rotate in the directions B and B' shown in FIG. 1C relative to the top weight plate 122A. As shown in FIG. 4B, cylindrically-shaped bearing surfaces 230 on an upper end portion 232 of the weight selector member 142 and corresponding bearings 234 are adapted to be received within this aperture 198 in the top weight plate 122A. A screw 236 extending down from the upper locking mechanism 138 and into a threaded aperture 238 in a top end of the weight selector member 142 connects the weight selector member 142 with the top weight plate 122A. As previously mentioned, the upper locking mechanism 138 is operably connected with the weight selector member 142 to prevent the weight selector member from rotating and deselecting weight plates when various weight plates are lifted.

Figure 6A:
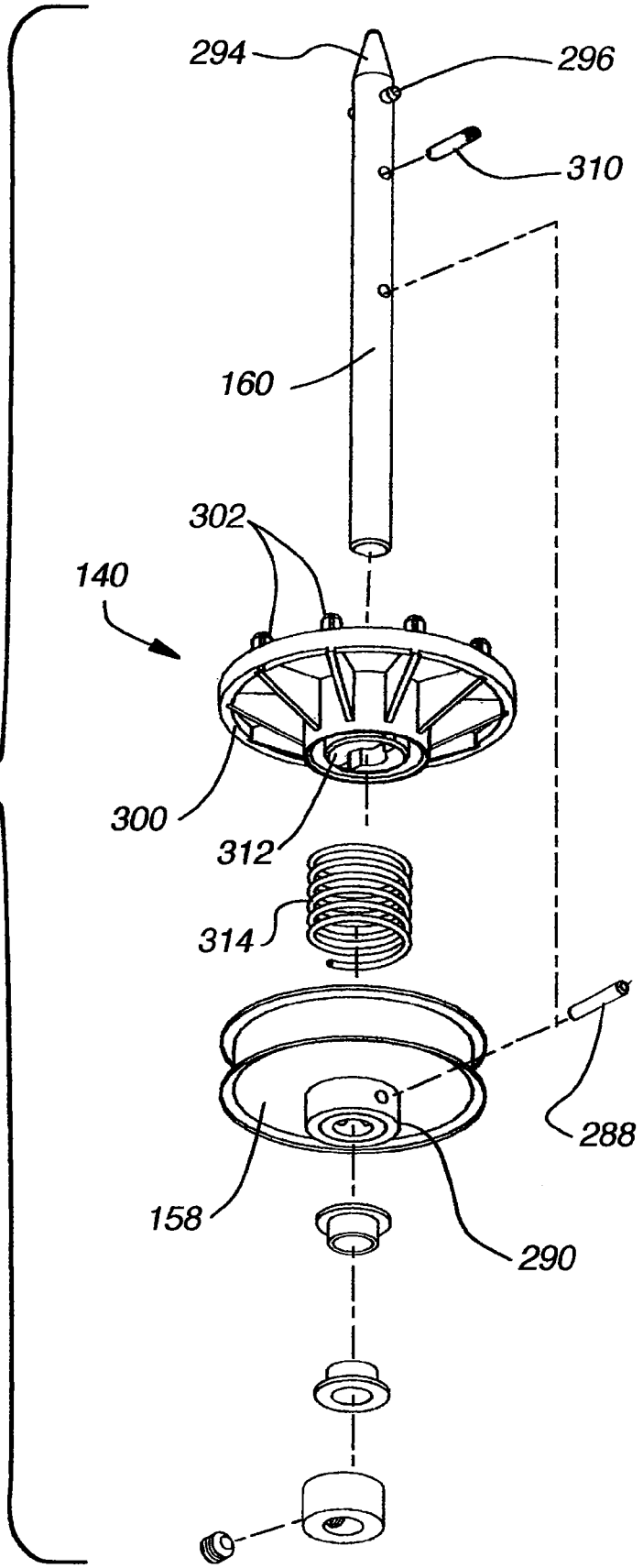
FIG. 6A is an exploded view of the lower locking assembly shown in FIG. 4A.
Figure 6B:
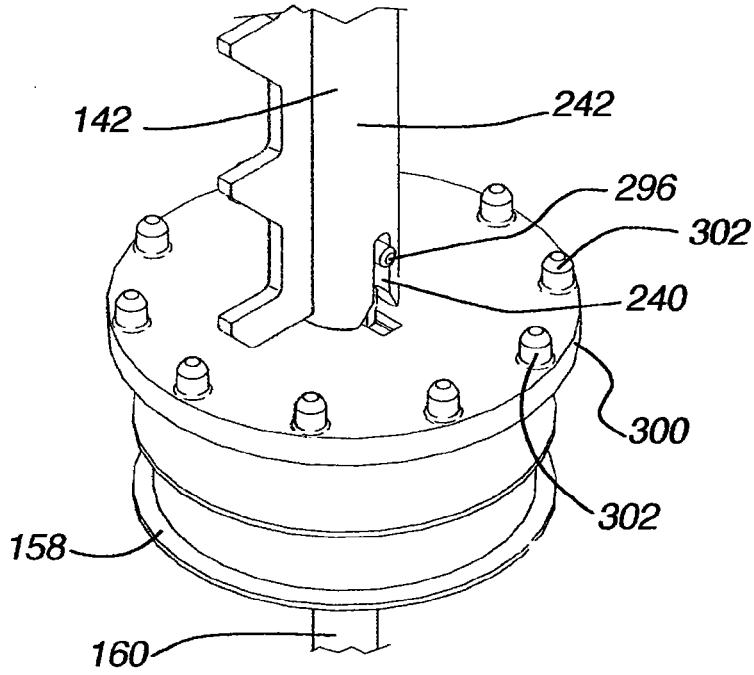
FIG. 6B is a detailed view the weight selector member engaging a lower shaft of the lower locking assembly to place the lower locking assembly in an unlocked position.
Figure 6C:
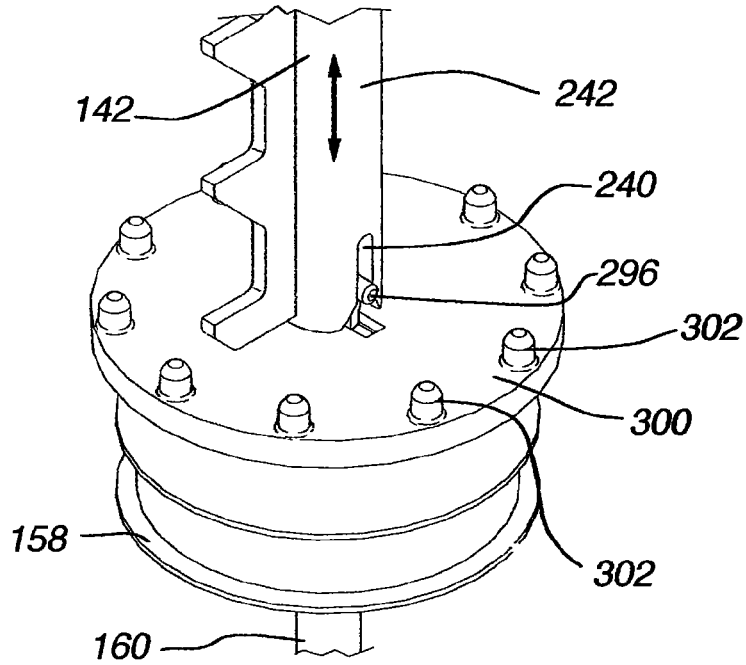
FIG. 6C is a detailed view the weight selector member disengaging from the lower shaft of the lower locking assembly to place the lower locking assembly in a locked position.
Figure 7A:
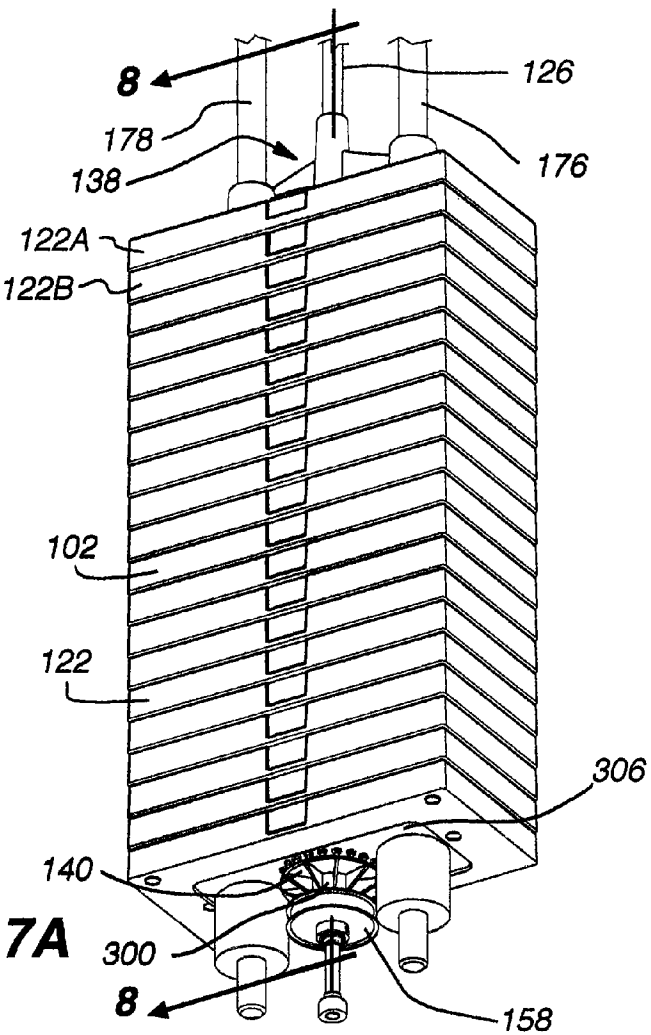
FIG. 7A is a view of the weight stack in an "at rest" state.

As previously mentioned, the lower locking mechanism 140 shown in FIG. 2A is selectively operably connected with the weight selector member 142. More particularly, when the weight stack 102 is in an "at rest" state (i.e. no weights are being lifted as shown in FIG. 7A), the lower shaft 160 of the lower locking assembly 140 is engaged with the weight selector member 142. As shown in FIGS. 4C, 6B, and 6C, elongated keyways 240 are located on opposing sides of a bottom end portion 242 of the weight selector member 142. As discussed in more detail below, the elongated keyways 240 are adapted to connect the weight selector member 142 with the lower shaft 160 when the weight stack 102 is in the "at rest" state. As such, when in the "at rest" state, rotation of the selector knob 132, which in turn, rotates the weight stack pulley 158, will cause the lower shaft 160 and weight selector member 142 to rotate. As discussed in more detail below, weight plates 122 are selected to be lifted by rotating the weight selector member 142 to bring the horizontal upper surfaces 226 of the tabs 204 into alignment below corresponding inner flanges 206 of the collars 200 on the weight plates 122. Once aligned, the tabs 204 will engage the inner flanges 206 on the collars of the selected weight plates as the top plate 122A and weight selector 142 member are lifted upward, which in turn, also lifts the selected weight plates. Alternatively, weight plates are not selected to be lifted by rotating the weight selector member 142 to bring the horizontal upper surfaces 226 of corresponding tabs 204 into alignment with slots 222 on the collars of particular weight plates. Once aligned with the slots 222, the tabs 204 will pass upward through the slots on the collars of the unselected weight plates as the top plate and weight selector member are lifted upward, leaving the unselected weight plates in the original "at rest" positions on the weight stack. As described in more detail below, when the top weight plate 122A, weight selector member 142, and selected weight plates are lifted upward a sufficient distance, the weight selector member 142 disengages from the lower shaft 160 of the lower locking mechanism 140.

As previously mentioned with reference to FIGS. 4A and 4B, the weight selector member 142 and upper locking mechanism 138 are connected with the top weight plate 122A. As such, the weight selector member and upper locking mechanism move up and down with the top weight plate 122A along with any weight plates selectively engaged by the weight selector member 142. As previously mentioned, the upper locking assembly 138 prevents the weight selector member 142 from being rotated when weights are lifted upward. As shown in FIGS. 4B, 4C, and 4D, the upper locking mechanism 138 includes an upper lock disk 244 having a center aperture 246 adapted to accept the screw 236 connected with the top end of the weight selector member 142. A four-sided center recessed area 248 in a bottom side of the upper lock disk 250 is adapted to accept a correspondingly shaped raised portion 252 on the upper end of the weight selector member 142. As such, the upper lock disk 244 and the weight selector member 142 are connected together, and as such, rotate together in directions B and B' shown in FIG. 1C relative to the top weight plate 122A.

Figure 4E:
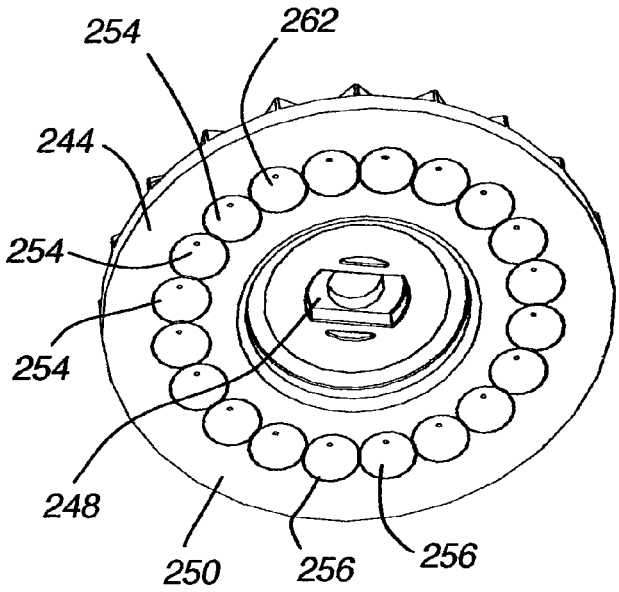
FIG. 4E is a detailed bottom isometric view of the upper locking disk shown in FIG. 4B.
Figure 8A:
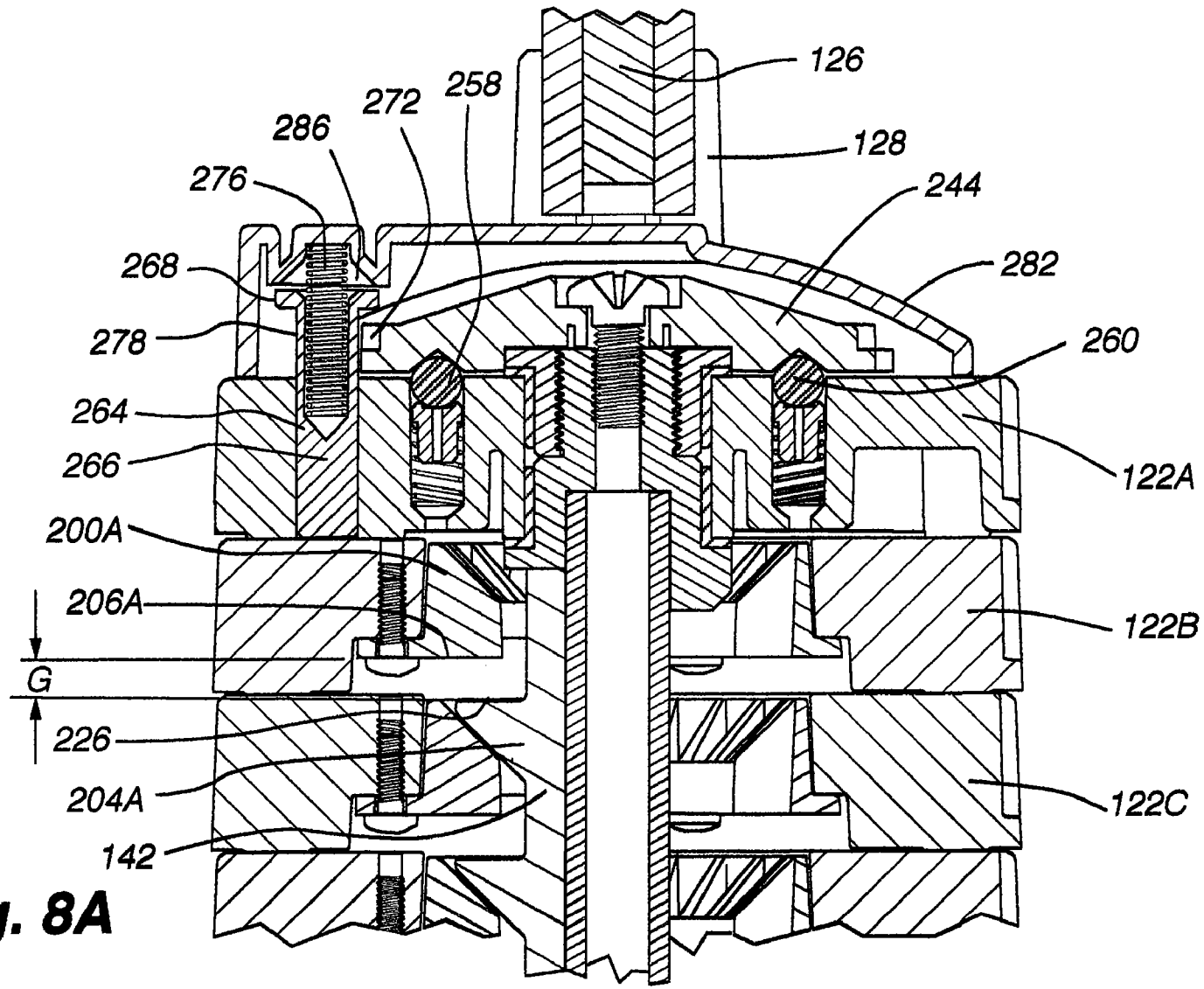
FIG. 8A is a cross-sectional view of an upper portion of the weight stack depicted in FIG. 7A, taken along line 8-8.
Figure 9A:
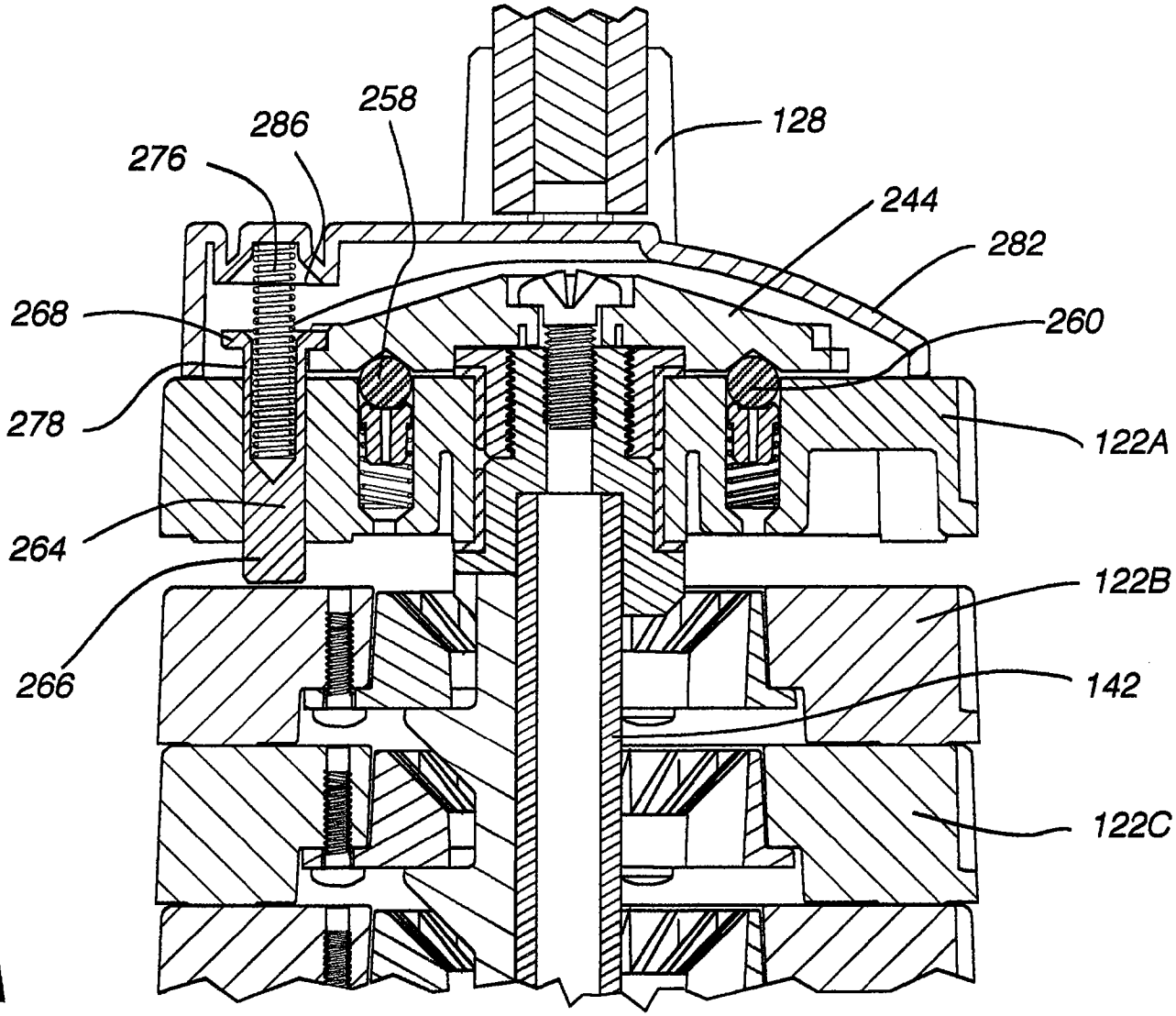
FIG. 9A is a cross-sectional view of an upper portion of the weight stack depicted in FIG. 7B, taken along line 9-9.

As shown in FIG. 4E, a plurality of adjacent curved indentations 254 collectively in the form of a circle are located in the bottom side 250 of the upper lock disk 244, with edges 256 of the indentations 254 connecting and overlapping with one another. As shown in FIGS. 4B, 8A, and 9A, first and second spring-loaded detent balls 258, 260 are positioned in the top weight plate 122A with the detent balls 258, 260 adapted to ride in the curved indentations 254 in the bottom side 250 of the upper lock disk 244. As the user turns the selector knob 132, which in turn rotates the weight selector member 142 and upper lock disk 244, the detent balls 258, 260 contact curved surfaces 262 of the curved indentations 254 to provide a "positive" feel for the user turning the selector knob 132. As such, the detent balls 258, 260 effectively provide an indication to the user when the weight selector member is in a proper fully engaged position at each weight selection position on the selector knob 132. The detent balls 258, 260 are spring-loaded so that if the user attempts to locate the selector knob in between weight selection locations, the detent balls will push on this curved surface 262 of the curved indentations 254 in which detent balls reside and center the position of the balls within the nearest curved indentation to properly orient the weight selection knob with the nearest weight selection.

As shown in FIGS. 4B, 8A, and 9A, the upper locking mechanism 138 also includes a lock member in the form of a spring-loaded locking pin 264 adapted to engage the upper lock disk 244 to hold the upper lock disk and weight selector member 142 in a particular rotational position relative to the top weight plate 122A when the top weight plate is being lifted upward. The locking pin 264 includes a cylindrical lower portion 266 connected with an upper annular portion 268. The cylindrical lower portion 266 is adapted to slide up and down inside a lock pin aperture 270 in the top weight plate 122A. The annular portion 268 is adapted to engage a plurality of curved recesses 272 circumferentially spaced along a top side 274 of the upper lock disk 244, shown in detail in FIGS. 4D, 5A, and 5B. The annular portion 268 of the locking pin 264 is dimensioned such that when engaged with one of the curved recesses 272 in the upper lock disk 244 (i.e. the locked position shown in FIGS. 5B, 7B, and 9A), the upper lock disk is prevented from rotating relative to the top weight plate 122A, as shown in FIG. 9A. Alternatively, when the annular portion 268 of the locking pin 264 is positioned above and out of engagement with the curved recesses 272 (i.e. the unlocked position shown in FIGS. 5A, 7A, and 8A), the upper lock disk 244 and weight selector member 142 can rotate freely relative to the top weight plate 122A, as shown in FIG. 8A.

Figure 5B:
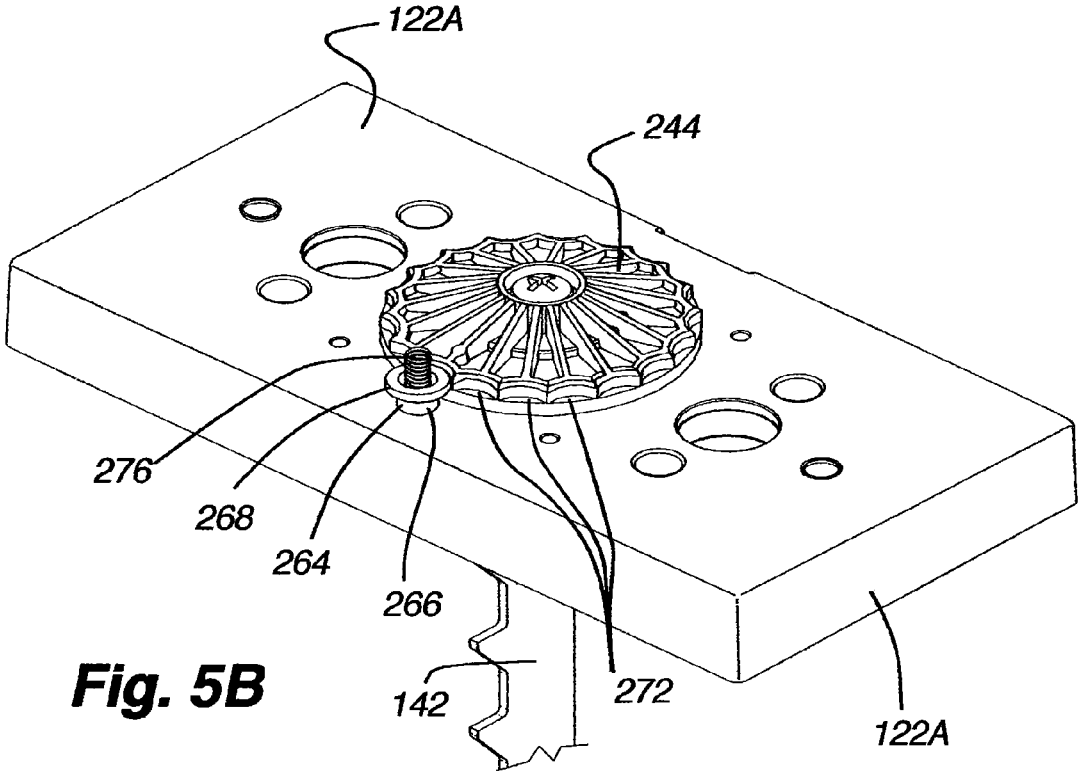
FIG. 5B is a detailed view of the top weight plate with the cover of the upper locking assembly removed and the locking pin in a locked position.
Figure 5A:
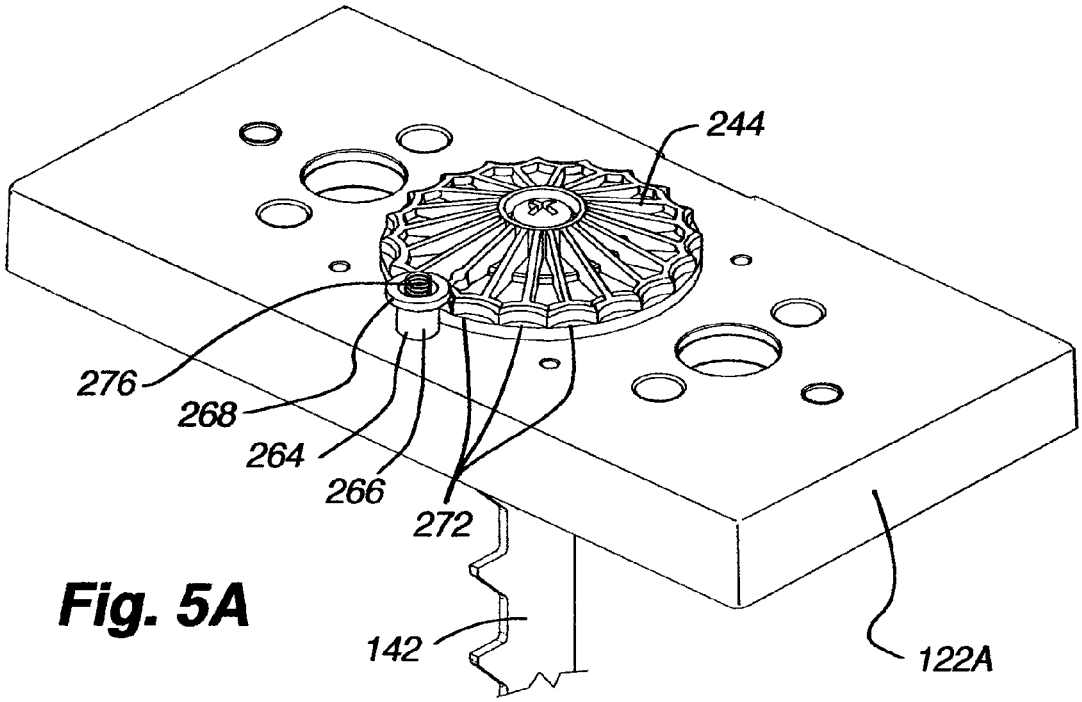
FIG. 5A is a detailed view of a top weight plate with a cover of the upper locking assembly removed and a locking pin in an unlocked position.

As shown in FIGS. 5B and 9A, an upper lock spring 276 biases the locking pin 264 in a downward position (i.e. the locked position). A lower end portion of the upper lock spring 276 is received within a cylindrical recess 278 extending downward from the annular portion 268 of the locking pin 264. An upper end portion of the upper lock spring 276 engages a bottom surface 280 of a cover 282. As shown in FIG. 4B, four screws 284 connect the cover 282 with the top surface of the top weight plate 122A. As shown in FIGS. 4B, 8A, and 9A, the cover includes a cylindrical recess 286 adapted to receive the upper lock spring 276 and to allow for axial movement (up and down) of the annular portion 268 of the locking pin 264 therein. The upper lock spring 276 acts to bias the locking pin 264 downwardly relative to the top weight plate 122A by pushing against the locking pin 264 and the bottom surface of the cover 282. As shown in FIGS. 8A and 9A, the locking pin 264 defines a length that is greater than the thickness of the top weight plate 122A. As such, the locking pin 264 extends downward from the bottom of the lock pin aperture 270 so that when engaged with the second weight plate 122B, as shown in FIG. 9A, the locking pin 264 is pushed upward and is held in the unlocked position with the annular portion 268 located above the curved recesses 272 in the locking disk 244, as shown in FIG. 8A. The position of the annular portion of the locking pin shown in FIGS. 5A and 8A allows the upper lock disk 244 and weight selector member 142 to rotate when the user is selecting the desired weight plates to be lifted with the weight selector knob 132.

Figure 7B:
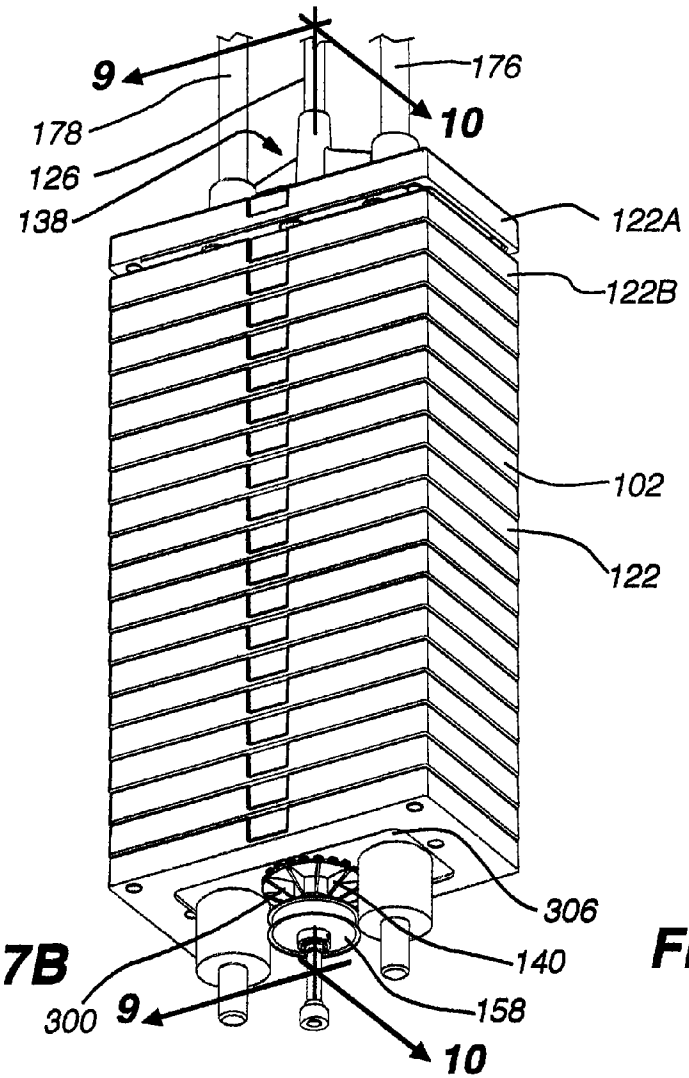
FIG. 7B is a view of the weight stack showing a first weight plate initially lifted upward.
Figure 10A:
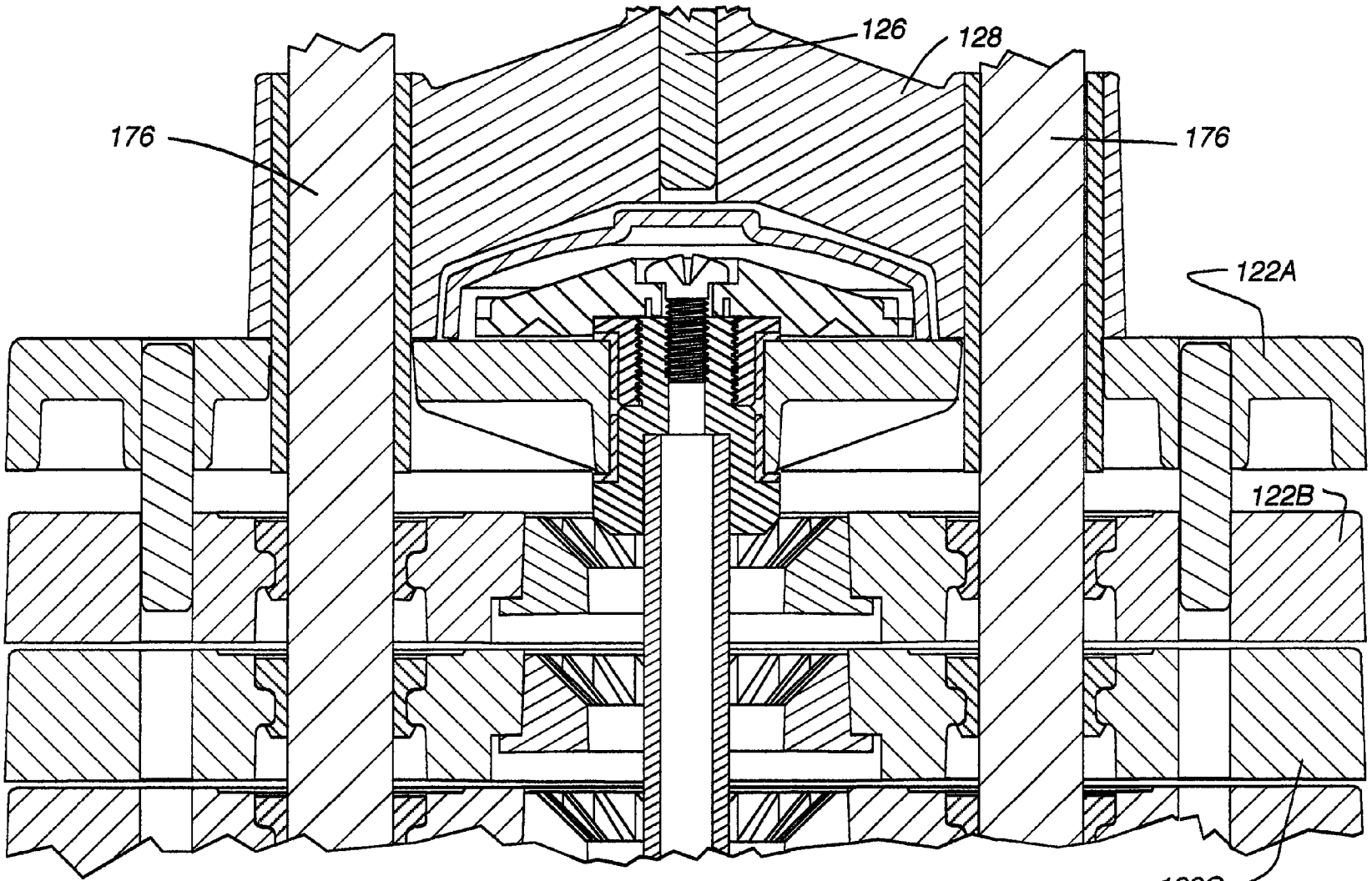
FIG. 10A is a cross-sectional view of an upper portion of the weight stack depicted in FIG. 7B, taken along line 10-10.

As shown in FIGS. 7B, 9A, and 10A, when the top weight plate 122A and weight selector member 142 are lifted, such as during exercise, the top weight plate 122A moves away from the second weight plate 122B. At the same time, the upper lock spring 276 biases the locking pin 264 downwardly to cause the annular portion 268 of the locking pin to fit into one of the curved recesses 272 in the upper lock disk 244 (i.e. the locked position) for the selected total weight. At this point, the upper lock disk 244 and the weight selector member 142 can no longer be turned because the locking pin 264 interferes with rotation of the upper lock disk 244. As such, the orientation of the weight selector member 142 cannot be changed, preventing the user from accidentally or intentionally causing weight plates to be deselected by rotation of the selector knob and/or the weight selector member. When the weight stack 102 is returned to an "at rest" state as shown in FIGS. 7A and 8A, the bottom end of the locking pin 264 engages the top side of the second weight plate 122B, pushing the annular portion 268 of the locking pin 264 upward and above the curved recesses 272 on the upper lock disk 244, thereby allowing the user to rotate the weight selector member to select a different weight.

Figure 8B:
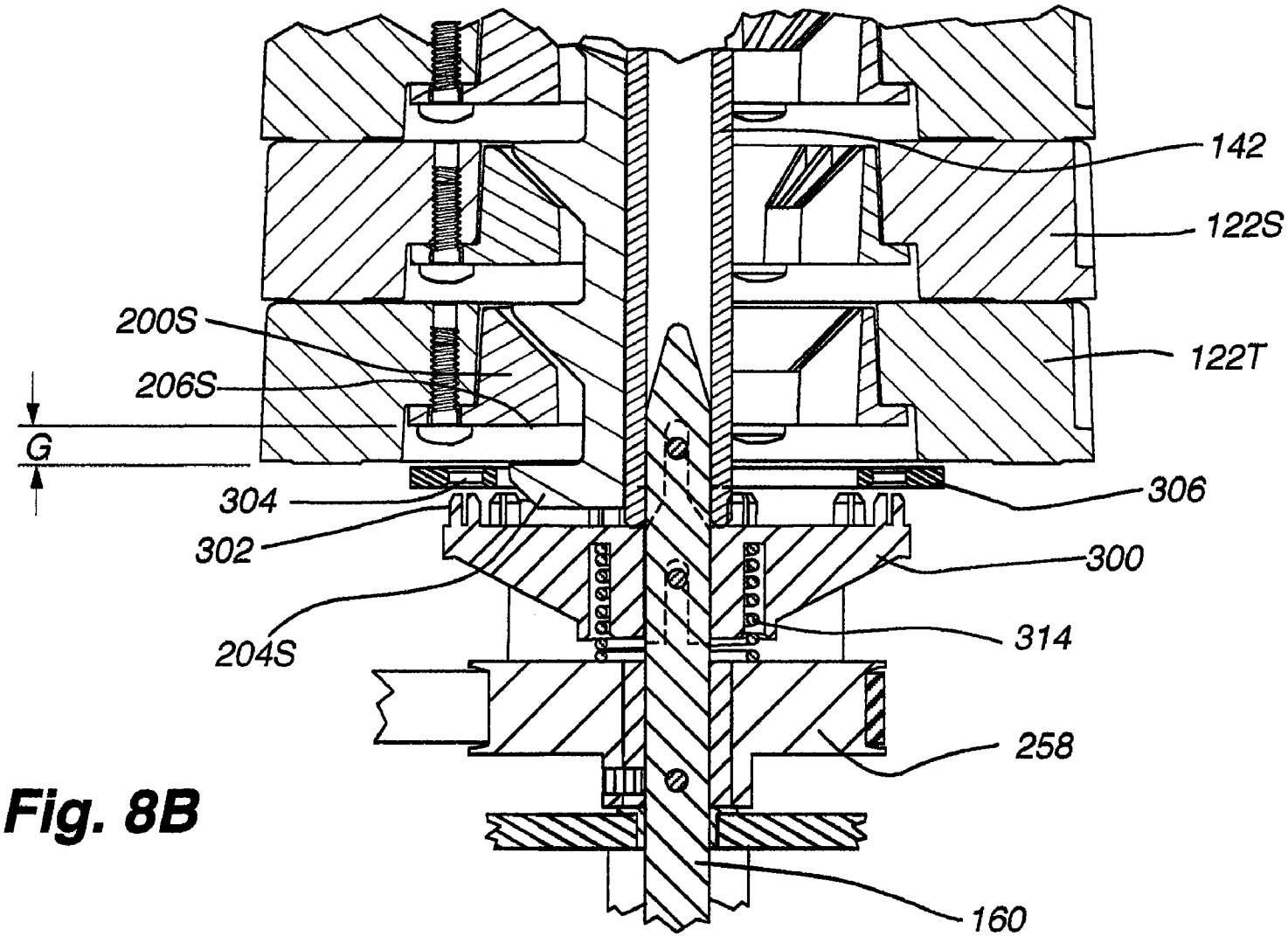
FIG. 8B is a cross-sectional view of a lower portion of the weight stack depicted in FIG. 7A, taken along line 8-8.

As previously discussed with reference to FIGS. 7B, 9A, and 10A, the first (top) plate 122A separates from the second weight plate 122B upon actuation of the resistance or lift cable 126 by the user. The second weight plate 122B (if selected) and other weight plates (if selected) are lifted by engagement of the tabs 204 with the weight plate collars 200 as explained above. As shown in FIGS. 8A and 8B, a gap G exists between the tabs 204 and the inner flanges 206 on each weight plate collar 200 prior to lifting the top weight plate 122A and weight selector member 142. As sufficient forces are applied to the top weight plate 122A, the top weight plate and weight selector member are moved upwardly. The second weight plate 122B (if selected) and lower weight plates (if selected) stay in position until respective tabs 204 engage respective inner flanges 206 in corresponding weight plate collars 200. The tabs 204 move upwardly under the applied forces by the dimension of the gap G and engage the inner flanges 206, which lifts the selected weight plates. The gap G distance is sized to allow the locking pin 264 to be biased sufficiently downwardly as the first or top weight plate 122A moves upward from the second plate 122B by the gap distance to cause the annular portion 268 of the locking pin 264 to be received in one of the curved recesses 272 and lock the upper lock disk 244 and weight selector member 142 to prevent rotational movement. While the gaps G between the tabs 204 and inner flanges 206 in the weight stack 102 may be all be the same dimension, the gaps can be differently sized. For example, if the gaps are not the same dimension such as where the gap in a lower weight plate is smaller than the gaps in the upper weight plates, then the upper weight plates may be supported by the lower weight plate and not by respective tabs positioned in the upper weight plates when lifted.

As previously mentioned, when the weight stack 102 is in the "at rest" state (i.e. no weight plates are lifted shown in FIG. 7A), the weight selector member 142 is connected with the lower shaft 160 of the lower locking mechanism 140 such that when the selector knob 132 is rotated, the weight selector member rotates along with the weight stack pulley 158. As shown in FIG. 6A, the weight stack pulley 158 is keyed to the lower shaft 160 through a lower pin 288. The weight stack pulley 158 includes a collar 290 defining apertures 292 adapted to receive opposing end portions of the lower pin 288 extending from the lower shaft 160. The lower shaft 160 is rotatably supported by the frame 110 of the exercise device 100. As such, the weight stack pulley 158 and the lower shaft 160 rotate together in directions B and B' shown in FIG. 1C, but do not move up and down along with the weight selector member 142. As shown in FIG. 6A and others, the lower shaft defines 160 a cone-shaped upper end portion 294 that is adapted to be received in the hollow bottom end portion 242 of the weight selector member 142 shown in FIGS. 8B and 9B. The conical shape of the upper end portion 294 of the lower shaft 160 allows the weight selector member 142 to more easily engage the lower shaft in the event of misalignment.

As shown in FIGS. 6B and 6C, the elongated keyways 240 on the bottom end portion 242 of the weight selector member 142 are adapted to connect the weight selector member 142 with the lower locking assembly 140 when the weight stack is in the "at rest" state. More particularly, as shown in FIGS. 6A-6C, a coupling pin or member 296 extending though the upper end portion 294 of the lower shaft 160 is adapted to be received within the elongated keyways 240 of the weight selector member 142 to connect the lower shaft with the weight selector member. FIGS. 6B and 8B show the coupling member 296 engaged with the elongated keyways 240 of the weight selector member. As shown in FIG. 4C, bottom end portions 298 of the elongated keyways 240 taper outward to define a larger width, which allows the coupling pin on the lower shaft to more easily engage the elongated keyways in the event of misalignment.

Figure 9B:
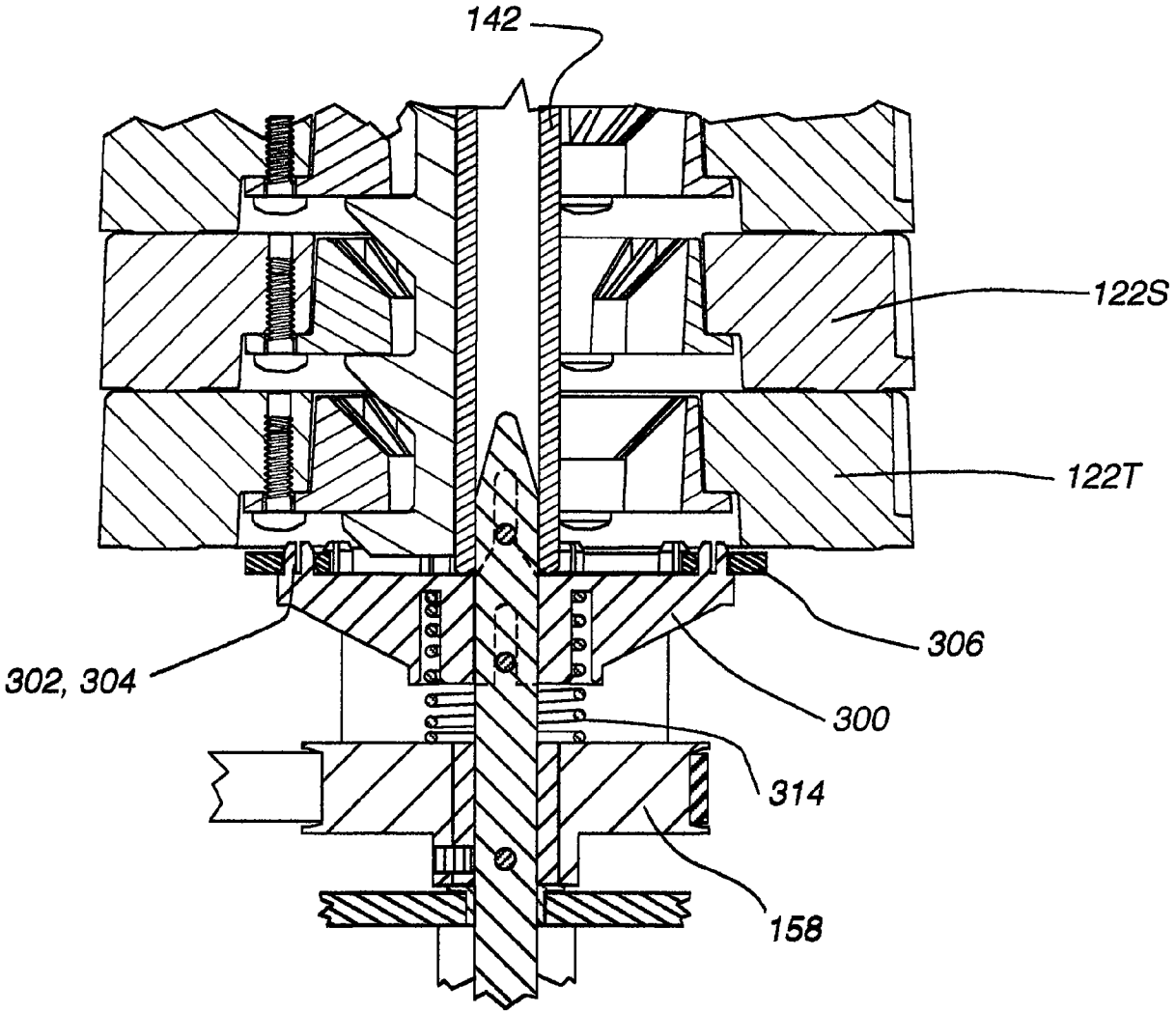
FIG. 9B is a cross-sectional view of a lower portion of the weight stack depicted in FIG. 7B, taken along line 9-9.
Figure 10B:
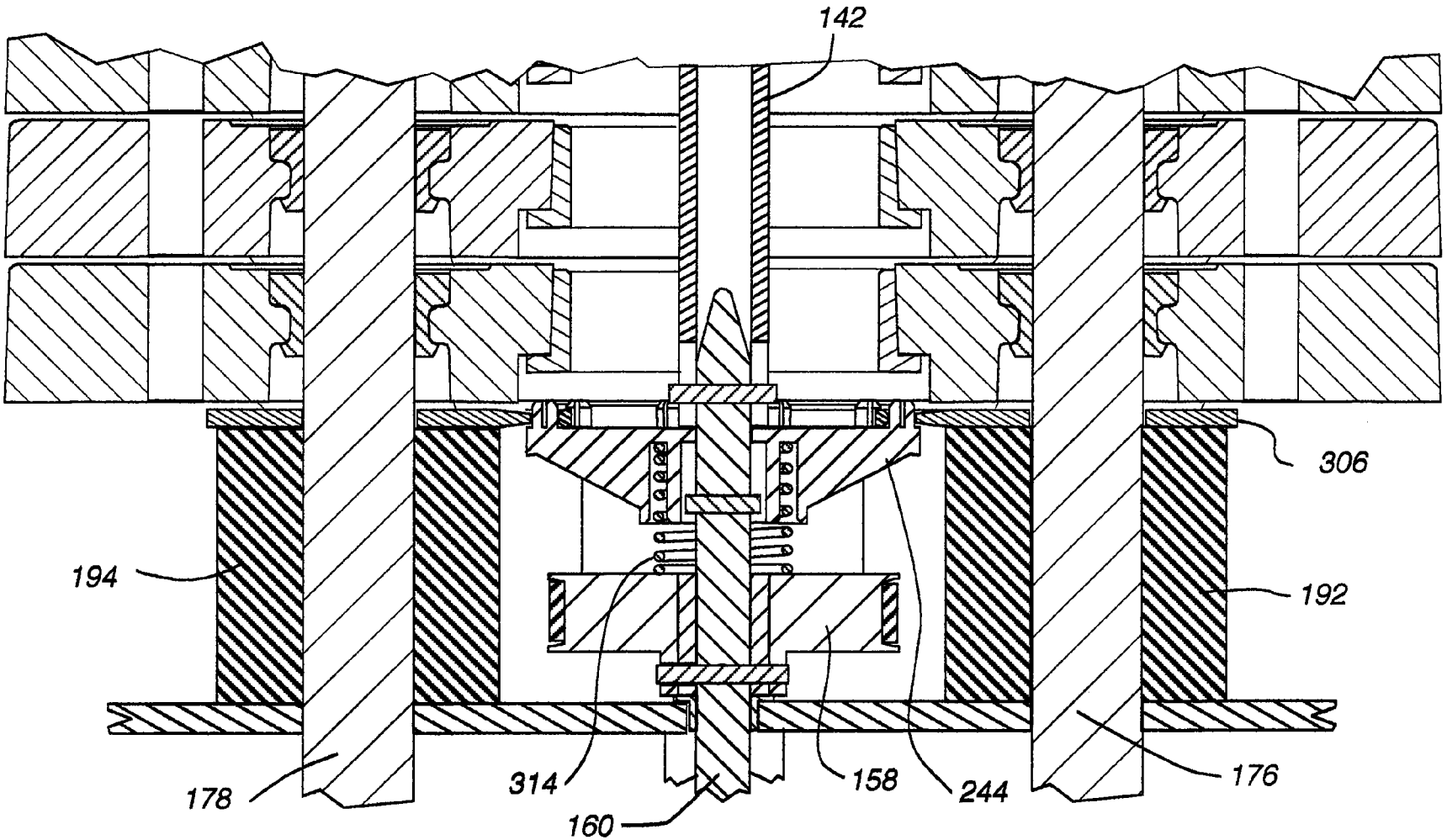
FIG. 10B is a cross-sectional view of a lower portion of the weight stack depicted in FIG. 7B, taken along line 10-10.

As previously mentioned, when the top weight plate 122A, weight selector member 142, and any selected weight plates 122 are lifted upward, the lower locking assembly 140 prevents the weight stack pulley 158 from rotating, and in turn, prevents rotation of the selector knob 132. As described in more detail below with reference to FIGS. 2A, 6A, 8B, 9B, and 10B, the lower locking assembly 140 includes a lower lock disk 300 with a plurality of studs 302 that can be selectively moved in and out of engagement with corresponding apertures 304 in a bottom lock plate 306. The bottom lock plate 306 is held in a fixed position by the two guide rods 176, 178 extending through guide rod apertures 308 in the bottom lock plate as shown in FIGS. 2A, 8B, 9B, and 10B. When the studs 302 on the lower lock disk 300 are inserted into the apertures 304 in the bottom lock plate 306, the weight stack pulley 158 and lower shaft 160 are prevented from rotating, as shown in FIGS. 6B, 9B, and 10B. Alternatively, when the studs 302 on the lower lock disk 300 are withdrawn from the apertures 304 in the bottom lock plate 306, the weight stack pulley 158 and lower shaft 160 are not prevented from rotating, as shown in FIGS. 6B and 8B.

As shown in FIGS. 2A, 8B, and others, the plurality of studs 302 extend upward from the upper surface of the lower lock disk 300. As previously mentioned, the studs 302 are adapted to be selectively received within corresponding apertures 304 in the bottom lock plate 306. As shown in FIG. 6A, the lower lock disk 300 is connected with the lower shaft 160 through an upper pin 310. The lower lock disk includes an elongated keyway 312 adapted to receive opposing end portions of the upper pin 310. As such, the lower lock disk 300 rotates with the lower shaft 160. However, the engagement between the upper pin 310 and the elongated keyways 312 allows the lower lock disk 300 to move up and down along the lower shaft 160, which allows the studs 302 to be inserted into and withdrawn from this corresponding aperture 304 in the bottom lock plate 306.

When the weight stack 102 is in an "at rest" state (i.e. no weights are being lifted, as shown in FIGS. 7A and 8B), the weight selector member 142 is engaged with the lower shaft 160 and the lower lock disk 300 is disengaged from the bottom lock plate 306. As such, the lower locking assembly 140 does not prevent rotation of the weight stack pulley 158 and the lower shaft 160. As shown in FIGS. 7A and 8B, when the weight stack 102 is in the "at rest" state, the weight selector member 142 presses downward on the upper surface of the lower lock disk 300, which in turn, moves the lower lock disk downward, disengaging the studs 302 from the apertures 304 on the bottom lock plate 306. In the position shown in FIG. 8B, the weight stack pulley 158, the lower shaft 160, and the weight selector member 142 are connected to rotate together. As shown in FIGS. 6A and 8B, the lower locking assembly 140 includes a lower lock spring 314 located between the lower lock disk 300 and the upper surface of weight stack pulley 158. The lower lock spring 314 is biased to press against the weight stack pulley and lower lock disk to move the lower lock disk 300 upward and into engagement with the bottom lock plate 306 when the weight selector member 142 is moved upward, such as when the top weight plate 122A is lifted upward, as shown in FIGS. 7B, 9B, and 10B.

As the top weight plate 122A and weight selector member 142 are lifted upward, the bottom end portion of the weight selector member 142 moves upward and away from the upper surface of the lower lock disk 300, as shown in FIGS. 7B, 9B, and 10B. At the same time, the lower lock spring 314 biases the lower lock disk 300 upward to cause the studs 302 on the lower lock disk to engage the apertures 304 on the bottom lock plate 306 (i.e. the locked position). At this point, the lower lock disk 300, weight stack pulley 158, and lower shaft 160 cannot be rotated because the studs interfere with rotation of the lower lock disk. As such, the orientation of the selector knob 132, weight stack pulley 158, and lower shaft 160 cannot be changed, which helps prevent the user from accidentally or intentionally causing weights to be deselected by rotation of the selector knob and/or the weight selector member. When the weight stack is lowered to an "at rest" position, the bottom end portion of the weight selector member re-engages the top of the lower lock disk, pushing lower lock disk downward. As such, the studs are withdrawn from the apertures on the bottom lock plate, thereby allowing the user to rotate the selector knob, weight stack pulley, lower shaft, and the weight selector member to select a different weight.

As described above with reference to various figures, when the weight stack 102 is in the "at rest" state (i.e. no weight is being lifted), a user positioned on the seat 106 of the exercise device 100 can rotate the selector knob 132 to select a desired number of weight plates 122 to be lifted. Because the selector knob 132 is operably connected with the weight stack pulley 158 through the belt-pulley assembly 134, rotating the selector knob causes the weight stack pulley to rotate. Rotation of the weight stack pulley 158 causes the lower shaft 160 to rotate. Because the lower shaft 160 is connected with the weight selector member 142 through engagement of the coupling pin 296 and elongated keyways 240, the weight selector member 142 also rotates. Rotation of the weight selector member 142 places a desired number of tabs 204 in alignment below the inner flanges 206 on weight stack collars 200 on a desired number of weight plates 122. Once the desired number of weight plates 122 is selected, forces applied to the resistance cable 126 lifts the first weight plate 122A and weight selector member 142 along with the selected number of weight plates. As weight plates 122 are lifted from the "at rest" state, upper and lower locking assemblies 138, 140 prevent rotation of the weight stack pulley 158 and weight selector member 142, which prevents rotation of the selector knob 132.

Figure 11A:
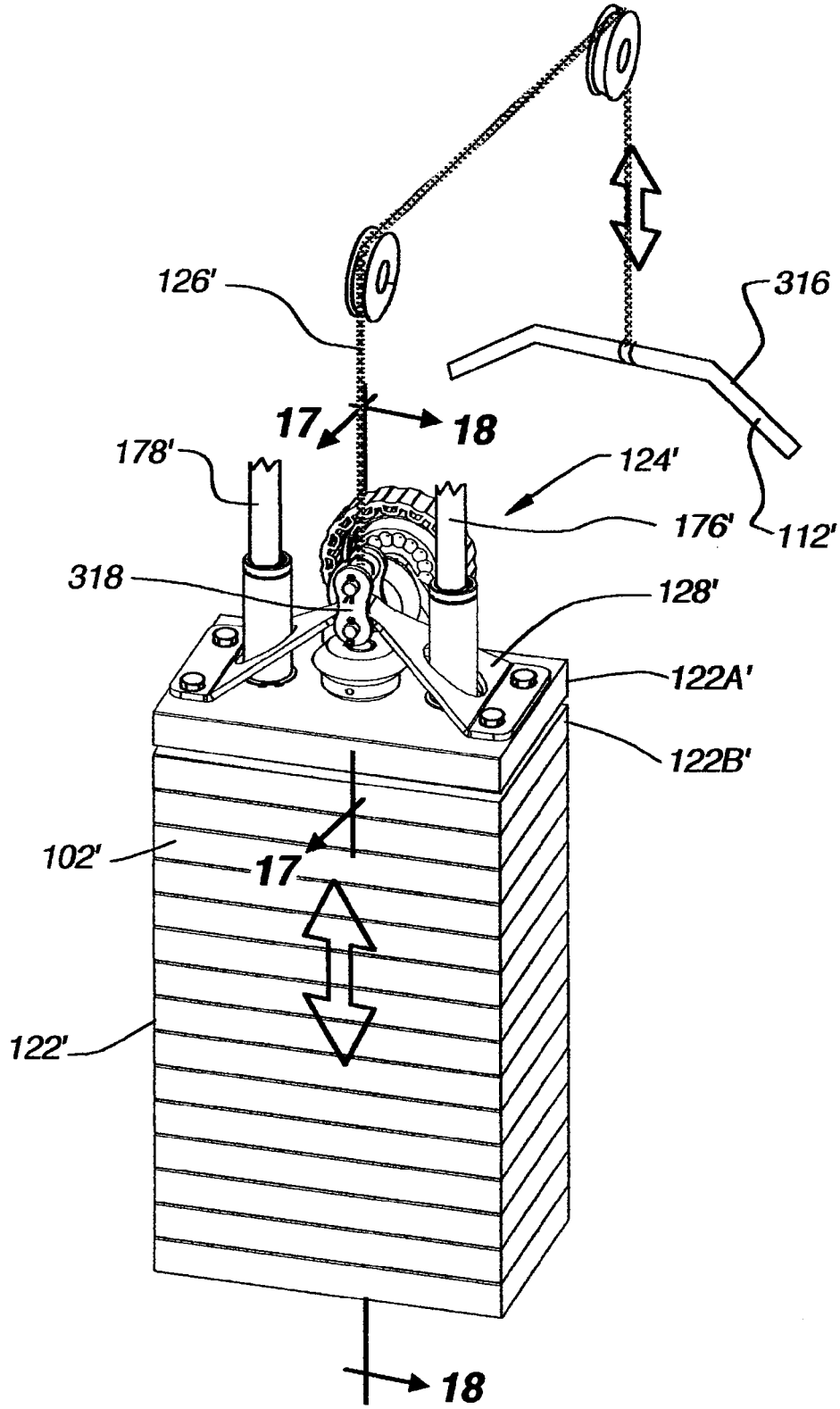
FIG. 11A is a rear isometric view of a second embodiment of a weight stack showing a first weight plate initially lifted upward.
Figure 11B:
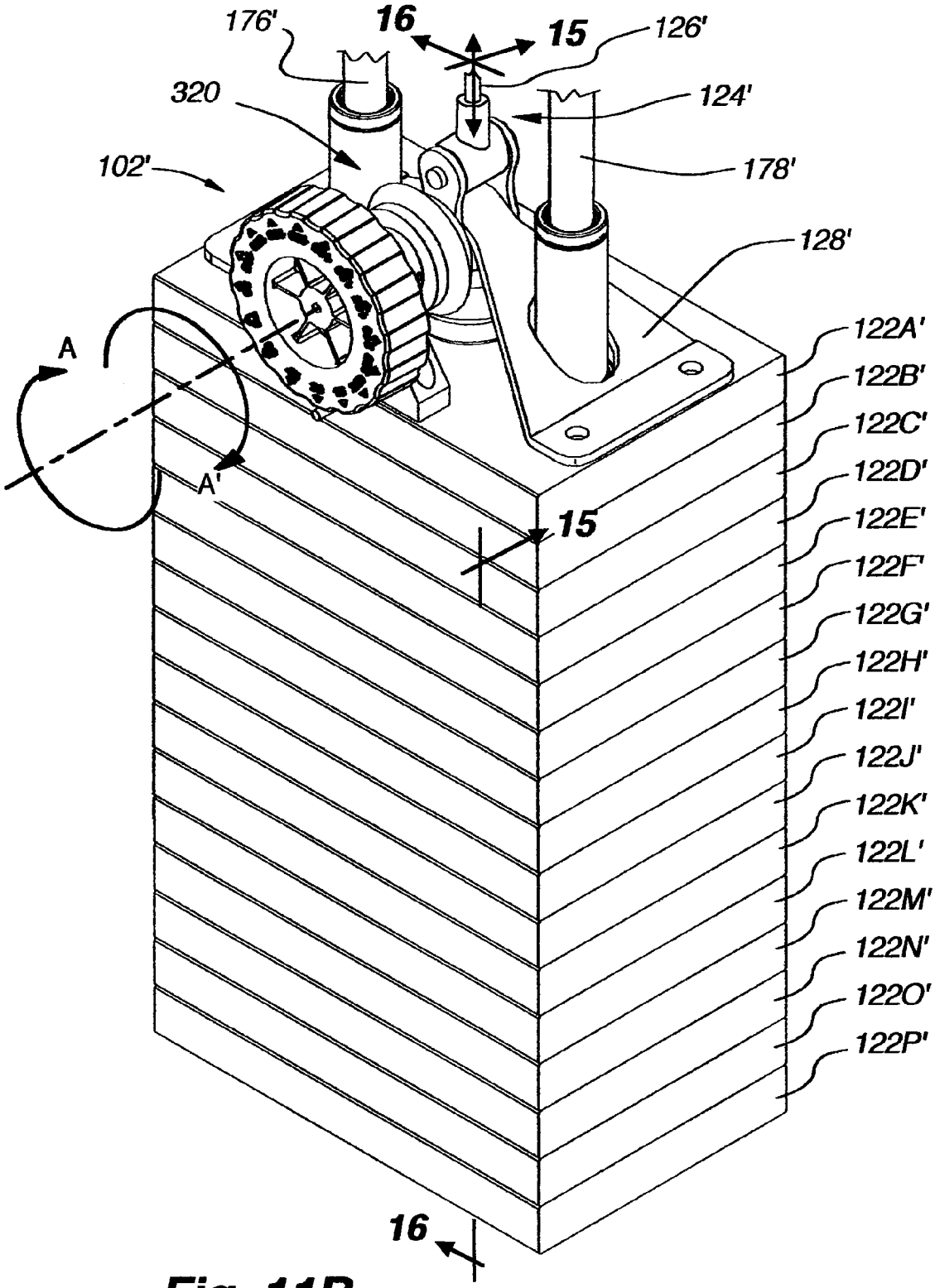
FIG. 11B is a front isometric view of the weight stack shown in FIG. 11A in an "at rest" state.

FIGS. 11A and 11B show a second weight stack 102' conforming to aspects of the present invention. Similar to the first weight stack 102 described above, the second weight stack 102' includes a plurality of weight plates stacked one on top of another. The second weight stack 102' also includes a weight selector mechanism that allows a user to conveniently select a desired amount of weight to lift. As discussed in more detail below, the structure of the second weight stack varies from the first in several ways. For example, the selector mechanism of the second weight stack includes a selector knob that is located proximate the weight stack, as opposed to being remotely located. However, it is to be appreciated that the second weight stack can include a remotely located selector knob. The second weight stack 102' also includes a locking mechanism that is configured differently than the locking mechanisms described above with reference to the first weight stack.

For illustrative purposes, the weight stack 102' is shown in FIG. 11A as being connected with a lift or resistance cable 126' and actuation device 112' in the form of a bar 316, schematically representing an exercise device. However, it is to be appreciated that the second weight stack 102', like the first weight stack 102 described above, can be used with various types of exercise devices to provide a user with a source of resistance. As shown in FIGS. 11A, 11B, and others, the weight stack 102' includes a plurality of weight plates 122' stacked one on top of another. Although the weight stack 102' includes 16 weight plates (122A' through 122P'), it is to be appreciated that other embodiments can include more or less than 16 weight plates. As discussed in more detail below, a user can set a desired resistance by operating an engagement assembly or weight selector assembly or mechanism 124' to select a desired number of weight plates 122' to lift during exercise. As shown in FIG. 11A, the resistance cable 126' is connected with a lift member or bracket 128' through a link 318. The lift member 128', in turn, is connected with a top or first weight plate 122A'. As such, forces exerted on the resistance cable by the user can act to lift and lower the first weight plate 122A' along with a selected number of additional weight plates on the weight stack. It is to be appreciated that a cable, chain, belt, or other structure may also be used and connected directly with the lift bracket 128'. As discussed in more detail below, a user can set a desired resistance by operating the weight selector mechanism or assembly 124' to select a desired number of weight plates 122' to lift during exercise.

Figure 12A:
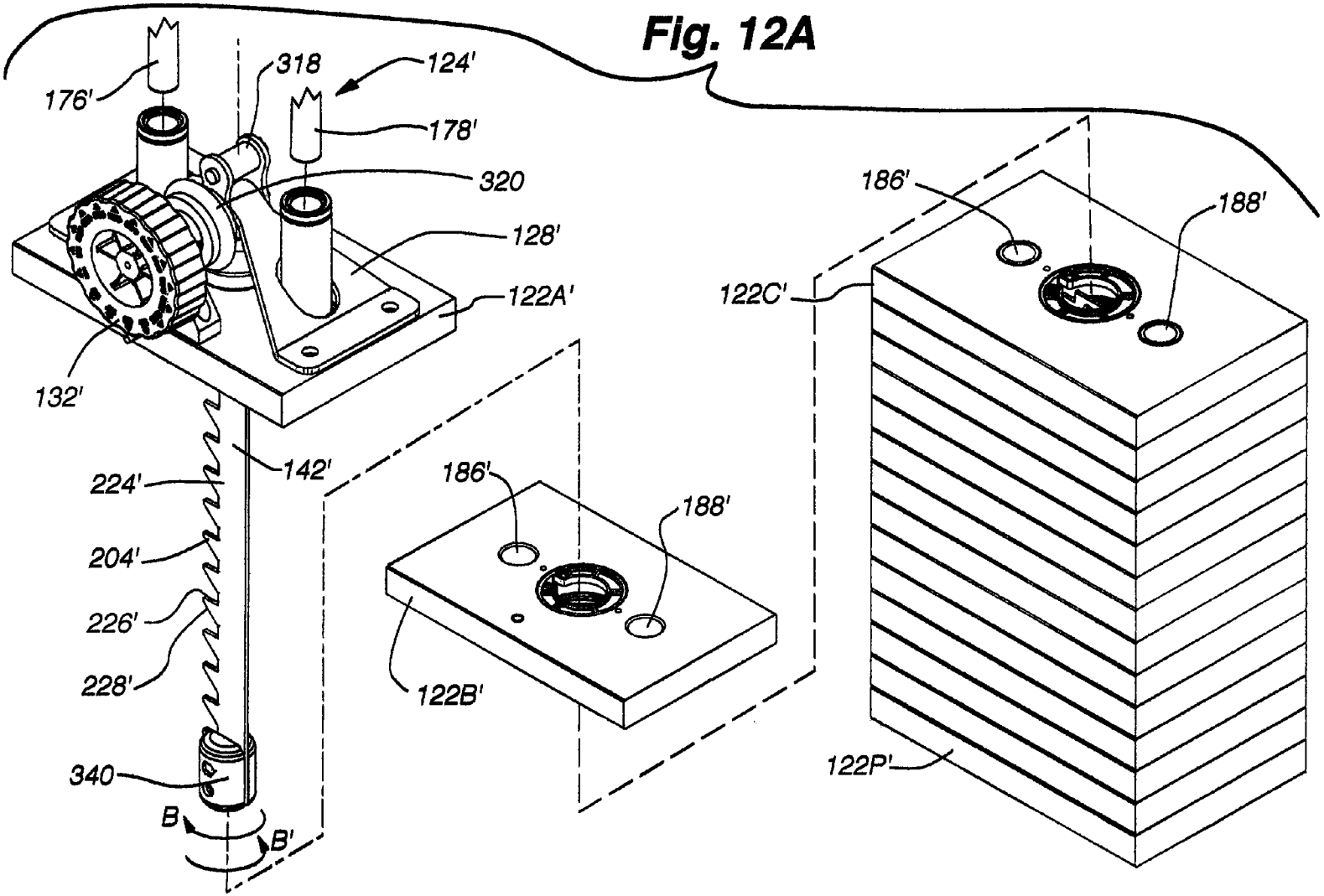
FIG. 12A is an exploded view of the weight stack shown in FIG. 11B.
Figure 12B:
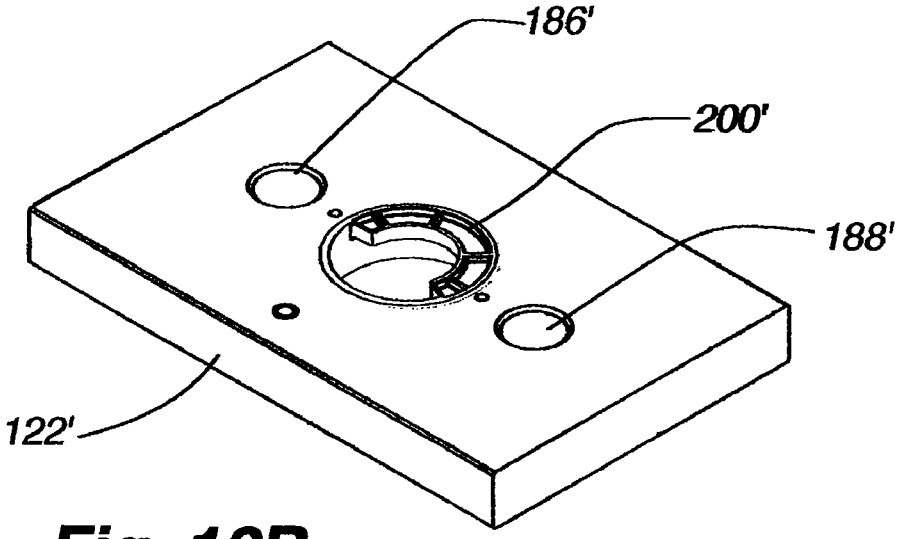
FIG. 12B is a top isometric view a weight plate.
Figure 12C:
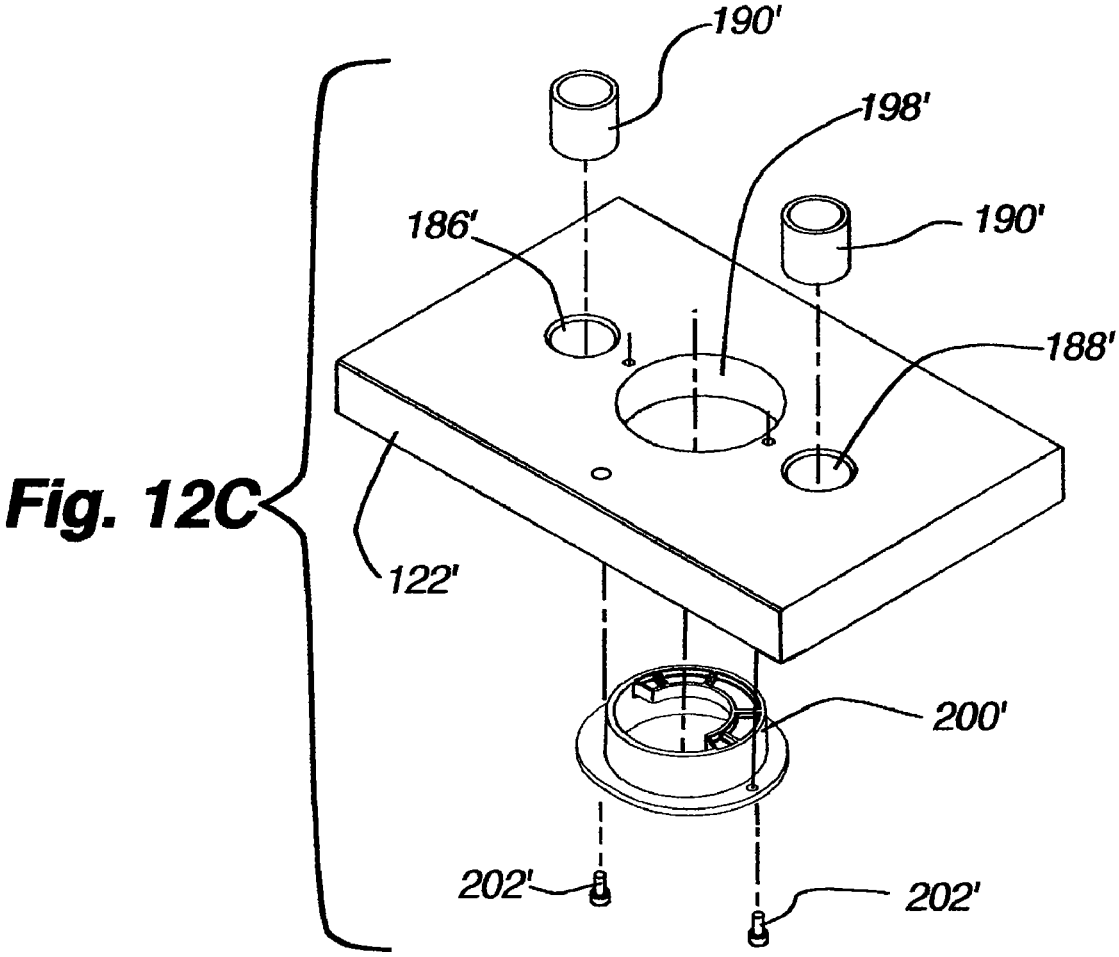
FIG. 12C is an exploded view of the weight plate shown in FIG. 12B.

As shown in FIGS. 11A, 11B, and 12A, the weight selector assembly 124' is positioned on the top of the weight stack 102'. More particularly, the weight selector assembly 124' is connected with the first or top weight plate 122A'. As discussed in more detail below, the weight selector assembly 124' includes a selector knob 132' that allows a user to choose a desired resistance level by selecting a desired number of weight plates 122' to lift. Although a selector knob is described, it is to be appreciated that various forms of gripping members can be used to adjust select the desired weight, such as a handle and the like. As shown in FIG. 12A, the selector knob 132' is located adjacent the first weight plate 122A' and is operably connected with the weight stack 102' through a gear train or assembly 320. The weight selector knob 132' is oriented in this particular embodiment to rotate around a substantially horizontally-oriented axis or rotation, and faces a front or rear face of the weight stack for easy access by the user. It is to be appreciated that the selector knob can also be located in various locations other than what is shown.

Figure 14A:
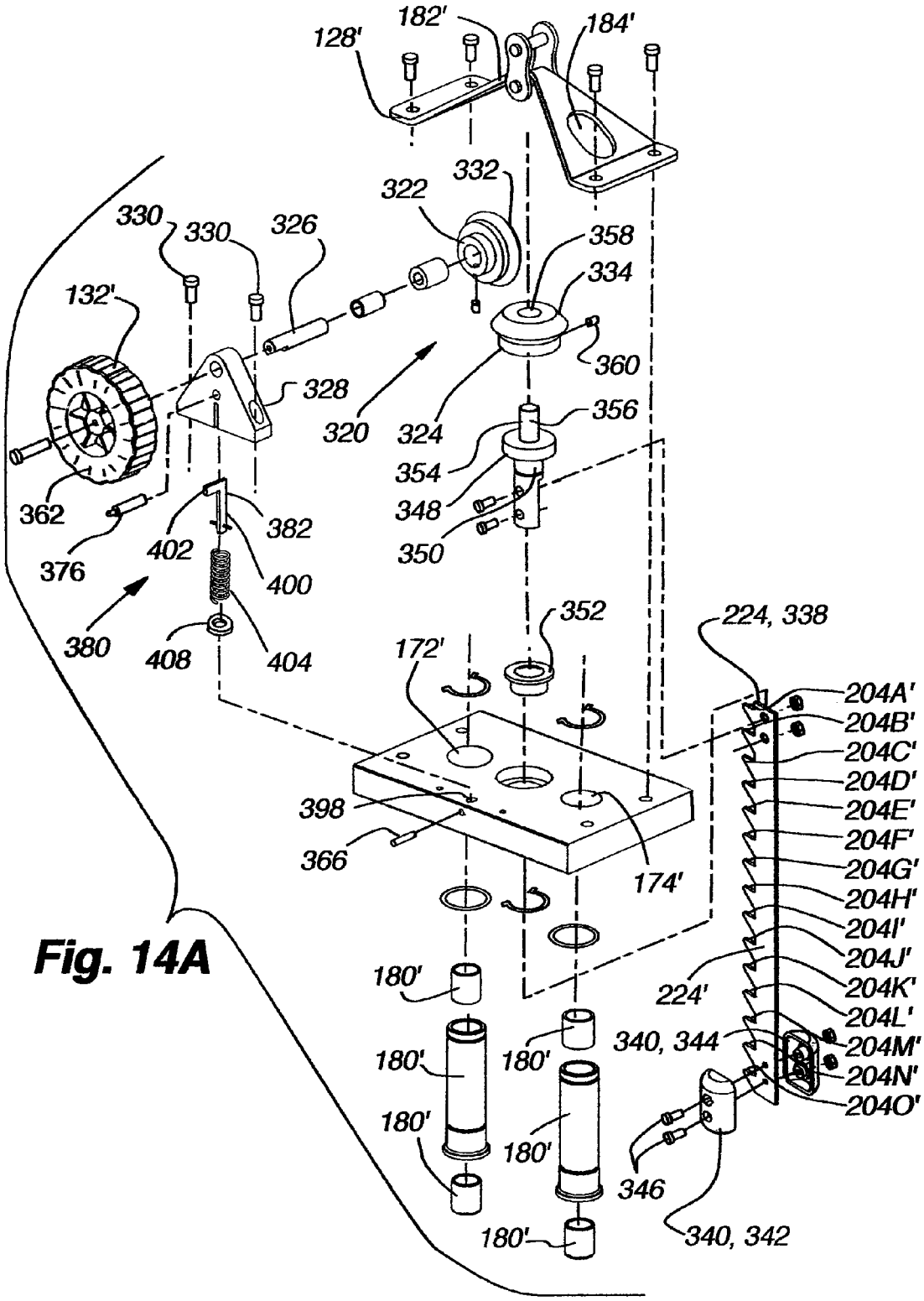
FIG. 14A is an exploded view of the upper locking assembly, top weight plate, lift member, and weight selector member shown in FIG. 12A.

As previously mentioned, the gear assembly 320 operably connects the selector knob 132' with the weight stack 102', and more particularly, with a weight selector member 142'. The desired amount of weight to be lifted is selected by rotating the selector knob 132', which in turn, causes the weight selector member 142' to rotate and selectively engage a desired number of weight plates 122'. As shown in FIG. 14A, the gear assembly 320 includes a first gear member 322 engaged with a second gear member 324. The selector knob 132' and the first gear member 322 are connected with a drive shaft 326. A support block 328 mounted on the first weight plate 122A' rotatably supports the drive shaft 326. As shown in FIG. 14A, two screws 330 connect the support block with the first weight plate 122A'. Therefore, rotation of the selector knob 132' causes the first gear member 322 to rotate. As discussed in more detail below, the second gear member 324 is connected with the weight selector member 142', which in turn, is rotatably connected with the top weight plate 122A'.

As shown in FIGS. 11B and 12A, the weight selector knob 132' and the first gear member 322 rotate about a substantially horizontally oriented axis of rotation defined by the drive shaft 326. The second gear member 324 and the weight selector member 142' rotate about a substantially vertically oriented axis of rotation. The first gear member 322 has a beveled gear face 332 adapted to engage a beveled gear face 334 on the second gear member 324. The interaction of the beveled gear faces translates the substantially horizontally oriented axis of rotation of first gear member 322 to the substantially vertically oriented axis of rotation of the second gear member 324. As such, rotation of the first gear member 322 causes the second gear member 324 to rotate, which in turn, rotates the weight selector member 142'.

In one scenario, rotation of the selector knob 132' in a clockwise direction (direction A in FIG. 11B) rotates the first gear member 322 in the same clockwise direction. Rotation of the first gear member 322 in the clockwise direction, in turn, causes the second gear member 324 to rotate in a clockwise direction (direction B in FIG. 12A), which also rotates the weight selector member 142' in the same clockwise direction. Alternatively, rotation of the selector knob 132' in a counterclockwise direction (direction A' in FIG. 11B) rotates the first gear member 322 in the same counterclockwise direction. Rotation of the first gear member 322 in the counterclockwise direction, in turn, causes the second gear member 324 to rotate in the counterclockwise direction (direction B' in FIG. 12A), which also rotates the weight selector member 142' in the same counterclockwise direction. As discussed in more detail below, when the weight stack 102' is in the "at rest" condition, rotation of the selector knob 132' causes the weight selector member 142' to rotate, which selectively engages the weight selector member with a desired number of weight plates to be lifted.

It is to be appreciated that the gear train 320 can be configured with different gear ratios such that the rotation of the selector knob 132' can have different rotational effects on the rotation of the weight selector member 142'. For example, the gear train can be configured such that the rotation of the selector knob can have a one-to-one effect on the rotation of the weight selector member. Other embodiments of the gear train can be configured differently so that the ratio can be greater than or less than one-to-one. It is also to be appreciated that other embodiments need not use gears to operably connect the selector knob with the weight selector member. It is also to be appreciated that the functional and structural interconnection of the weight selector knob with the weight selector member may have various configurations. For example, a different type of gear train may be used between the weight selection knob and the weight selector member in order to cause the weight selector member to rotate in conjunction with or in response to the rotation of the weight selection knob. Other embodiments can utilize sprockets, pulleys, belts, and chains and/or various arrangements of gears or other transmission means. In addition, as previously mentioned, the selector knob can be located in various other locations on the exercise device or the weight stack, which may require corresponding changes to the connection structure between the selector knob and the weight stack. For instance, the weight selection knob can be located on an end face of the weight stack or in different positions on the weight stack. The selector knob could also be located in various positions on the equipment frame or other locations if desired. For example, if a flexible torsion cable is used to connect the weight selection knob to the weight selector member, whether or not through a gear train or other transmission means, the weight selector knob could be positioned at a location separate from the weight stack. Additionally, in other embodiments, a motor or servo can be attached to the weight selector member and be controlled wirelessly by a remote selector control knob, button, and the like.

As discussed above with reference to FIG. 11B, the resistance cable 126' is connected with the top weight plate 122A' through the lift member 128'. As shown in FIG. 14A, four bolts 170' connect the lift member 128' to the top surface of top weight plate 122A'. As sufficient forces are applied to the resistance cable 126', the top weight plate 122A' moves up and down with the resistance cable. As shown in FIG. 14A, the top weight plate 122A' includes first and second guide rod apertures 172', 174' through which first and second guide rods 176', 178' extend. Guide rod bushing assemblies 180' positioned in first and second apertures 182', 184' of the lift member 128' and the top weight plate 122A' provide for a low friction engagement between the top weight plate and the guide rods 176', 178'. As shown in FIG. 12A, the first and second guide rods 176', 178' also extend through the weight plates (122B' through 122P') positioned under the top weight plate 122A'. As previously mentioned, the guide rods 176', 178' help guide the vertical motion of the weight plates 122'. As shown in FIGS. 12A-12E, the weight plates (122B' through 122P') have first and second guide rod apertures 186', 188' through which the first and second guide rods 176', 178' extend. Guide rod bushings 190' positioned in the first and second guide rod apertures also allow for a low friction engagement between the weight plates and the guide rods.

Figure 13A:
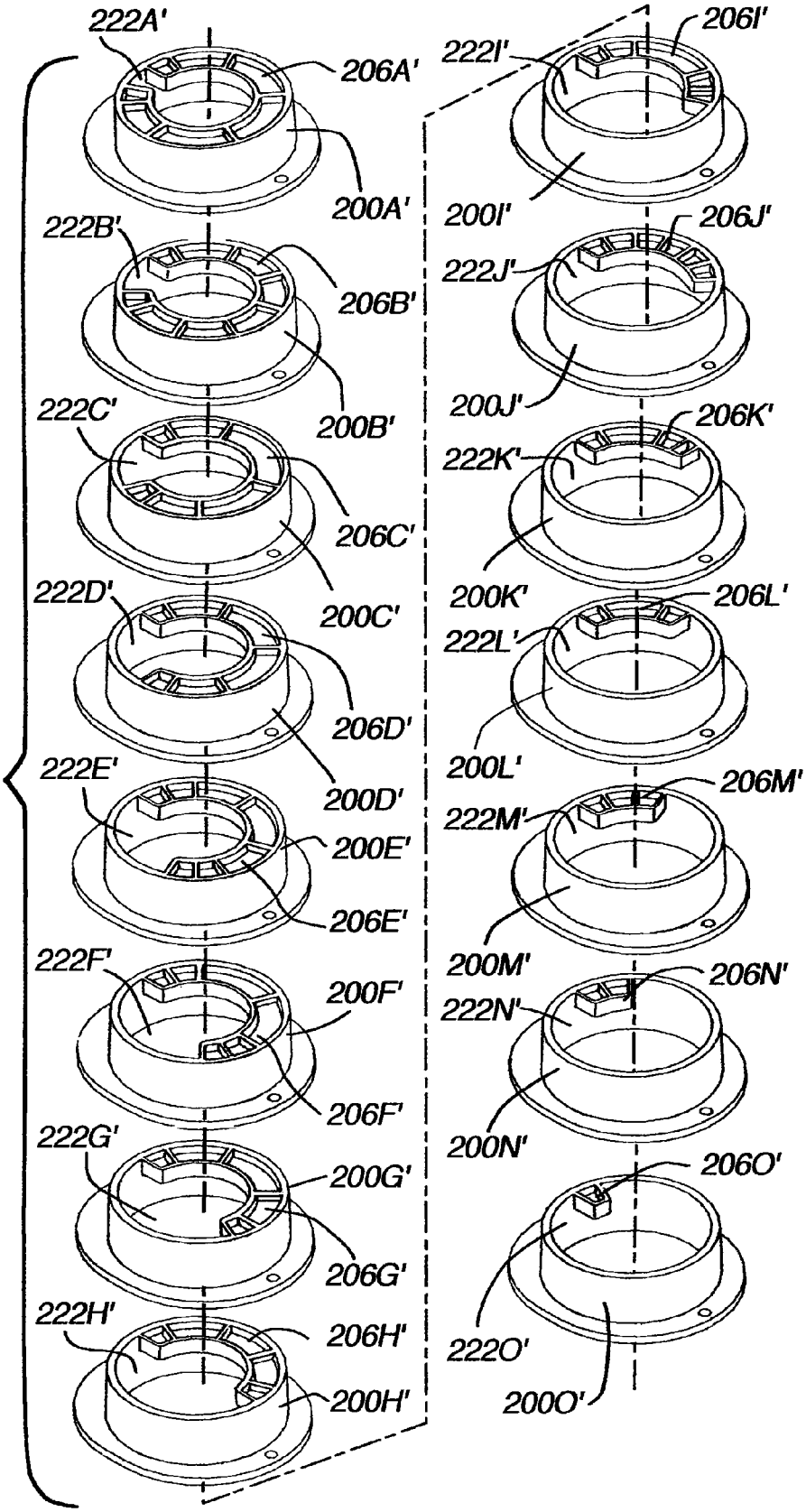
FIG. 13A shows top isometric views of the plurality of weight stack collars used in the weight stack of FIG. 11B.
Figure 13B:
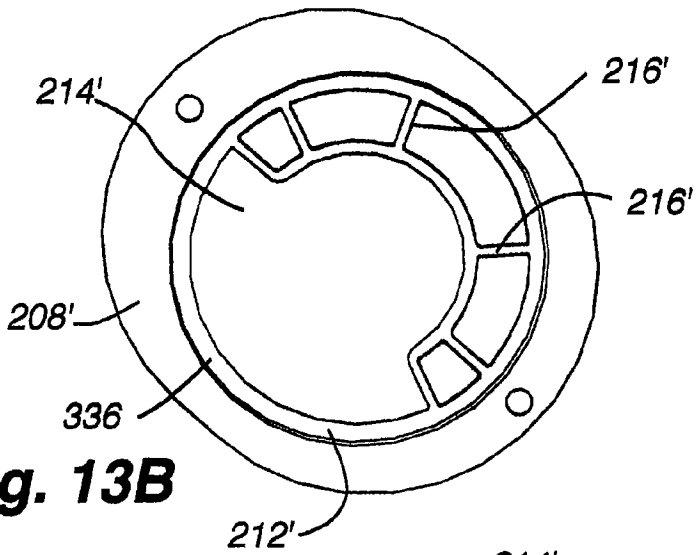
FIG. 13B is a top view of a weight plate collar.
Figure 13D:
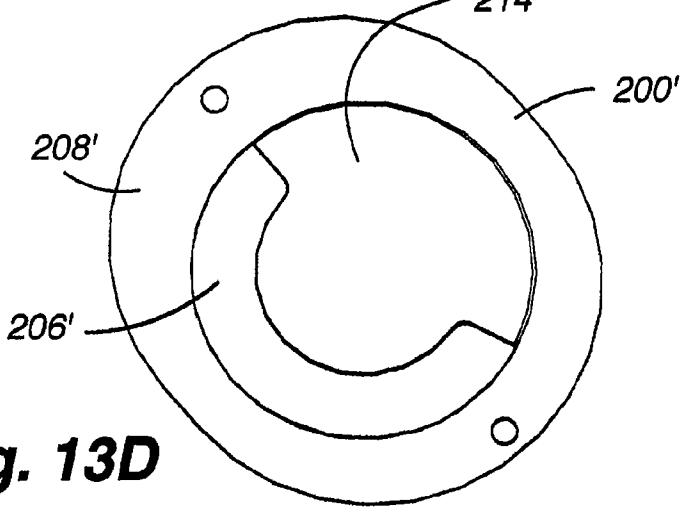
FIG. 13D is a bottom view of the weight plate collar shown in FIG. 13B.
Figure 13E:
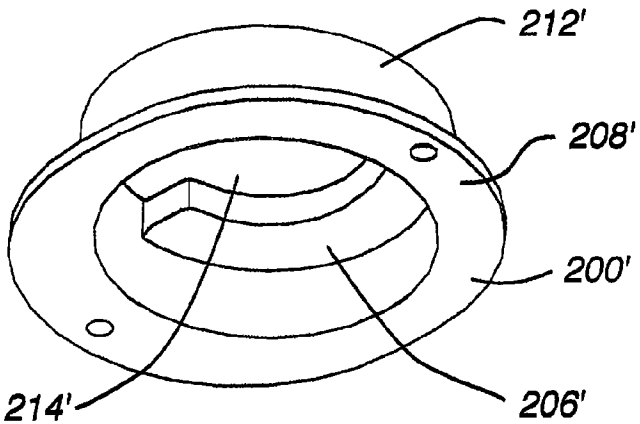
FIG. 13E is a bottom isometric view of the weight plate collar shown in FIG. 13B.
Figure 13C:
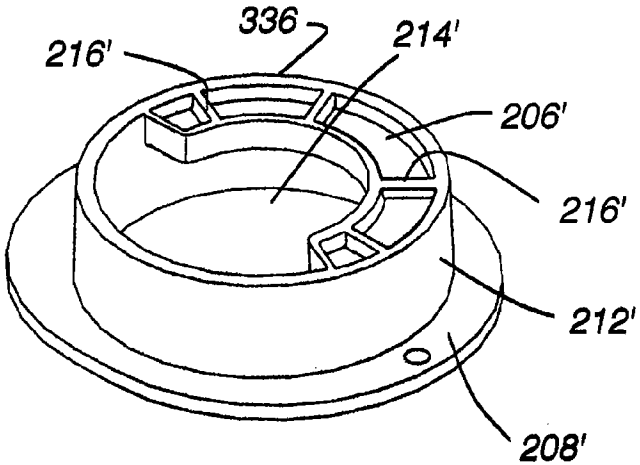
FIG. 13C is a top isometric view of the weight plate collar shown in FIG. 13B.

As shown in FIGS. 12A-12E, each weight plate 122' also includes an aperture 198' through which the weight selector member 142' extends. Although the apertures 198' are shown as being centrally located in the weight plates 122', it is to be appreciated that the apertures can be positioned in other locations on the weight plates. As shown in FIGS. 11B, 12A, and 13A, the weight stack 102 includes 16 weight plates (122A' through 122P'), with 15 of the weight plates (122B' through 122P') having a weight plate collar (200A' through 2000') positioned in the aperture 198. As previously mentioned, the weight selector member 142' is rotatably connected with the top or first weight plate 122A', and as such, does not include a weight plate collar. The weight plate collars 200' are held in the central apertures 198' of the weight plates 122' by two screws 202'. It is to be appreciated that other types of fastening structures can also be used to secure the weight plate collars to the weight plates. In addition, the weight plate collars may be formed integrally with the weight plates.

As discussed above with reference to the first weight stack, the weight selector member 142' of the second weight stack 102' includes a plurality of projections or tabs 204' adapted to selectively engage the weight plate collars 200' to select the desired number of weight plates 122' to be lifted. In particular, the weight selector member includes 15 tabs (204A'-2040' as shown in FIG. 14A) adapted to engage corresponding weight plate collars (200A'-2000' shown in FIG. 13A). The weight selector member 142' is rotated to place the tabs 204' into alignment with engagement surfaces which may be in the form of inner flanges 206' on the weight plate collars 200'. As such, a particular weight plate is selected to be lifted when one of the tabs on the weight selector member rotated into alignment with the flange on the weight plate collar connected with a particular weight plate.

As shown in FIGS. 13A-13E, the weight plate collars 200' each include an outer bottom flange 208' adapted to engage a bottom surface 210' of each weight plate 122'. It is to be appreciated that the outer bottom flanges of the weight plate collars can have virtually any shape that allows for attachment of the weight plate collars 200' to the weight plates 122' while positioned within the apertures 198' of the weight plates. A raised cylindrical middle portion 212' extending upward from the bottom flange 208' is adapted to be received within the aperture 198' in the weight plates 122'. The raised cylindrical middle portion 212' has a top rim 336 that includes the radially inwardly extending inner flange 206', defining an aperture 214' through which the weight selector member 142' extends. As shown in FIGS. 13B-13E, the inner flange 206' also includes a plurality of brace structures 216' to help strengthen the inner flange. As shown in FIG. 13A, the inner flange 206' of each weight plate collar 200' extends at least partially around the circumference of the inside of the raised cylindrical middle portion 212', defining a slot 222' between opposing end portions of the inner flange 206'. As discussed in more detail below, when one of the tabs 204' on the weight selector member 142' is aligned below the inner flange 206' on a particular weight plate, the weight plate is selected to be lifted. Alternatively, when one of the tabs 204' on the weight selector member is aligned with the slot 222' on a particular weight plate, the weight plate is not selected to be lifted.

Except for the top weight plate 122A', the weight plates (122B' through 122P') in the weight stack 102' each include weight plate collars 200' with inner flanges 206' and slots 222' having different lengths. For example, FIG. 13A shows a top isometric view of embodiments of the weight plate collars (200A' through 2000') used in the weight stack 102'. As previously mentioned, the weight stack includes 16 weight plates (122A' through 122P'), with 15 of the weight plates (122B' through 122P') having weight plate collars. The top or first weight plate 122A' does not include a weight plate collar, because the weight selector member 142' is rotatably connected with first weight plate 122A'. Therefore, the first or top weight plate collar 200A' in FIG. 13A is positioned in the second weight plate 122B' from the top, and the $15^{th}$ or bottom weight plate collar 2000' is positioned in the $16^{th}$ weight plate 122P' from the top (i.e. the bottom weight plate). From the top collar 200A' to the bottom collar 2000' in FIG. 13A, the lengths of the inner flanges 206' and slots 222' change from a relatively long flange 206A and a relatively short slot 222A' (shown in the top weight plate collar 200A') gradually to a relatively short flange 206O' and a relatively long slot 222O' (shown in the bottom weight plate collar 200O').

As discussed above with reference to the first weight stack, it is to be appreciated that weight plate collars 200' with varying inner flange and slot lengths can be used with various embodiments of the weight stack 102'. FIGS. 13B-13E shows various detailed views of the weight plate collar 200' with the inner flange 206' and slot 222' having lengths indicative of a weight plate collar used in the middle portion of the weight stack where the weight selector member 142' is oriented to have a particular corresponding tab 204' to engage the inner flange in several rotational orientations. As such, a weight plate collar used in the lower portion of the weight stack 102' may have relatively a relatively shorter flange length and a relatively longer slot length than shown in FIGS. 13B-13E, where the weight selector member is oriented to have a particular corresponding tab engage the inner flange in relatively fewer rotational orientations. Conversely, a weight plate collar used in the upper portion of the weight stack may have relatively a relatively longer flange length and a relatively shorter slot length than shown in FIGS. 13B-13E, where the weight selector member is oriented to have a particular corresponding tab engage the inner flange in relatively more rotational orientations.

As previously mentioned, when the weight stack 102' is in an "at rest" state (i.e. no weights are being lifted as shown in FIG. 11B), the selector knob 132' can be rotated, which in turn, rotates the weight selector member 142' to engage a desired number of weight plates to be lifted. FIGS. 12A and 14A show the weight selector member 142' which is rotatably connected with the first weight plate 122A'. The weight selector member 142' includes a main body 224' defined by an elongated flat length of metal 338 having triangular tabs extending from one longitudinal edge thereof. As previously mentioned, the tabs 204' are adapted to engage the inner flanges 206' of the weight plate collars 200' in the weight plates 122'. Depending on the configuration of each of the weight plate collars and each of the respective inner flanges on the weight plate collars, the weight selector member tabs 204 can be formed differently. As shown in FIGS. 12A and 14A, each tab 204' includes a substantially horizontally-oriented upper surface 226' and a sloped lower surface 228'. As discussed in more detail below, the upper surfaces 226' are adapted to engage inner flanges 206' of corresponding weight plate collars on weight plates that are selected to be lifted. As such, in this particular embodiment, the weight selector member includes one tab corresponding with each weight plate having a weight plate collar.

It is to be appreciated that the weight selector member 142' may have different shapes or forms, and may be made from different materials. Depending on the configuration of each of the weight plate collars with each respective contact surface of the weight plate collar, the weight selector member tabs can be formed differently. For instance, the tabs can be positioned on either side of the weight selector member as opposed to simply along one edge of the weight selector member. Although the tabs are shown as being equally spaced, the tabs may also be unevenly spaced, depending on the spacing between the weight plates, for example if the weight plates had differing thicknesses.

Figure 16A:
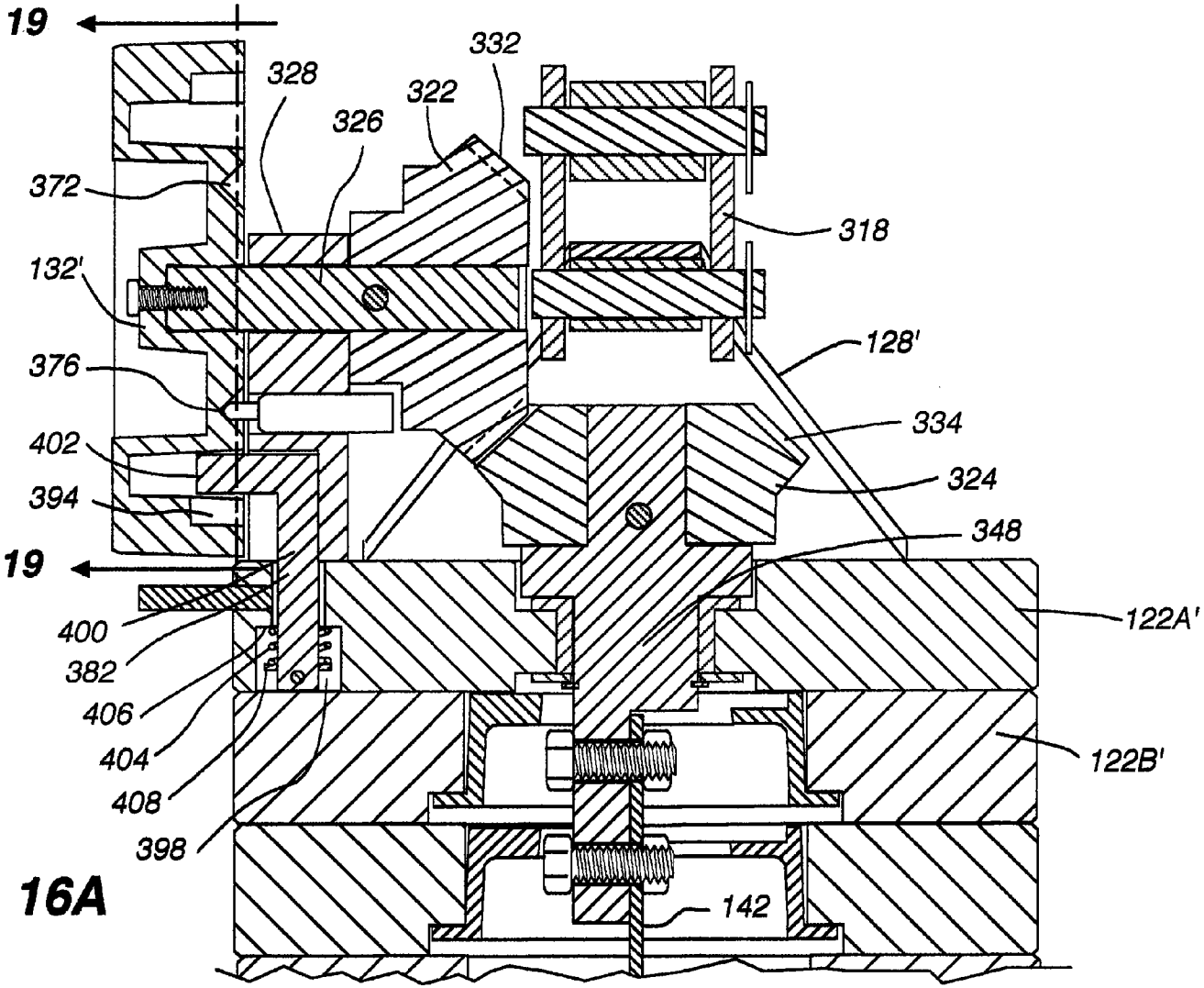
FIG. 16A is a cross-sectional view of an upper portion of the weight stack depicted in FIG. 11B, taken along line 16-16.
Figure 16B:
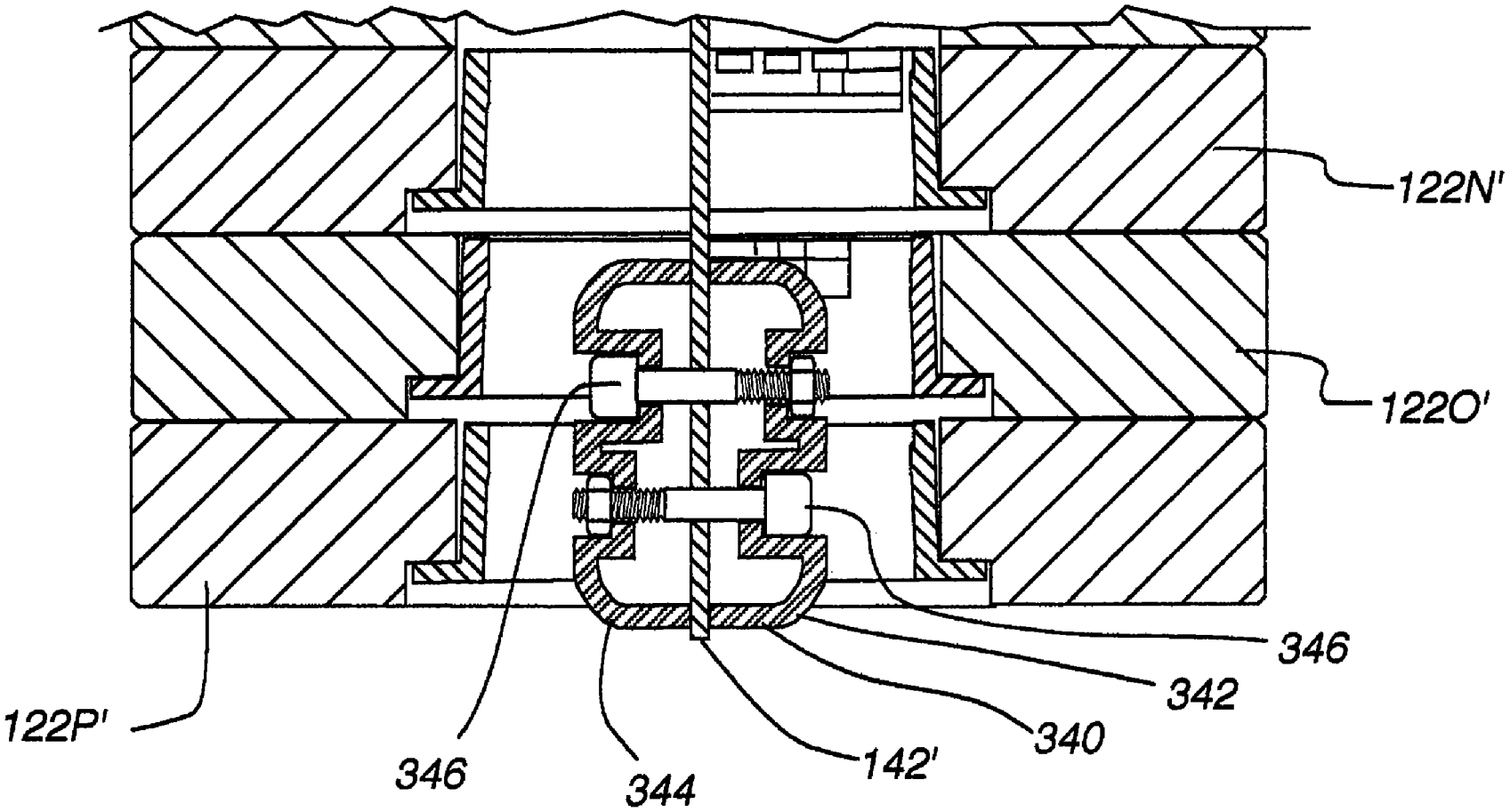
FIG. 16B is a cross-sectional view of a lower portion of the weight stack depicted in FIG. 11B, taken along line 16-16.
Figure 18A:
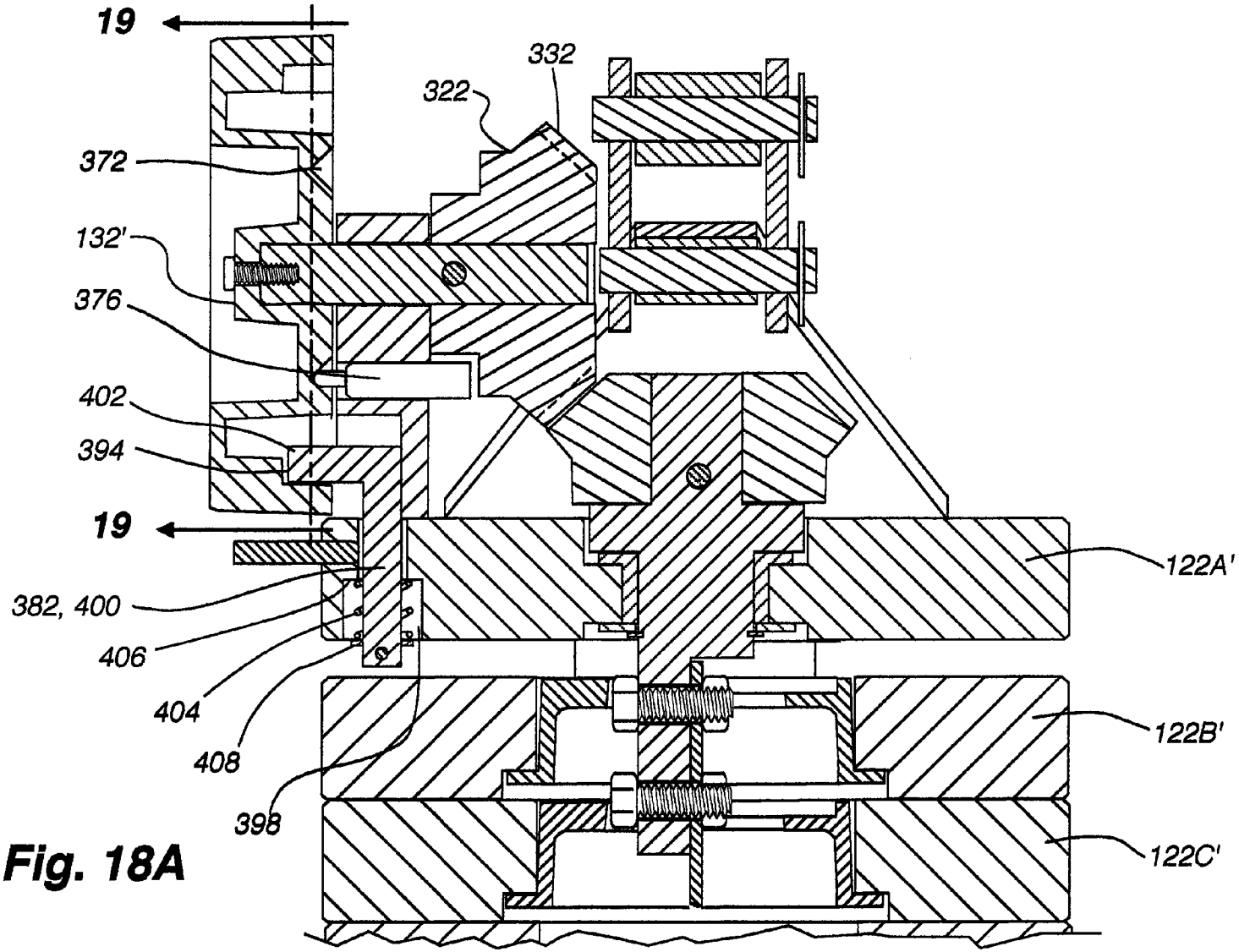
FIG. 18A is a cross-sectional view of an upper portion of the weight stack depicted in FIG. 11A, taken along line 18-18.
Figure 18B:
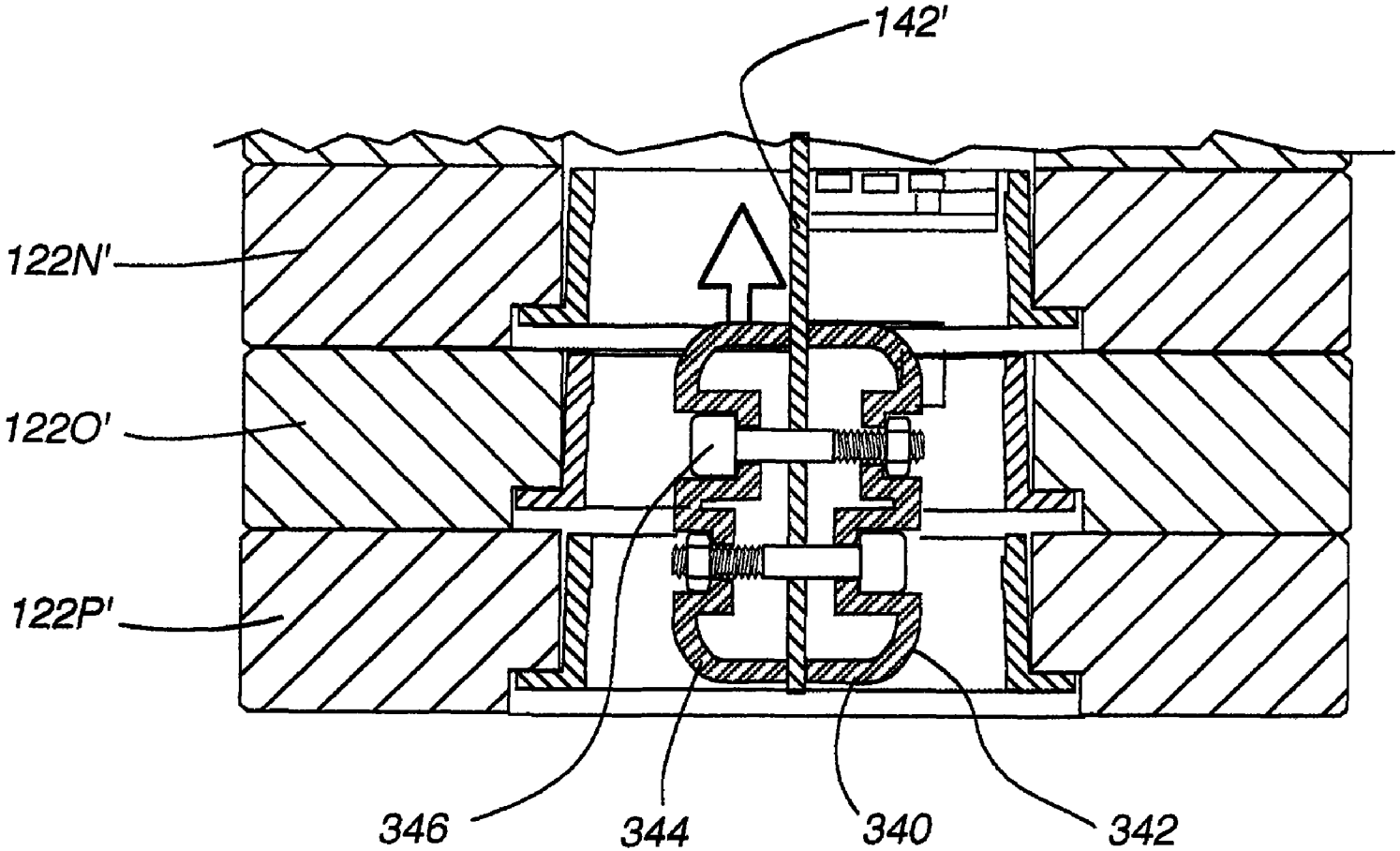
FIG. 18B is a cross-sectional view of a lower portion of the weight stack depicted in FIG. 11A, taken along line 18-18.

As shown in FIGS. 12A, 14A, 16B, and 18B, the weight selector member 142' includes a cylindrically-shaped bushing or bearing housing 340 connected with a bottom end portion 242' the main body 224' of the weight selector member 142'. As shown in FIGS. 14A, 16B, and 18B, the bushing housing 340 includes a first portion 342 and a second portion 344 secured to the bottom end portion of the main body 244' with two bolts 346. The bushing housing 340 acts a bearing or bushing that aligns the bottom end of the weight selector member 142' with the internal diameters of the weight plate collars 200' to help prevent the weight selector member from becoming misaligned and rattling during use.

Figure 15:
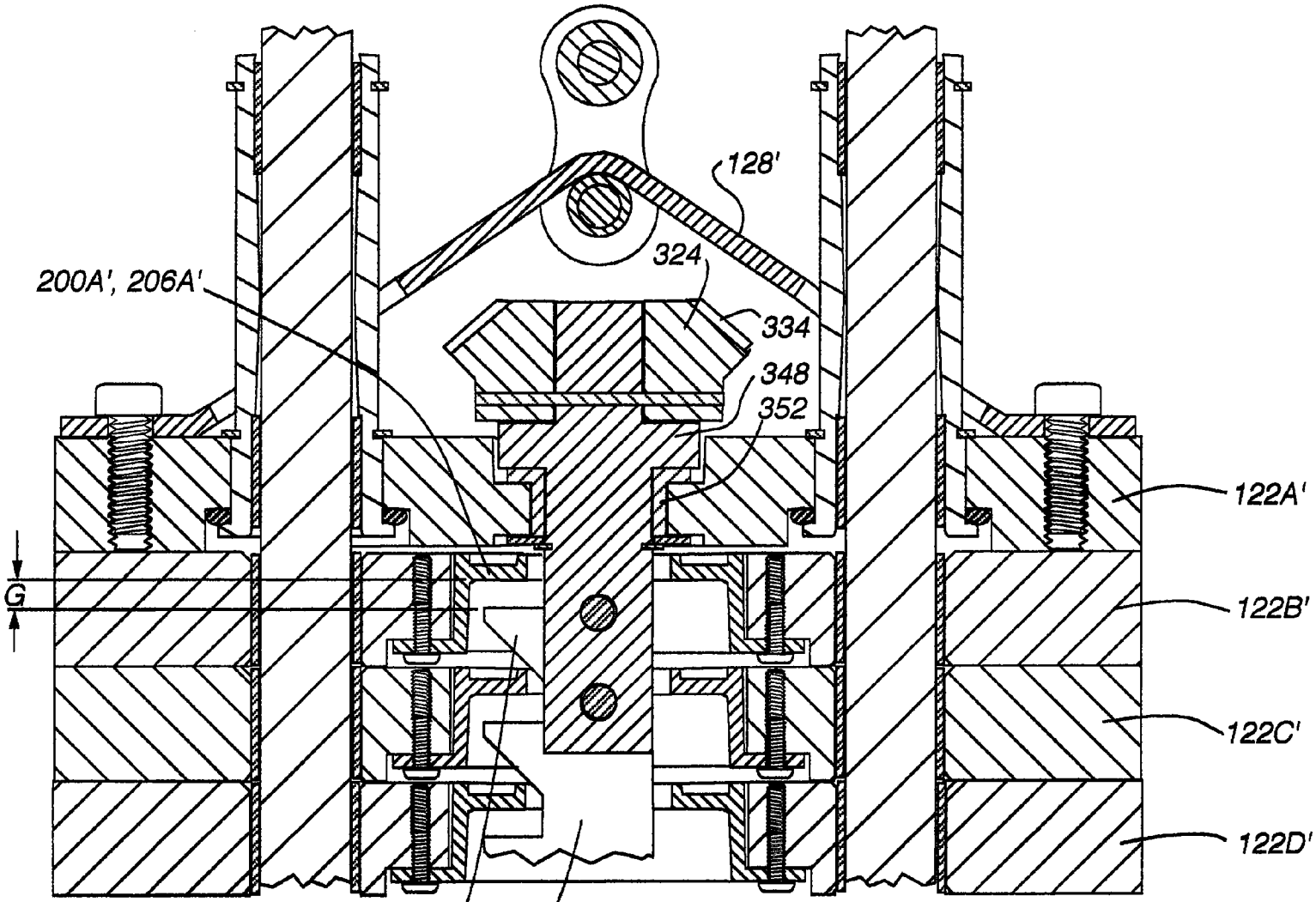
FIG. 15 is a cross-sectional view of an upper portion of the weight stack depicted in FIG. 11B, taken along line 15-15.
Figure 17:
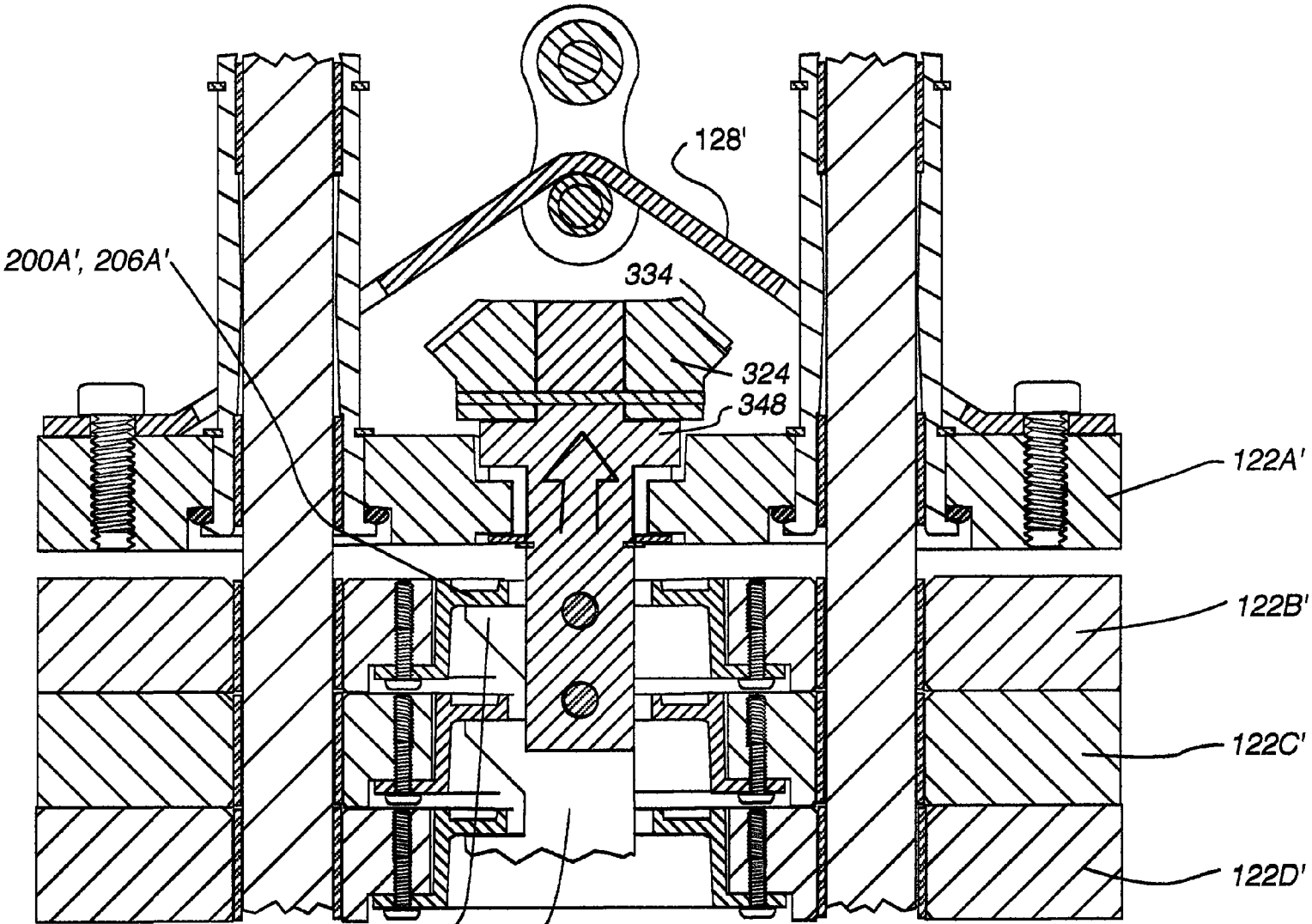
FIG. 17 is a cross-sectional view of an upper portion of the weight stack depicted in FIG. 11A, taken along line 17-17.

As previously mentioned, the second gear member 324 and the weight selector member 142' are rotatably connected with the top weight plate 122A'. As such, the weight selector member 142' is lifted up and down along with the top weight plate 122A' and can rotate in the directions B and B' shown in FIG. 12A relative to the top weight plate 122A'. As shown in FIGS. 14A, 15, and 17, the weight selector member 142' includes a bearing member 348 connected with an upper end portion 232' of the main body 224' of the weight selector member. The bearing member defines cylindrically-shaped bearing surfaces 350 adapted be received within a corresponding bearing 352. The bearing member 348 and the bearing 352 are adapted to be received within the aperture 198' in the top weight plate 122A'. An upper end portion of the bearing member 348 defines a cross section with an curved side 354 connected with a flat side 356. The upper end portion of the bearing member is adapted to be received within a correspondingly shaped aperture 358 in the second gear member 324, which rotatably connects the bearing member with the second gear member. A set screw 360 on the second gear member acts to hold the second gear member on the bearing member.

Figure 14B:
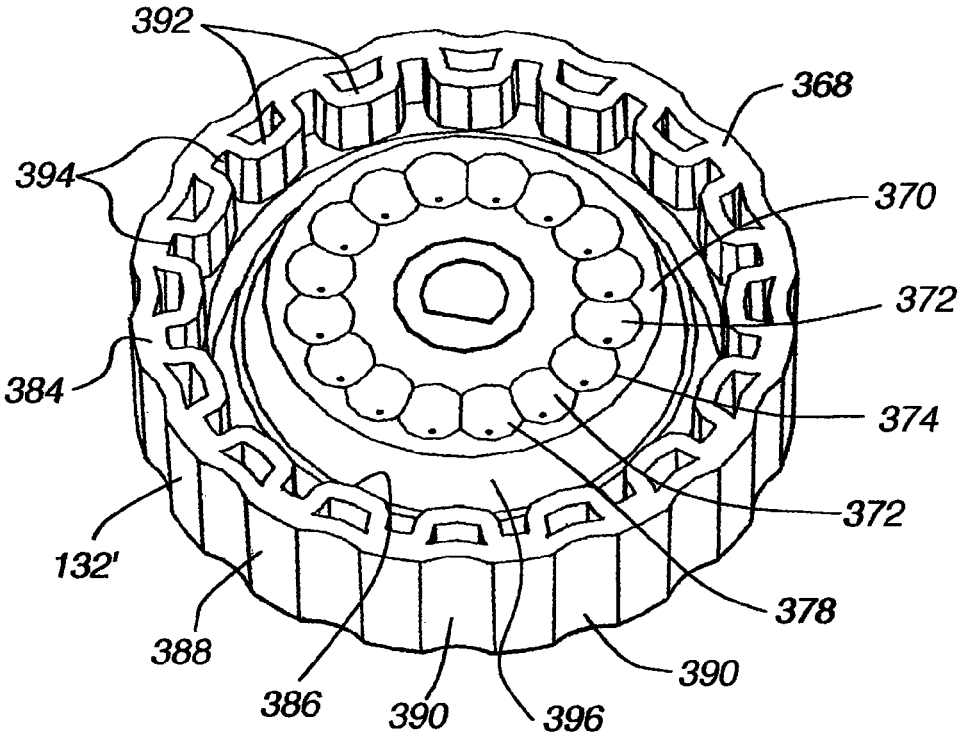
FIG. 14B is a detailed rear isometric view of a selector knob shown in FIG. 14A.
Figure 14C:
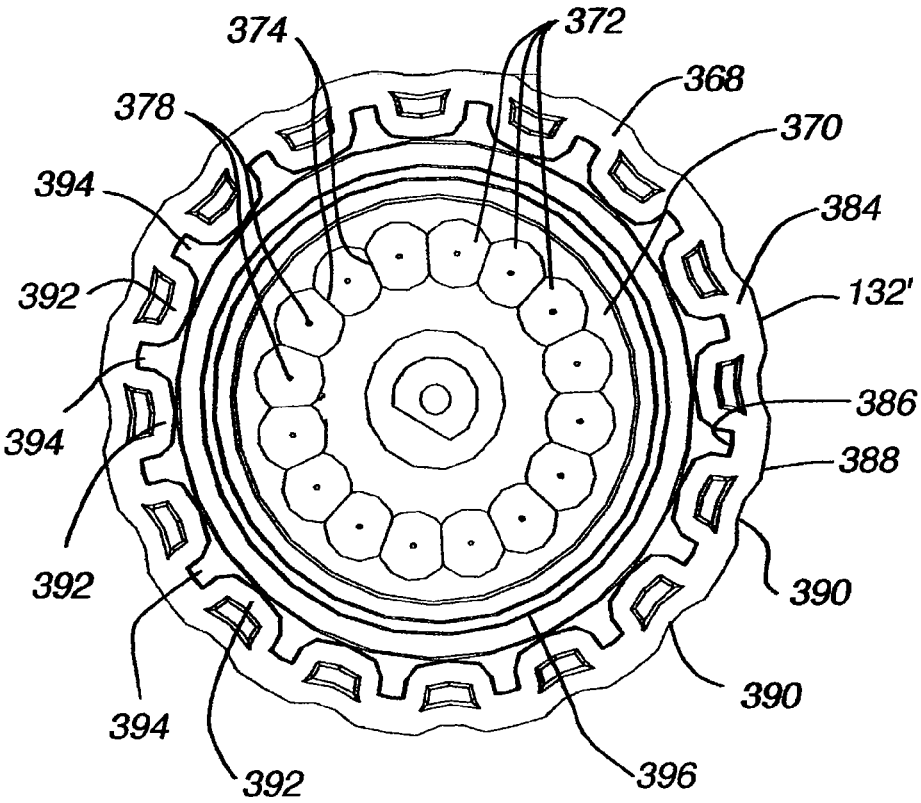
FIG. 14C is a detailed rear side view of a selector knob shown in FIG. 14A.
Figure 14D:
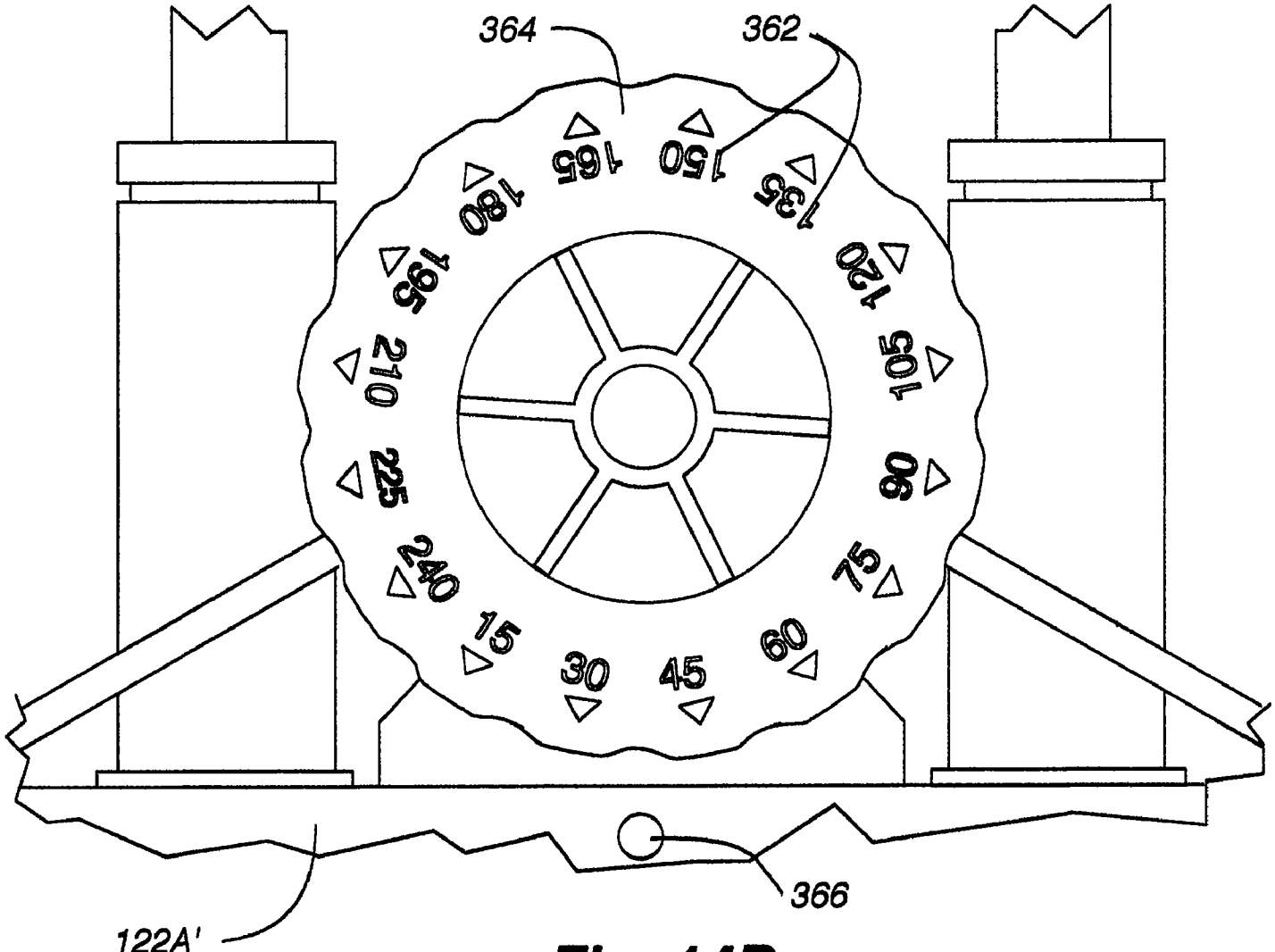
FIG. 14D is a detailed front side view of the selector knob shown in FIG. 11B.
Figure 19A:
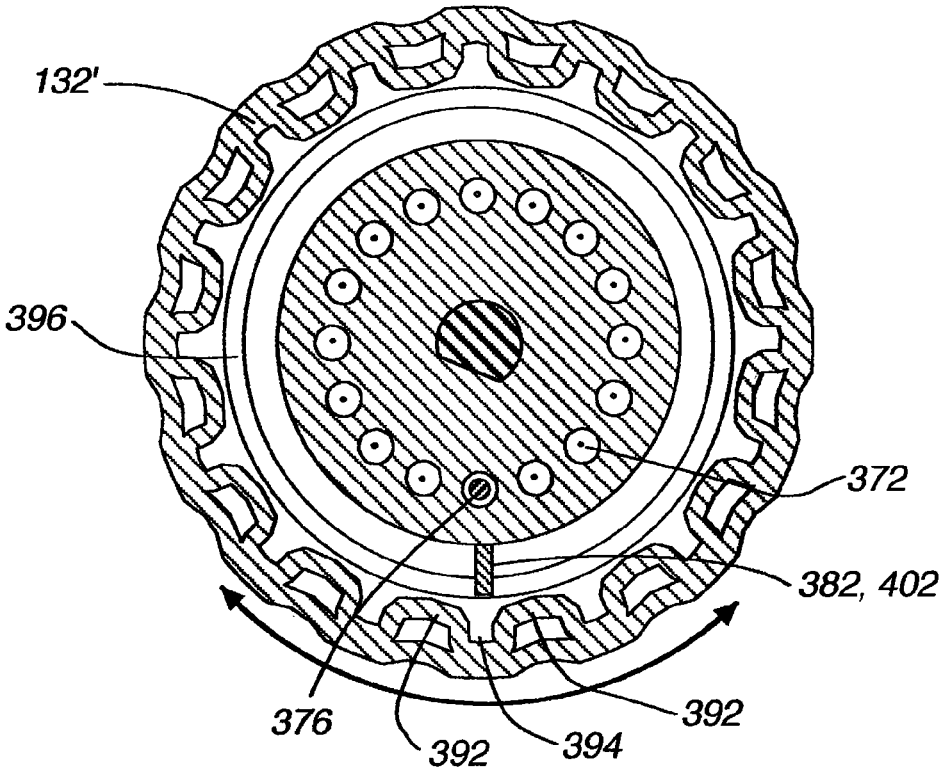
FIG. 19A is a cross-sectional view of the weight stack depicted in FIG. 16A, taken along line 19-19.
Figure 19B:
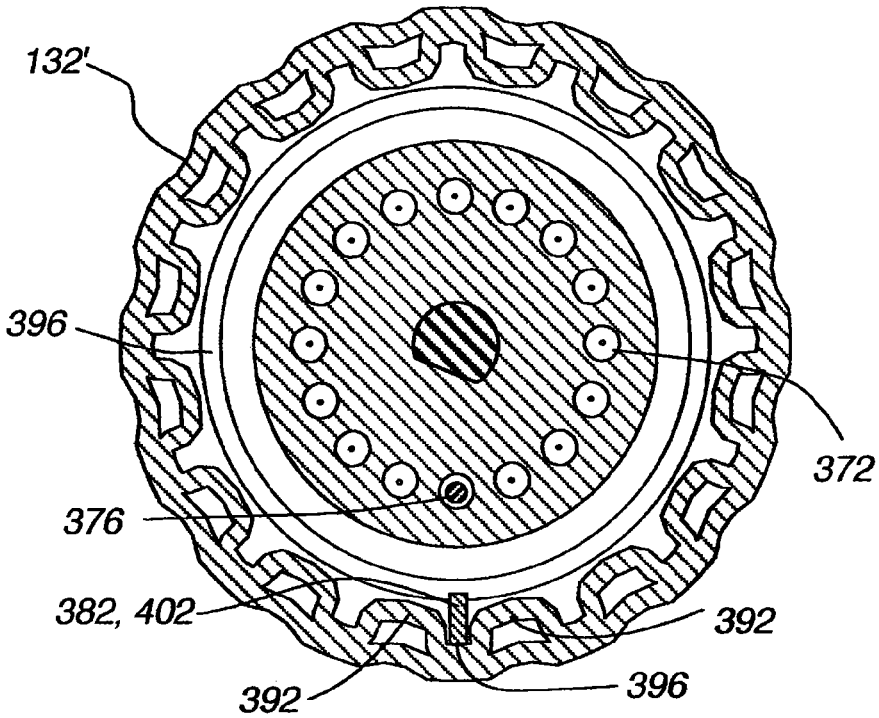
FIG. 19B is a cross-sectional view of the weight stack depicted in FIG. 18A, taken along line 19-19.

As shown in FIG. 14D and others, indicia or markings 362 located on a front side 364 of the selector knob 132' correspond with the various available weight selections. As such, a user can determine the amount of weight selected to be lifted by aligning one of the markings with an indicator pin 366 affixed to the top weight plate 122A'. As shown in FIGS. 14B and 14C, a rear side 368 of the weight selector knob includes a central portion 370 defining a plurality of adjacent conical indentations 372 collectively in the form of a circle. Edges 374 of the conical indentations 372 connect and overlap with one another. As shown in FIGS. 14A, 19A, and 19B, a spring-loaded detent pin 376 is positioned in the support block 328 with the detent pin 376 adapted to ride in the conical indentations 372. As the user turns the selector knob 132', the detent pin 376 contacts conical surfaces 378 of the conical indentations 372 to provide a "positive" feel for the user turning the selector knob. As such, the detent pin 376 effectively indicates when the weight selector member 142' is in the proper fully engaged position at each weight selection position on the selector knob. The detent pin 376 is spring-loaded so that if the user attempts to locate the selector knob 132' in between weight selection locations, the detent pin 376 will push on the sloped surfaces 378 of the conical indentations 372 and center the position of the detent pin 376 the nearest conical indentation. As such, the detent pin 376 acts to properly orient the weight selection knob 132' with the nearest weight selection and help prevent the selection knob from being misaligned during use. The indicator pin 366 extending from the top weight plate 122A' in FIGS. 14A and 14D is the position indicator for the weight selection knob. For the weight selection knob to cause the weight selection rod to be in full engagement with the proper amount of weight plates, the weight indicator on the weight selector knob 132' must be in alignment with the indicator pin 366. For example, FIG. 14D shows the weight selector knob 132' with the weight selection being positioned between 30 and 45 pounds. In the particular position shown, the weight selection knob 132' is in between proper weight selecting positions.

As previously mentioned, a user selects the desired amount of weight to lift by turning the selector knob 132', which turns the weight selector member 142' to engage a desired number of weight plates 122'. Each rotation of the selector knob 132' between detents rotates the weight selector member 142' to orient the tabs 204' to engage the number of weight plates sufficient to provide the load desired by the user and as indicated by the indicator pin 366 and the markings 362 on the selector knob 132'. By rotating the selector knob 132', a user can select the desired weight to be lifted, ranging from a minimum of only the top weight plate 122A' to a maximum of all the weight plates 122' in the weight stack 102'. For example, if the user selects the minimum weight to be lifted (i.e. only the top plate 122A'), then the weight selector member 142' is oriented so that each of the tabs 204' are aligned with the slots 222' in all the respective weight plate collars 200'. As such, when the weight selector member 142' is lifted upwardly, only the top weight plate 122A' is lifted upwardly and the remaining weight plates (122B' through 122P') in the weight stack 102' are left in the "at rest" position. In another example, if the user turns the selector knob 132' to a weight corresponding with the top weight plate 122A' and the second weight plate 122B', then the weight selector member 142' is oriented so that a top-most tab 204A' is positioned under the inner flange 206' in the top-most collar 200A'. In addition, the remaining tabs (204B' through 2040') are oriented in the slots 222' of respective collars. As such, when the weight selector member 142' is lifted upward, only the top two plates 122A', 122B' are lifted upwardly.

As previously mentioned, the weight stack 102' can include a locking mechanism 380 to help prevent a user from rotating the selector knob 132' and weight selector member 142' when the top weight plate 122A' and weight selector member are lifted upward. As shown in FIGS. 14A, 16A, and 18A, the locking mechanism 380 includes lock member in the form of a spring-loaded key 382 mounted on the top weight plate 122A' that is adapted to selectively engage the selector knob 132'. More particularly, when the top weight plate 122A' is lifted upward a sufficient distance, the key 382 automatically engages the selector knob 132' and prevents the selector knob from being rotated. When the weight stack 102' is an "at rest" state (i.e. no weight plates are being lifted as shown in FIGS. 11B and 16A), the key is disengaged from the selector knob, which allows the selector knob to be rotated as shown in FIG. 19A.

As shown FIGS. 14B and 14C, the selector knob 132' includes a substantially circular outer wall 384 having an inner surface 386 and an outer surface 388. Grip indentations 390 are formed in the outer surface 388 for the user to utilize in conveniently gripping when turning the selector knob 132'. The inner surface 386 defines a plurality of spaced apart radially inwardly directed bumps 392 that are spaced apart by grooves 394. Each of the grooves 394 aligns with a particular weight indicator 362 on the front side 364 of the selector knob 132'. An annular clearance space 396 is formed between the bumps 392 and the central portion 370 on which the conical indentations 372 are formed. As discussed below, a portion of the key 382 is adapted to move between the grooves 394 and the annular clearance space 396 to selectively lock and unlock the rotational position of the selector knob 132'.

As shown in FIGS. 14A, 16A, and 18A, the key 382 is positioned in a central side aperture 398 in the top weight plate 122A'. The key includes a first leg portion 400 connected at a right angle with a second leg portion 402, defining an L-shape. The first leg portion 400 extends through the aperture 398 in the top weight plate 122A', and the second leg or lateral portion 402 extends into the annular clearance space 396 of the selector knob 132'. FIGS. 16A and 19A show the key 382 in an upward first position (i.e. the unlocked position) with the second leg portion 402 positioned in the annular space 396 on the selector knob 132'. The key 382 is sized such that when the second leg portion 402 is positioned in the annular space 396, the selector knob 132' can turn freely. As shown in FIGS. 18A and 19B, the key 382 is movable from the first upward position to a second downward position (i.e. the locked position) wherein the second leg portion 402 is positioned within one of the grooves 394 on the selector knob 132'. When the second leg portion 402 of the key 382 is positioned in one of the grooves 394, the bumps 392 on opposing sides of the groove, which also define the groove, prevent the selector knob 132' from rotating because the second leg portion 402 of the key 382 interferes with the bumps. As such, rotation of the selector knob 132' on the drive shaft is prohibited.

As shown in FIGS. 14A and 18A, the key 382 is biased in the second downward position (i.e. the locked position) by a spring 404 mounted in the aperture 398 in the top weight plate 122A'. In particular, a seat 406 is formed the aperture 398 in which the first leg portion 400 of the key 382 and spring 404 are received. The spring 404 is held on the key 382 by a retainer 408. The key 382 is biased downwardly relative to the top weight plate 122A' by the spring 404 pushing against the seat 406 and the retainer 408, which pushes the key downwardly. When the weight stack 102' is the "at rest" state (i.e. no weight plates are being lifted as shown in FIG. 11B), the top weight plate 122A' rests on the second weight plate 122B' and the first leg portion 400 of the key 382 is engaged with the second weight plate to hold the key in the unlocked position. More particularly, the first leg portion 400 of the key 382 extends from the bottom of the aperture 398 a sufficient distance such that when the first leg portion is engaged with the second weight plate 122B', the key 382 is pushed upward and held in the first upward position shown in FIGS. 16A and 19A. The first upward position of the key allows the user to change the selected weight to be lifted by rotating the selector knob 132'.

As shown in FIGS. 11A, 17, and 18A, when lifting forces are applied to the resistance cable 126' and top weight plate 122A', such as during exercise, the top weight plate separates from the second weight plate 122B'. The separation between the first and second weight plates occurs because a gap G exists between the tabs 204' and the inner flanges 206' in each weight plate collar 200' prior to actuation of the resistance cable, as shown in FIG. 15. More particularly, the top weight plate 122A' is connected directly to the lift bracket 128' and the resistance cable 126', and as such, is lifted directly by the resistance cable. However, the other weight plates (122B' through 122P') in the weight stack are lifted by the engagement between the tabs on the weight selector member 142' and this collar 200', as explained above. For example, as upward forces are applied to the resistance cable 126', the first weight plate 122A' moves upwardly with the resistance cable. The other weight plates (122B' through 122P') stay in position until tabs on the weight selector member 142' engage respective flanges in the weight plates. As such, the tabs 204' move upwardly under the force of the resistance cable 126' the distance defined by the gap G before engaging the inner flanges 206' on the collars 200' and lifting respective weight plates. The distance defined by the gap G is sufficient to allow the key 382 to be biased sufficiently downwardly, as the first and second weight plates separate when lifted, to cause the second leg portion 402 of the key 382 to be received in one of the grooves 394 on the selector knob 132', locking the selector knob in a particular rotational position. While the gaps between the tabs and flanges in each weight stack are can be all be the same dimension, it is not necessary. If the gaps are not the same dimension, for instance if the gap in the fourth weight plate 122D' is smaller than the gap in the third weight plate 122C', then the third weight plate 122C' may be supported by the fourth weight plate 122D' and not by the respective tab 204C' positioned in the third weight plate when lifted.

Referring to FIGS. 11A, 17, 18A, and 19B, when the weight selector member 142' is lifted upward such as during exercise repetitions, the top weight plate 122A' moves away from the second weight plate 122B' and the spring 404 biases the key 382 downwardly to cause the second leg portion 402 of the key to move into one of the respective grooves 394 (i.e. the locked position) for the selected total weight. At this point, the selector knob 132' cannot be rotated, because the second leg portion 402 of the key 382 interferes with the rotation of the selector knob 132'. Because the selector knob cannot be turned, the orientation of the weight selector member 142' cannot be changed, which helps prevent the user from accidentally or intentionally causing weight plates to be deselected by rotation of the weight selection knob. When the user is finished exercising, and the weight stack is lowered to an "at rest" state, the first leg portion 400 of the key 382 engages the top of the second plate 122B', and the key is pushed upwardly as shown in FIGS. 16A and 19A. At the same time, the second leg portion 402 of the key 382 is pushed upward and out of the groove 394 and into the annular space 396, thereby allowing the user to rotate the selector knob and select a different weight.

As discussed above with reference to FIGS. 11B, 12A, 13A, and 14A, the weight selector member 142' extends downwardly through the central apertures 214' in each of the weight plate collars 200' which are positioned in each of the weight plates (122B' through 122P') except the top weight plate 122A'. The tabs 204 on the weight selector member 142' extend in a particular direction. As noted above, the weight plate collars 200' in each of the weight plates have different sized inner flanges 206' and correspondingly sized slots 222'. For instance, the weight plate collar 200A' in the second weight plate 122B' has a relatively short slot 222A' and a relatively long flange 206A'. The weight plate collar 200B' for this third weight plate 122C' has an incrementally shorter flange 206B' and an incrementally larger slot 222B'. A middle weight plate 122H' has a slot 222G' and flange 206H' of equal lengths. The bottom weight plate 122P' effectively has the reverse of the second weight plate 122B' with a relatively short flange 222O' and relatively long slot 206O' effectively being the balance of the periphery of that inner aperture of the weight plate collar. Thus, for example, in all but one position of weight selection on the weight selection knob 132', the tab 204A' on the weight selector member 142' engages the flange 206A' in the weight plate collar 200A' in the second weight plate 122B' from the top. As such, each weight plate (122B' through 122P') (other than the top weight plate) is lifted by corresponding tabs on the weight selector member 142', as opposed to the next lower weight plate.

As described above with reference to various figures, when the weight stack 102' is in the "at rest" state (i.e. no weight is being lifted), a user can rotate the selector knob 132' to select a desired number of weight plates 122' to be lifted. Because the selector knob 132' is operably connected with the weight selector member 142' through the gear train 320', rotating the selector knob causes the weight selector member 142' to rotate. Rotation of the weight selector member 142' places a desired number of tabs 204' in alignment below the inner flanges 206' on weight stack collars 200' on a desired number of weight plates 122'. Once the desired number of weight plates 122' is selected, forces applied to the resistance cable 126' lifts the first weight plate 122A' and weight selector member 142' along with the selected number of weight plates. As weight plates 122' are lifted from the "at rest" state, the locking assembly 380 prevents rotation of the selector knob 132', which prevents rotation of the weight selector member 142'.

In one example, where the user selects to lift the top two weight plates 122A', 122B', the top tab 204A' on the weight selector member is oriented to engage respective flanges in the top weight plate collar 200A', with the remaining tabs on the weight selector member positioned in the slots 222' of corresponding weight plate collars. Thus, when the user actuates the exercise machine, and the selector rod is lifted upward by the cable, only the top two weight plates 122A', 122B' are lifted with the weight selector member 142' with the other weight plates remaining positioned in their "at-rest" position. In another example, when the user selects to lift every one of the weight plates (122A'-122P') in the weight stack, the weight selector knob 132' is turned to the maximum number. In this position, all of the tabs 204' on the weight selector member 142' are oriented to engage the flanges 206' in the corresponding weight plate collars 200'. As such, when the user applies forces to the resistance cable 126' to lift the weight selector member 142', all of the weight plates in the weight stack 102' are lifted upwardly. In this manner, each weight plate is individually selected by the particular tab coordinated with the weight plate so that each tab only has to lift the load of only one weight plate, as opposed to the bottommost tab lifting the load of all of the weight plates from that weight plate upward.

As described above, although the weight selector member can be rotatably connected with the top weight such that the top weight plate is always selected to be lifted, other embodiments can be configured with a selectable top weight plate. For example, it is contemplated that in other embodiments that the top weight plate can have a collar positioned therein with a slot formed in the inner flange. The weight selector knob apparatus can be structured to not be attached to the top weight plate, but instead attached to the cable mounting or the like. For instance, a two-piece weight selector member could be used that has a bottom length rotatably attached to a top portion to allow selective rotation of the bottom length to orient the tabs. The top portion can be attached to the cable. When the cable is lifted, the entire weight selector member is lifted as well. As such, it would be possible to have a zero pound position on the selector knob (i.e. none of the tabs on the weight selector member positioned to engage a flange in respective weight plate collars), which allows the weight selector member to be extended entirely from the weight stack without lifting any weight plates. At the position of the weight selector knob where the intention is to select only the top weight plate (say 10 pounds) the top tab on the weight selector member would engage the flange in the weight plate collar in the top weight plate. With only the top plate selected, every other tab on the weight selector member would be positioned in the slots of corresponding weight plate collars. In this orientation, when the user actuates the exercise machine, the weight plate selector rod is lifted by the cable and the top tab engages only the flange on the top weight plate, thereby lifting only the first weight plate.

It is to be appreciated that embodiments of a weight stack having a weight selector mechanism that allows a user to select a desired amount of weights to be lifted from a weight stack has been described. Embodiments of the weight stack can also include a locking mechanism that prevents the user from accidentally or intentionally manipulating the weight selector mechanism when weights are lifted, which could cause weight plates to be deselected while suspended in an upward position. It will also be appreciated that the features described in connection with each arrangement and embodiment of the weight stacks described herein are interchangeable to some degree so that many variations beyond those specifically described are possible.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A vertical weight stack for an exercise device comprising:

a plurality of weight plates each including an aperture defined by an engagement surface;

an engagement assembly supported on the plurality of weight plates, the engagement assembly including a longitudinal member with a plurality of longitudinally spaced projections, the longitudinal member defining a longitudinal axis; and a lock member operably associated with the longitudinal member to selectively lock the rotational position of the longitudinal member, the lock member comprising a pin, a member joined to the longitudinal member and a bias member operatively associated with the pin, the bias member biasing the pin to a first position that engages the pin with the member when the longitudinal member is moved from a predetermined rest position, and engagement of the pin with the member locks the rotational position of the longitudinal member;

wherein at least one of said apertures is shaped differently than the other said apertures and each aperture and engagement surface is arranged adjacent the longitudinal member;

the longitudinal member is rotatably positionable to arrange the spaced projections for engagement with a corresponding engagement surface to engage one or more of the plurality of weight plates;

when the rotational position of the longitudinal member is locked by engagement of the pin with the member, a user is unable to rotate the longitudinal member around the longitudinal axis; and when the longitudinal member is moved to the predetermined rest position, the pin moves to a second position that disengages the pin from the member and allows the user to rotate the longitudinal member around the longitudinal axis.

2. The weight stack of claim 1, wherein the plurality of longitudinally spaced projections comprises a plurality of triangularly-shaped tabs.

3. The weight stack of claim 1, the engagement assembly further comprising a grip member operably connected with the longitudinal member to adjust the rotational position of the longitudinal member.

4. The weight stack of claim 3, wherein the grip member is a knob.

5. The weight stack of claim 3, the engagement assembly further comprising a gear train connecting the grip member with the longitudinal member.

6. The weight stack of claim 5, wherein the gear train comprises:

a first gear connected with the grip member;

a second gear connected with the longitudinal member; and wherein the first gear member is engaged with the second gear member.

7. The weight stack of claim 3, the engagement assembly further comprising:

a first pulley connected with the grip member;

a second pulley connected with the longitudinal member; and at least one belt operably connecting the first pulley with the second pulley.

8. The weight stack of claim 1, the engagement assembly further comprising a grip member operably connected with the longitudinal member to adjust the rotational position of the longitudinal member;

a second lock member operably associated with the grip member to selectively lock movement of the grip member; and the lock member comprises a key selectively connectable with the longitudinal member.

9. The weight stack of claim 1, wherein the engagement surface for each of the plurality of weight comprises a uniquely shaped engagement surface.

10. The weight stack of claim 9, wherein each of the plurality of weight plates includes an aperture and wherein the weight stack further comprises:

a plurality of collars adapted to be received within the apertures in the plurality of weight plates, each collar defining the uniquely shaped engagement surfaces.

11. The weight stack of claim 9, wherein each uniquely shaped engagement surface is a uniquely sized flange.

12. The weight stack of claim 1, wherein the member comprises a disk including a plurality of curved recesses configured to receive at least a portion of the pin.

* * * * *